US009349288B2

(12) United States Patent
Raamot

(10) Patent No.: US 9,349,288 B2
(45) Date of Patent: May 24, 2016

(54) SELF-CONFIGURING TRAFFIC SIGNAL CONTROLLER

(71) Applicant: Econolite Group, Inc., Anaheim, CA (US)

(72) Inventor: Eric Raamot, Monument, CO (US)

(73) Assignee: Econolite Group, Inc., Anaheim, CA (US)

( * ) Notice: Subject to any disclaimer, the term of this patent is extended or adjusted under 35 U.S.C. 154(b) by 0 days.

(21) Appl. No.: 14/811,686

(22) Filed: Jul. 28, 2015

(65) Prior Publication Data

US 2016/0027300 A1 Jan. 28, 2016

Related U.S. Application Data

(60) Provisional application No. 62/029,857, filed on Jul. 28, 2014.

(51) Int. Cl.

| | |
|---|---|
| ***G08G 1/08*** | (2006.01) |
| ***G08G 1/01*** | (2006.01) |
| ***G08G 1/052*** | (2006.01) |

(52) U.S. Cl.

CPC ..... *G08G 1/08* (2013.01); *G08G 1/0112* (2013.01); *G08G 1/0116* (2013.01); *G08G 1/0129* (2013.01); *G08G 1/0145* (2013.01); *G08G 1/052* (2013.01); *G08G 1/012* (2013.01)

(58) Field of Classification Search

CPC ..... G08G 1/08; G08G 1/0145; G08G 1/00; G08G 1/01; G08G 1/0104; G08G 1/0112; G08G 1/0116; G08G 1/012; G08G 1/081; G08G 1/0129; G08G 1/052

USPC ..... 340/922, 936, 905, 906, 907, 909, 911, 340/912, 913, 914, 916, 919, 921, 923, 929

See application file for complete search history.

(56) References Cited

U.S. PATENT DOCUMENTS

| | | | |
|---|---|---|---|
| 2,550,970 | A | 5/1951 | Richard et al. |
| 2,747,023 | A | 5/1956 | Kurt |

(Continued)

FOREIGN PATENT DOCUMENTS

| | | | |
|---|---|---|---|
| EP | 2187369 | A2 | 5/2010 |

OTHER PUBLICATIONS

Traffic Signals 101, MnDOT—Office of Traffic, Safety & Technology (OTST), Minnesota Department of Transportation, Feb. 2015.

(Continued)

*Primary Examiner* — Steven Lim
*Assistant Examiner* — Mancil Littlejohn, Jr.
(74) *Attorney, Agent, or Firm* — Knobbe Martens Olson & Bear LLP

(57) ABSTRACT

Embodiments describe new mechanisms for signalized intersection control. Embodiments expand inputs beyond traditional traffic control methods to include awareness of agency policies for signalized control, industry standardized calculations for traffic control parameters, geometric awareness of the roadway and/or intersection, and/or input of vehicle trajectory data relative to this intersection geometry. In certain embodiments, these new inputs facilitate a real-time, future-state trajectory modeling of the phase timing and sequencing options for signalized intersection control. Phase selection and timing can be improved or otherwise optimized based upon modeling the signal's future state impact on arriving vehicle trajectories. This improvement or optimization can be performed to reduce or minimize the cost basis of a user definable objective function.

11 Claims, 14 Drawing Sheets

(56) References Cited

U.S. PATENT DOCUMENTS 3,302,015 A 1/1967 Heinz
3,375,494 A 3/1968 Jens et al.
3,833,881 A 9/1974 Drebinger et al.
3,872,422 A 3/1975 Obermaier et al.
3,885,227 A 5/1975 Moissl
3,916,374 A 10/1975 Drebinger et al.
3,962,676 A 6/1976 Maisel
3,968,395 A 7/1976 Obermaier
3,992,671 A 11/1976 Rudmann
4,149,069 A 4/1979 Strelow
4,204,189 A 5/1980 Weyer
4,215,405 A 7/1980 Brunner et al.
4,290,136 A 9/1981 Brunner et al.
4,296,400 A 10/1981 Becker et al.
4,303,905 A 12/1981 Drebinger
4,323,970 A 4/1982 Brunner et al.
4,352,086 A 9/1982 Hunziker
4,356,485 A 10/1982 Boschulte et al.
4,357,593 A 11/1982 Von Tomkewitsch
4,358,749 A 11/1982 Clark
4,369,427 A 1/1983 Drebinger et al.
4,459,561 A 7/1984 Clark et al.
4,486,830 A 12/1984 Taylor, Jr. et al.
4,491,841 A 1/1985 Clark
4,594,681 A 6/1986 Eue et al.
4,641,243 A 2/1987 Hartkopf et al.
4,792,764 A 12/1988 Walker et al.
4,862,162 A 8/1989 Duley
4,873,494 A 10/1989 Jefferis
4,907,160 A 3/1990 Duncan et al.
5,088,010 A 2/1992 Wimmer et al.
5,220,321 A 6/1993 Sauer
5,339,081 A 8/1994 Jefferis et al.
5,365,603 A 11/1994 Karmann
5,475,583 A 12/1995 Bock et al.
5,561,841 A 10/1996 Markus
5,696,502 A 12/1997 Busch et al.
5,775,801 A 7/1998 Shaffer
5,798,949 A * 8/1998 Kaub ..... G08G 1/164 703/6
5,892,226 A 4/1999 Robinson et al.
5,969,642 A 10/1999 Runyon et al.
6,069,452 A 5/2000 Rossner
6,115,010 A 9/2000 Trager
6,144,311 A 11/2000 Hahn et al.
6,208,981 B1 3/2001 Graf et al.
6,282,488 B1 8/2001 Castor et al.
6,313,757 B1 11/2001 Braun
6,489,920 B1 12/2002 Anders et al.
6,529,736 B1 3/2003 Kopetzky
6,556,916 B2 4/2003 Waite et al.
6,650,948 B1 * 11/2003 Atkinson ..... G08G 1/0104 340/995.13
6,653,914 B2 11/2003 Gapski et al.
6,687,607 B2 2/2004 Graf et al.
6,693,557 B2 2/2004 Arnold et al.
6,850,171 B2 2/2005 Mathias
6,956,494 B2 10/2005 Tichborne et al.
6,964,489 B2 11/2005 Blume et al.
6,985,090 B2 1/2006 Ebner et al.
6,999,004 B2 2/2006 Comaniciu et al.
7,027,496 B2 4/2006 Tapaninen
7,129,856 B2 10/2006 Hering et al.
7,161,383 B2 1/2007 Siemers
7,269,502 B2 9/2007 Zhang et al.
7,426,450 B2 9/2008 Arnold et al.
7,427,930 B2 9/2008 Arnold et al.
7,486,681 B2 2/2009 Weber
7,555,046 B2 6/2009 Zoghlami et al.
7,573,400 B2 8/2009 Arnold et al.
7,688,224 B2 3/2010 Teffer et al.
7,698,596 B2 4/2010 Busch et al.
7,807,923 B2 10/2010 Moran
7,848,855 B2 12/2010 Metzler
7,880,436 B2 2/2011 Fischer et al.
7,889,097 B1 2/2011 Arnold et al.
7,889,098 B1 2/2011 Arnold et al.
7,893,846 B2 2/2011 Teffer et al.
7,894,979 B2 2/2011 Mück
7,912,628 B2 * 3/2011 Chapman ..... G01C 21/3691 701/117
7,924,170 B1 4/2011 Arnold et al.
7,948,398 B2 5/2011 Miller
7,991,542 B2 8/2011 Giles et al.
8,035,546 B2 10/2011 Nalezinski et al.
8,050,854 B1 * 11/2011 Chandra ..... G08G 1/081 340/917
8,103,436 B1 1/2012 Chandra et al.
8,161,452 B2 4/2012 Creighton et al.
8,214,092 B2 7/2012 Ghaly
8,217,580 B2 7/2012 Grimm et al.
8,248,272 B2 8/2012 Arnold et al.
8,253,592 B1 8/2012 Chandra et al.
8,297,558 B2 10/2012 O'Dell et al.
8,306,645 B2 11/2012 Giebels et al.
8,344,909 B2 1/2013 Teffer et al.
8,386,156 B2 2/2013 Miller
8,442,749 B2 5/2013 Teffer et al.
8,457,869 B2 6/2013 Wenzel
8,500,071 B2 8/2013 O'Dell
8,514,228 B2 8/2013 Anklam et al.
8,519,868 B2 8/2013 Nadeem et al.
8,531,520 B2 9/2013 Stricklin et al.
8,566,011 B2 10/2013 Tas et al.
8,576,069 B2 11/2013 Nadeem et al.
8,590,844 B2 11/2013 Hogan
8,611,987 B2 12/2013 Allmendinger et al.
8,630,468 B2 1/2014 Klingenbeck
8,653,989 B1 2/2014 Chandra et al.
8,660,215 B2 2/2014 Hogan
8,665,113 B2 3/2014 Arnold et al.
8,676,394 B2 3/2014 Lo et al.
8,695,927 B2 4/2014 Ghaly
8,698,650 B2 4/2014 Bunz et al.
8,702,282 B2 4/2014 Birkholz et al.
8,762,037 B2 6/2014 Teffer et al.
8,804,900 B2 8/2014 Feuerlein et al.
8,805,564 B2 8/2014 Fontanot et al.
8,825,350 B1 9/2014 Robinson
8,849,554 B2 9/2014 Aubrey et al.
8,855,902 B2 10/2014 Neel et al.
8,922,392 B1 12/2014 Chandra et al.
8,933,814 B2 1/2015 Berg et al.
8,976,041 B2 3/2015 Buckel
9,013,325 B2 4/2015 Miller et al.
9,014,486 B2 4/2015 Ernst et al.
9,020,742 B2 4/2015 Neel et al.
9,026,806 B2 5/2015 Falk et al.
2002/0054210 A1 5/2002 Glier et al.
2002/0097276 A1 7/2002 Paulke et al.
2002/0198862 A1 12/2002 Bellmann
2003/0058133 A1 3/2003 Arnold et al.
2003/0060969 A1 3/2003 Waite et al.
2003/0063015 A1 4/2003 Ebner et al.
2003/0063016 A1 4/2003 Mathias
2003/0065625 A1 4/2003 Rosenbaum et al.
2003/0189499 A1 10/2003 Stricklin et al.
2004/0131233 A1 7/2004 Comaniciu et al.
2004/0153340 A1 8/2004 Christ et al.
2004/0174294 A1 9/2004 Arnold et al.
2004/0196891 A1 10/2004 Tapaninen
2004/0201496 A1 10/2004 Hering et al.
2004/0233905 A1 11/2004 Weber
2005/0046597 A1 3/2005 Hutchison et al.
2005/0063182 A1 3/2005 Birch et al.
2005/0122235 A1 6/2005 Teffer et al.
2005/0159991 A1 7/2005 Hashuber et al.
2005/0177342 A1 8/2005 Busch et al.
2005/0271187 A1 12/2005 Bohmer et al.
2006/0008058 A1 1/2006 Dai et al.
2006/0055421 A1 3/2006 Siemers
2006/0181433 A1 8/2006 Wolterman
2006/0191179 A1 8/2006 Gonzalez et al.
2006/0193691 A1 8/2006 Gonzalez et al.

(56) References Cited

U.S. PATENT DOCUMENTS

2006/0203412 A1 9/2006 Schillert et al.
2007/0028233 A1 2/2007 Miller
2007/0096943 A1 5/2007 Arnold et al.
2007/0112471 A1 5/2007 Erkens
2007/0222639 A1* 9/2007 Giles ..... G08G 1/07 340/907
2007/0270120 A1 11/2007 Zhang et al.
2008/0069000 A1 3/2008 Muck
2008/0204277 A1 8/2008 Sumner
2008/0246436 A1 10/2008 Fischer et al.
2008/0284247 A1 11/2008 Metzler
2009/0009362 A1 1/2009 Miller
2009/0015713 A1 1/2009 Horton
2009/0134548 A1 5/2009 Marti
2009/0143928 A1 6/2009 Ghaly
2009/0200056 A1 8/2009 Moran
2009/0256721 A1* 10/2009 Glatfelter ..... G08G 1/01 340/907
2009/0281452 A1 11/2009 Pfister et al.
2010/0007490 A1 1/2010 Kochenburger
2010/0007545 A1 1/2010 Nalezinski et al.
2010/0057240 A1 3/2010 Giebels
2010/0117865 A1 5/2010 Teffer et al.
2010/0141479 A1 6/2010 Arnold et al.
2010/0149020 A1 6/2010 Arnold et al.
2010/0205225 A1 8/2010 Ahlig et al.
2010/0286897 A1 11/2010 Dedic et al.
2010/0305839 A1 12/2010 Wenzel
2010/0324434 A1 12/2010 Allmendinger et al.
2011/0007071 A1 1/2011 Pfister
2011/0095908 A1 4/2011 Nadeem et al.
2011/0106442 A1* 5/2011 Desai ..... G01S 5/0072 701/532
2011/0109479 A1 5/2011 Teffer et al.
2011/0156924 A1 6/2011 Nadeem et al.
2011/0181440 A1 7/2011 Bunz et al.
2011/0201925 A1 8/2011 Lautenschläger
2011/0205086 A1* 8/2011 Lamprecht ..... G08G 1/08 340/928
2011/0274323 A1 11/2011 Klingenbeck
2011/0301928 A1 12/2011 Iffländer
2012/0004783 A1 1/2012 Lo et al.
2012/0026014 A1 2/2012 Miller et al.
2012/0029798 A1 2/2012 Miller
2012/0029799 A1 2/2012 Miller
2012/0069418 A1 3/2012 Kanitz et al.
2012/0081235 A1 4/2012 Nadeem et al.
2012/0083996 A1 4/2012 Tas et al.
2012/0128121 A1 5/2012 Feuerlein et al.
2012/0136243 A1 5/2012 Boese et al.
2012/0198412 A1 8/2012 Creighton et al.
2012/0217350 A1 8/2012 Ghaly
2012/0221281 A1 8/2012 Dreyer et al.
2012/0330580 A1 12/2012 Fruh et al.
2013/0099942 A1* 4/2013 Mantalvanos ..... G08G 1/082 340/910
2013/0129229 A1 5/2013 Ernst et al.
2013/0151135 A1 6/2013 Aubrey et al.
2013/0182619 A1 7/2013 Tiirola et al.
2013/0191189 A1 7/2013 Aparicio et al.
2013/0212378 A1 8/2013 Falk et al.
2013/0262172 A1 10/2013 Blümler
2013/0287261 A1 10/2013 Lee et al.
2013/0300583 A1 11/2013 Wignot et al.
2013/0311791 A1 11/2013 Falk et al.
2014/0047568 A1 2/2014 Falk et al.
2014/0070961 A1 3/2014 Collar et al.
2014/0104072 A1 4/2014 Temming
2014/0104275 A1 4/2014 Boettger et al.
2014/0123760 A1 5/2014 Klos et al.
2014/0126557 A1 5/2014 Kasslatter et al.
2014/0132425 A1 5/2014 Buckel
2014/0138494 A1 5/2014 Ghaly
2014/0139361 A1 5/2014 Arnold et al.
2014/0210645 A1 7/2014 Sharma
2014/0240146 A1 8/2014 Neel et al.
2014/0244145 A1 8/2014 Neel et al.
2014/0266796 A1 9/2014 Kellermann et al.
2014/0324739 A1 10/2014 Claussen et al.
2015/0002315 A1 1/2015 Box et al.
2015/0015420 A1 1/2015 Miller
2015/0033054 A1 1/2015 Armbruster et al.
2015/0046075 A1 2/2015 Neel et al.
2015/0066340 A1 3/2015 Nelson
2015/0100285 A1 4/2015 Heidinger et al.
2015/0194056 A1 7/2015 Neel et al.

OTHER PUBLICATIONS

Scoot—Advice Leaflet1: the "Scoot" Urban Traffic Control System, accessed on Jul. 3, 2015.
Leir, 'Talking Signals Speed Meadows' Traffic Flow, The Observer Online, www.theobserver.com/?p=12106 Oct. 18, 2012.
International Search Report and Written Opinion issued in application No. PCT/US2015/042521 on Jan. 12, 2016.

* cited by examiner

SELF-CONFIGURING TRAFFIC SIGNAL CONTROLLER

INCORPORATION BY REFERENCE TO ANY PRIORITY APPLICATIONS

Any and all applications, if any, for which a foreign or domestic priority claim can be identified in the Application Data Sheet of the present application is hereby incorporated by reference under 37 CFR 1.57.

BACKGROUND

It can be frequently desirable to monitor traffic on roadways and to enable intelligent transportation system controls. For instance, traffic monitoring allows for enhanced control of traffic signals, speed sensing, detection of incidents (e.g., vehicular accidents) and congestion, collection of vehicle count data, flow monitoring, and numerous other objectives.

Existing traffic detection systems can be available in various forms, utilizing a variety of different sensors to gather traffic data. Inductive loop systems can be known that utilize a sensor installed under pavement within a given roadway. Inductive loop sensors can be relatively expensive to install, replace and repair because of the associated road work that may be required to access sensors located under pavement, not to mention lane closures and traffic disruptions associated with such road work. Other types of sensors, such as machine vision and radar sensors can be also used. These different types of sensors each have their own particular advantages and disadvantages.

SUMMARY

In certain embodiments, a self-configuring traffic signal controller system includes a plurality of trajectory sensors including one or more of the following: a radar, a video camera, or a hybrid radar and video camera, each of the trajectory sensors installed on masts, wires, poles, or luminaires at a traffic intersection, some of said masts, wires, or luminaires also including a plurality of traffic signal heads attached thereto. The system can also include a traffic controller including electronic hardware in wireless or wired communication with the trajectory sensors and the traffic signal heads. The traffic controller can be programmed with executable instructions that cause the traffic controller to: obtain, from the trajectory sensors, vehicle trajectory data associated with a plurality of vehicles approaching and traversing the intersection, the vehicle trajectory data including data regarding position, velocity, and acceleration of the plurality of vehicles; transform the vehicle trajectory data into data relative to a coordinate system derived from geometric information about the intersection stored in a memory device at the traffic controller; compute, from at least the vehicle trajectory data, a delay factor representing delay of the vehicles at the intersection, a stop factor representing a number of vehicles stopped at the intersection, a capacity of the intersection reflecting a number of vehicles per minute passing through green lights in each lane, estimated emissions of the vehicles, and a safety factor; compute multiple instances of an objective function with user-defined weights that selectively prioritize one or more of the following factors: the delay factor, the stop factor, the capacity of the intersection, the estimated emissions of the vehicles, and the safety factor; use outputs from the computed objective function instances to adjust signal timing within a cycle at the intersection; and change signal lights at the traffic signal heads according to the adjusted signal timing; wherein the adjusted signal timing based upon at least the vehicle trajectory data has a higher accuracy in adjust signal timing than prior traffic controllers that adjust signal timing based solely upon coarser-grained vehicle positioning information detected by inductive loops or magnetometers installed in roads of the intersection.

The system of the preceding paragraph can be implemented together with any subcombination of the following optional features: the traffic controller also receives preconfigured geometric intersection data into so that the traffic controller is able to map sensor data to appropriate road positions in the intersection so as to detect vehicle trajectories within lanes and with respect to road features such as stop lines; the user-defined weights are derived from agency policies; the traffic controller is further configured to adjust the vehicle trajectory data based on in-ground sensors, connected vehicle output, user device output, and output from second traffic controllers of second intersections adjacent to the intersection; the traffic controller adjusts the signal timing by adjusting green signal timing, yellow clearance timing, and red clearance timing, wherein the adjustment of red clearance timing includes an increase in red clearance timing based on the traffic controller determining that a vehicle is or will run a red light; the traffic controller adjust the signal timing by prolonging or reducing green timing within a single cycle of signal light phases without attempting to optimize cycle offsets of multiple intersections at once or overall cycle time; traffic controller includes a co-processor or separate circuit board that overrides a base functionality of the traffic controller; and the traffic controller use outputs from the computed objective function instances to adjust signal timing within a cycle at the intersection by selecting a traffic phase from a plurality of possible traffic phases and selecting a phase termination time from a plurality of possible phase termination times.

In certain embodiments, a self-configuring traffic signal controller apparatus can include a plurality of inputs that receive sensor signals from a plurality of trajectory sensors at an intersection. Each trajectory sensor can include one or more of the following: an ultrasound sensor, a radar, or a video camera. The apparatus can also include a plurality of outputs that transmit first control signals to traffic signal heads at the intersection to cause the traffic signal heads to selectively turn on and off traffic signals; a storage device having stored thereon geometric intersection data representing a geometry of the intersection and cycle data representing a signal timing configuration for different phases of a signal cycle of the intersection; and electronic hardware that: generates trajectory data from the plurality of inputs and the geometric intersection data, the trajectory data including information representing at least current and predicted future vehicle speeds and positions with respect to the geometric intersection data; automatically reconfigures the signal timing configuration multiple times per day by analyzing the trajectory data according to a balancing of different user-defined factors; and adjusts the plurality of outputs based on the reconfigured signal timing configuration to transmit second control signals to the traffic signal heads to cause the traffic signal heads to selectively turn on and off the traffic signals according to the reconfigured signal timing configuration.

The apparatus of the preceding paragraph can be implemented together with any subcombination of the following optional features: the controller generates the trajectory data in part by sending the geometric intersection data to the trajectory sensors so that the trajectory sensors are configured to send inputs to the traffic controller that are described with respect to a coordinate frame matching a geometry of the intersection; the inputs from the trajectory sensors are not described with respect to a coordinate system corresponding to a geometry of the intersection, and wherein the traffic controller generates the trajectory data by transforming the inputs into the coordinate system based on the geometric intersection data; the controller generates the trajectory data in part from predicted traffic volumes in addition to the inputs received from the trajectory sensors; the controller generates the trajectory data in part from traffic data reported from second traffic controllers of second intersections adjacent to the intersection in addition to the inputs received from the trajectory sensors; the controller generates the trajectory data in part by predicting the future vehicle speeds and positions based on estimated or measured acceleration data; the user-defined factors comprise two or more of the following: delay, vehicle stops, intersection capacity, emissions, and safety; the traffic controller includes a co-processor or separate circuit board that overrides a traffic controller; the traffic controller automatically reconfigures the signal timing configuration by selecting a traffic phase from a plurality of possible traffic phases and selecting a phase termination time from a plurality of possible phase termination times; the traffic controller generates the trajectory data multiple times within a single traffic signal cycle until a calculated time to remain in a current phase has been reached; the calculated time is based on an average time difference between initial vehicle trajectory detection, obtained from the trajectory data, and a time at which vehicles are detected from the plurality of inputs as entering a dilemma zone; the traffic controller automatically reconfigures the signal timing configuration in response to reaching the calculated time.

In certain embodiments, a self-configuring traffic signal controller method, the method including: under control of a traffic controller including electronic hardware, receiving sensor data from a trajectory sensor at an intersection, the trajectory sensor optionally including a radar or video camera; generating trajectory data from the sensor data based on intersection geometric data about the intersection stored in data storage; automatically adjusting a signal timing configuration of the traffic controller by analyzing the trajectory data according to an objective function specified by user-defined policies; and outputting control signals to traffic signal lights according to the adjusted signal timing configuration to cause the traffic signal lights to selectively turn on and off the traffic signals according to the adjusted signal timing configuration.

The method of the preceding paragraph can be implemented together with any subcombination of the following optional features: the sensor data is specified according to a coordinate reference frame related to the geometric intersection data; generating the trajectory data includes using vehicle speeds in the sensor data to predict future vehicle positions with respect to the intersection; automatically adjusting the signal timing configuration of the traffic controller includes adjusting one or more of green time, yellow time, and red time according to predicted future vehicle trajectory; the user-defined policies emphasize some policies over other policies in the objective function; further including providing at least some of the trajectory data to a second traffic controller at another intersection to enable the second traffic controller to use at least some of the trajectory data to adjust signal timing of at the second traffic controller; the objective function is user-definable; automatically reconfiguring the signal timing configuration includes selecting a traffic phase from a plurality of possible traffic phases and selecting a phase termination time from a plurality of possible phase termination times.

In certain embodiments, a self-configuring traffic signal controller apparatus includes a traffic controller including electronic hardware that: receives sensor data from a trajectory sensor at an intersection, the trajectory sensor optionally including a radar or video camera; generates trajectory data from the sensor data based on intersection geometric data about the intersection stored in data storage, the trajectory data including data about vehicles speeds; automatically adjusts a signal timing configuration of the traffic controller by analyzing the trajectory data according to user-defined policies; and outputs control signals to traffic signal lights according to the adjusted signal timing configuration to cause the traffic signal lights to selectively turn on and off the traffic signals according to the adjusted signal timing configuration.

The apparatus of the preceding paragraph can be implemented together with any subcombination of the following optional features: the sensor data is specified according to a coordinate reference frame related to the geometric intersection data; the traffic controller generates the trajectory data by at least using vehicle speeds in the sensor data to predict future vehicle positions with respect to the intersection; the traffic controller generates the trajectory data by at least using vehicle speeds in the sensor data to predict future vehicle speeds with respect to the intersection; the traffic controller automatically adjusts the signal timing configuration of the traffic controller by at least adjusting one or more of green time, yellow time, and red time according to predicted future vehicle trajectory; the user-defined policies weight some policies over other policies; the traffic controller also provides at least some of the trajectory data to a second traffic controller at another intersection to enable the second traffic controller to use at least some of the trajectory data to adjust signal timing of at the second traffic controller; the traffic controller includes a co-processor or separate circuit board that overrides a traffic controller; the traffic controller automatically reconfigures the signal timing configuration by selecting a traffic phase from a plurality of possible traffic phases and selecting a phase termination time from a plurality of possible phase termination times; the traffic controller generates the trajectory data multiple times within a single traffic signal cycle until a calculated time to remain in a current phase has been reached; the calculated time is based on an average time difference between initial vehicle trajectory detection, obtained from the trajectory data, and a time at which vehicles are detected from the plurality of inputs as entering a dilemma zone; and the traffic controller automatically reconfigures the signal timing configuration in response to reaching the calculated time.

Certain aspects, advantages and novel features of the inventions can be described herein. It can be to be understood that not necessarily all such advantages may be achieved in accordance with any particular embodiment of the inventions disclosed herein. Thus, the inventions disclosed herein may be embodied or carried out in a manner that achieves or selects one advantage or group of advantages as taught herein without necessarily achieving other advantages as may be taught or suggested herein.

BRIEF DESCRIPTION OF THE DRAWINGS

The features disclosed herein are described below with reference to the drawings. Throughout the drawings, reference numbers are re-used to indicate correspondence between referenced elements. The drawings are provided to illustrate embodiments of the inventions described herein and not to limit the scope thereof.

DETAILED DESCRIPTION

Figure 1A:
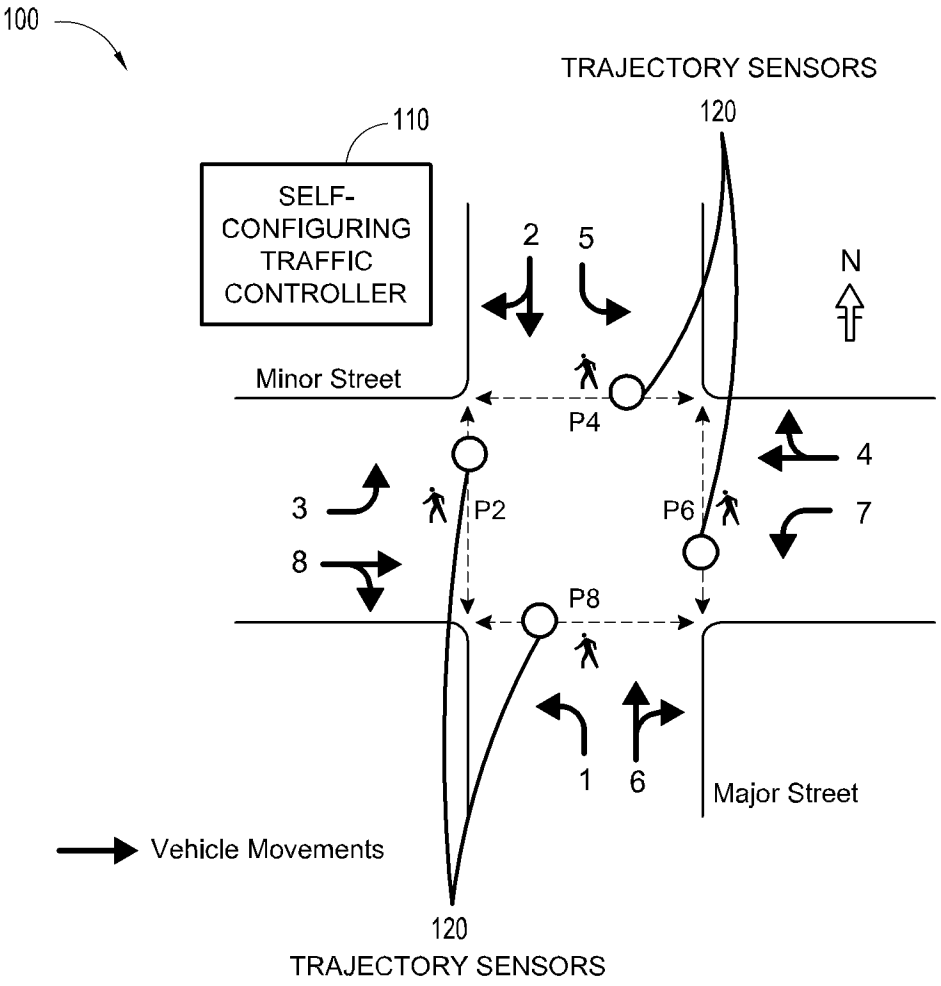
FIGS. 1A and 1B illustrate embodiments of a self-configuring traffic controller at different traffic intersections.

Embodiments of this disclosure describe new mechanisms for signalized intersection control. Embodiments expand inputs beyond traditional traffic control methods to include awareness of agency policies for signalized control, industry standardized calculations for traffic control parameters, geometric awareness of the roadway and/or intersection, and/or input of vehicle trajectory data relative to this intersection geometry. In certain embodiments, these new inputs facilitate a real-time, future-state trajectory modeling of the phase timing and sequencing options for signalized intersection control. Phase selection and timing can be improved or otherwise optimized based upon modeling the signal's future state impact on arriving vehicle trajectories. This improvement or optimization can be performed to reduce or minimize the cost basis of a user definable objective function.

As used herein, the terms "optimal," "optimized," and the like, in addition to having their ordinary meaning, when applied to a traffic controller can sometimes refer to a traffic control scheme that has a lower cost than other traffic control schemes as determined by a set of one or more objective functions. An optimal traffic control scheme may be the best scheme available (e.g., least cost), or an optimal scheme may simply be a scheme that satisfies certain objective function constraints with lower cost than other available scheme without necessarily being the absolute least-cost scheme. As used herein, the term "minimize" and its derivatives, in addition to having their ordinary meaning, when used with respect to an objective function, can mean to find a lower value solution of the objective function than other values, and may, but need not, necessarily mean finding a truly minimal solution to the objective function.

In addition, as used herein, the term "real time," in addition to having its ordinary meaning, can mean rapidly or within a certain expected or predefined time interval, in addition to or instead of meaning "immediately." For instance, real-time traffic controller functions may be performed within milliseconds (or faster), seconds, a few minutes, or within some other short period of time after receiving information that triggers re-configuration of the traffic controller.

1 Introduction

This section provides a technical introduction to current standards and accepted practices for intersection traffic control in North America. Certain inventive traffic controller aspects can be more fully described in detail below.

1.1 Overview: Traffic Control Terminology

Intersection traffic signals (sometimes referred to colloquially as "traffic lights") within North America can be controlled via highly standardized conventions and methodologies. These methods can be constructed upon the base concept of a "traffic phase."

A "traffic phase," or simply "phase," in addition to having its ordinary meaning, can be used herein to mean the green, yellow clearance, and red clearance intervals for any independent movement of traffic (see, e.g., FIG. 1A, described below). A "cycle" of traffic phases, in addition to having its ordinary meaning, can be used herein to mean a sequence of all phases that can be served for an intersection. Phases also have splits within a cycle, such that a phase operates throughout the entire cycle but splits from green to yellow to red during the cycle. A traffic controller may cycle through a first phase where lights can be green on a major road at an intersection and a second phase where lights can be green on a minor road at the same intersection. The completion of both phases would constitute a single cycle. More complicated intersections may include up to 8 or more phases (see FIG. 1A). The control of pedestrian movements can be also constructed from this same phase terminology, through assignment of "pedestrian phases" that can be served in a manner consistent with vehicular traffic phases.

A "movement" of traffic or pedestrians (sometimes called a "movement group"), in addition to having its ordinary meaning, is used herein to refer to a set of vehicles (or pedestrians) moving from an approach to an intersection either through the intersection or into a turn or exit lane. Also as used herein, the term "approach," in addition to having its ordinary meaning, refers to a section of roadway coming into an intersection. An approach may divide into multiple lanes. For example, a two-lane approach may divide at the intersection into two left turn lanes and two through lanes. Vehicles on the approach separate into one of four movements in this example; two left turn movements (corresponding to each left turn lane), a through movement, and a right turn movement.

1.2 Overview: Intersection Traffic Controllers

Intersection traffic controllers, in addition to having their ordinary meaning, can be used herein to mean hardware devices that receive inputs from vehicle and pedestrian detectors at an intersection, render intersection control logic, and then assert the appropriate outputs to the overhead traffic signal indications (also called traffic signal heads). Currently-available traffic controllers perform this phase timing via three stages of activity: pre-configuration, operation, and data collection and reporting. In contrast, a self-configuring traffic controller can be described below in section 2.

1.2.1 Standards for Traffic Control Preconfiguration

The traffic engineer configures the traffic controller before it can be put into operation by establishing control parameters that define the sequencing, timing, and other details of the phase service. Examples of these parameters include minimum green time per phase, yellow clearance time per phase, and phase sequence order. This practice of establishing a pre-configuration can be commonly referred to as signal timing. Modern traffic controllers contain thousands of configurable parameters that can be set by the traffic engineer to optimize the traffic control for a specific intersection. Most of these features may not be applied at every intersection; however, traffic controllers on the market support a broad set of configurable features in order to handle a myriad of intersection geometries and control strategies.

It can be a responsibility of traffic engineers to establish these controller parameters by applying standard calculations and practices as recommended by the USDOT, FHWA, Institute of Transportation Engineers (ITE) as well as localized agency policies. There can be many standardized documents and guidelines regarding traffic signal timing such as: *The Manual on Uniform Traffic Control Devices* (MUTCD) (Reference: 23 Code of Federal Regulations (CFR), Part 655, Subpart F); *The FHWA Traffic Signal Timing Manual* (STM) (Reference: HOP-08024); and *The Highway Capacity Manual* (HCM) (Reference: http://hcm.trb.org/), each of which can be hereby incorporated by reference in its entirety. These documents define the regulations, methodologies, common practices, and mechanisms of measurement for efficient and safe signal timing.

Several standards have been developed that govern the specifications and feature sets within the traffic controller and intersection control equipment. Common standards applied to signal control in North America include: NEMA TS-2—Traffic Controller Assemblies with NTCIP may requirements, as published by National Electrical Manufacturers Association (NEMA). This standard governs hardware and software, encompassing both design and operation of traffic controllers. NTCIP—The National Transportation Communications for Intelligent Transportation System Protocol can be a joint standardization project of AASHTO, ITE, and NEMA. This protocol defines many of the configuration features and resultant functionality often implemented in a traffic controller.

1.2.2 Process for Traffic Control Preconfiguration

Collectively, the traffic control industry's framework reveals a highly standardized and accepted process for signal timing, initiated by establishing policies for signal control. These policies can be then applied under location-specific considerations through a complex signal timing process. The output of this timing may requires ongoing operations and maintenance in order to ensure the signals can be operating with efficiency and safety, while remaining consistent to agency policies.

The *Traffic Signal Timing Manual* (STM) can be a 273-page guide covering the timing process from the initial establishment of policies, to implementation within the actual traffic controller configuration, as well as ongoing system maintenance. This can be a very labor-intensive process that traffic engineers should follow to establish proper signal configuration. Once proper timing can be established, traffic engineers constantly monitor operations and should expect to completely re-optimize the controller configuration every 3-7 years in order to handle changes in traffic patterns. This signal retiming can be a significant sustaining cost for most transportation agencies, with typical signal retiming costs estimated at approximately $3,000-5,000 per signal. The STM reveals the arduous level of user interaction may be required to implement this signal timing process.

Most agencies lack the resources to properly follow this process. The National Transportation Operations Coalition (NTOC) asks transportation professionals to provide a self-assessment of their ability to maintain good signal timing practices. Respondents to this survey encompass 39% of all of the traffic signals in the United States. This response provides an overall self-assessment grade of D+ across all categories. Given the processes for signal timing can be well established, this response reveals that agencies do not have the manpower nor financial mechanism to maintain good signal timing across their jurisdictions.

1.3 Traffic Controller Operation

Traffic controllers apply the base configuration as established by the traffic engineer. They additionally receive input of real-time detection of vehicle or pedestrian position information to better serve demand within the intersection. Vehicle detectors can be commonly wire loop, video, or radar detection devices that identify vehicle position by identifying when a vehicle occupies the roadway in front of the stop line (sometimes referred to as a "stop bar") at an intersection. This real-time vehicle presence can be passed to the traffic controller, informing it as to which phases have demand for service so that signals do not serve extraneous green time for a phase that has no traffic present.

Figure 1B:
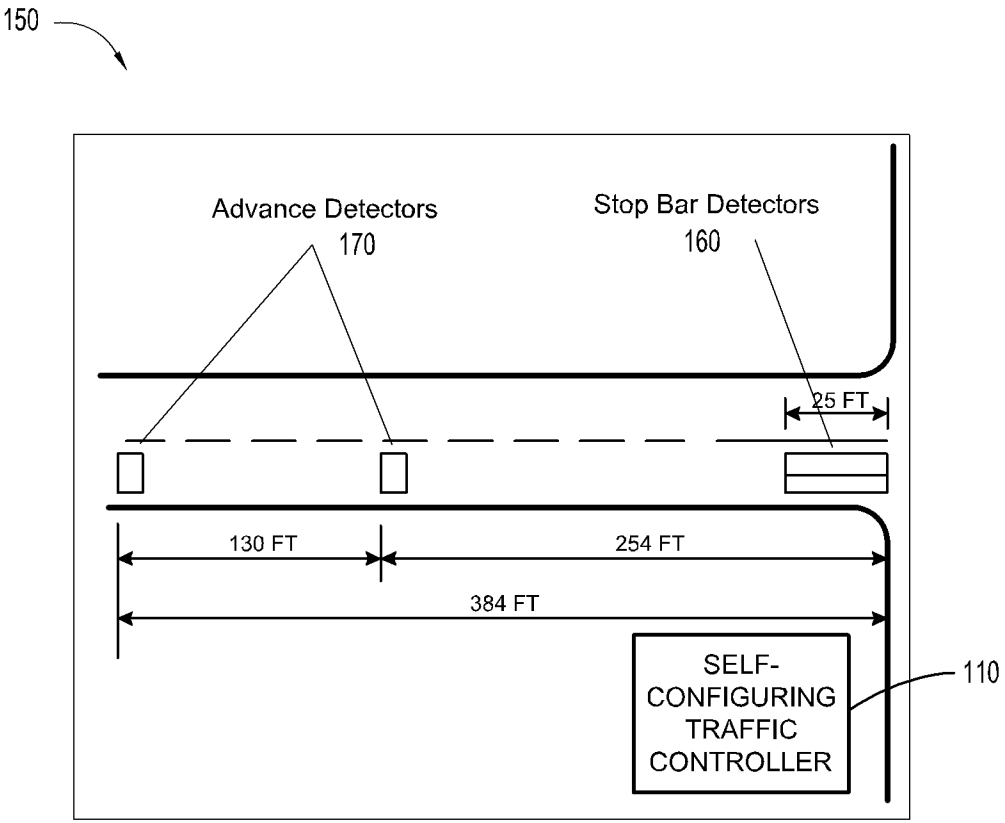

Certain intersections may also have vehicle detectors placed several hundred feet upstream of the intersection (see, e.g., FIG. 1B). Detection at these locations allows the traffic controller to determine when there can be a gap between arriving vehicles. Signal controllers have used these detectors for gap logic algorithms that determine the most appropriate duration and termination point for a green interval.

Most agencies cannot afford the costs associated with vehicle detection on all intersection approaches. They can judiciously determine the locations and movements where detection can be implemented. Traffic control falls into basic levels of service based upon the detection available at the approach to the intersection: No detection, stop line detection, and advance detection.

No detection: Approaches that have no detection can be placed on a phase recall, where the phase can be served for a predetermined amount of time each cycle regardless of actual vehicle demand. This can be common practice on main street movements where vehicle demand can be assumed to be constantly present.

Stop line detection: Approaches with stop line detection can run in an actuated mode where the phase can be not served if no vehicles can be detected at the stop line. Phase green can be commonly extended while cars can be detected at the stop line up to some predefined maximal value.

Advance detection: Approaches with advance detection can determine gaps in traffic platoons to determine a safe point of green termination, and they additionally can measure the vehicle arrival time at the intersection as well as queue lengths of vehicles awaiting service. Advance detection can be usually applied on main street approaches that have higher approach speeds or along arterials.

1.4 Traffic Controller Limitations

NTCIP and NEMA based traffic controllers utilize a numeric phase convention for the traffic movements that can be served. Within this convention, each phase can be treated with geometric independence and does not represent any of the geometric information of the intersection including whether the movement can be a main-street, side-street, turning or through movement. Moreover, traffic controllers do not have information regarding the number of lanes, spatial orientation, size of the intersection or other geometric information of the intersection. Traffic controllers do not utilize maps of the local intersection and can be limited to control these phases without regard for the intersection geometrics.

The control strategy in place by both NEMA TS-2 and NTCIP 1202 utilizes stop line presence and advance detector presence as the basis of real-time traffic demand inputs. Traffic controllers do not utilize the spatial positioning or velocity of vehicles in real-time, but rather derive their control methodologies from the presence of vehicles over these point-source detectors.

Moreover, the current state of practice for traffic agencies merely calls for the basic mindfulness of traffic control policies while configuring the traffic controller. Configuration of the traffic controller can be a very manually-intensive process that may requires the traffic engineer to provide many manual data inputs and perform manual calculations. This ad-hoc practice can be both arduous and fraught with human error. Traffic controllers do not have awareness of these policies and thus can do little to ensure that initial configuration or future operation can be consistent with these policies.

2 Overview of Self-Configuring Traffic Controller Embodiments

This section provides a brief overview of a self-configuring traffic controller. More detailed embodiments are described below in sections 3 and 4.

2.1 Example Innovative Approach:

Certain embodiments of the traffic controller described herein overcome these limitations by providing the traffic controller with geometric awareness of the intersection, vehicle trajectory data as an input for vehicle demand, as well as awareness of the traffic policies and standardized timing practices. This broadened awareness may open a platform for an entirely new set of traffic control strategies, optimization models, and features. The terms "trajectory," "vehicle trajectory," and the like, in addition to having their ordinary meaning, are used herein to refer to a path of a vehicle with respect to an intersection. For example, a trajectory of a vehicle may refer to any combination of position, speed (or velocity), and acceleration (including solely position or solely speed or solely acceleration). In some embodiments, speed is an important aspect of vehicle trajectory that provides advantages over existing position-based traffic detection systems, but its inclusion in all embodiments is not required to achieve at least some advantages described herein. The path of the vehicle can be specified at a single point in time (e.g., single position, speed/velocity, or acceleration) or over multiple points in time (e.g., multiple positions, speeds/velocities, or accelerations). The trajectory may be expressed in vector form (e.g., velocity) or scalar form (e.g., speed). The position of a vehicle may also be expressed as a global position (e.g., latitude/longitude) or a position relative to an intersection feature (e.g., stop line) or other landmark. The position of a vehicle's trajectory may include or take into account the curvature of a road or turning movements of the vehicle. A vehicle's trajectory may include position, speed, or acceleration data on an approach to an intersection, within an intersection itself, or exiting the intersection. The trajectory of a vehicle may include past, present, or future predicted position, speed, or acceleration information. In some embodiments, predicting future trajectory information provides advantages over existing traffic controller systems, but its inclusion in all embodiments is not required to achieve at least some advantages described herein.

The traffic controller can have a broadened awareness of these manual inputs to traffic control. This awareness can overcome historic impediments of the standardized solution and can facilitate a completely new approach to signal timing. The traffic controller can utilize geometric awareness of the intersection, as well the real-time vehicle trajectories within the intersection, to provide a more automated mechanism of implementing these traditional practices. Furthermore, the traffic controller may transcend the prior efficiency and safety limitations within the standardized mechanism of traffic control. This innovative approach can create new traffic control advantages: In one embodiment, the traffic controller described herein implements mechanisms for automated signalized intersection control utilizing awareness of roadway geometry, real-time vehicle trajectories, and/or agency policies for signalized intersection control.

The traffic controller can utilize policy-level inputs, geometric modeling of the intersection, vehicle trajectory data, and/or automated calculation of standardized traffic engineering practices to transcend the current nature of traffic control beyond the current practice of NTCIP feature-level tuning. The traffic controller can also offer a platform for traffic control via policy selection and optimization of signal timing consistent to user-defined, strategic objectives.

By way of overview, FIGS. 1A and 1B illustrate embodiments of a self-configuring traffic controller 110 at different traffic intersections 100, 150. In FIG. 1A, major and minor streets are shown, with phases 1-8 depicted as arrows representing vehicle movements on each street. An example sequence of phases may be: phases 1&5 active at the same time, followed by phases 2&6 active at the same time, followed by phases 3&7 active at the same time, followed by phases 4&8 active at the same time, which completes a cycle (which then repeats possibly indefinitely). Pedestrian phases P2, P4, P6, and P8 are also shown and can occur along with their respective roadway phases 2, 4, 6, and 8.

A self-configuring traffic controller 110 is installed at the intersection as shown in both FIGS. 1A and 1 B. The traffic controller 110 may include electronic hardware installed in a traffic controller cabinet or the like, which may be affixed to a concrete pad near the intersection, buried underground, attached to a pole, or a combination of the same. An example traffic controller cabinet may include a power panel to distribute electrical power in the cabinet; a detector interface panel to connect to either in-ground detectors 160, 170 (FIG. 1B), trajectory sensors 120 (FIG. 1A), or both; detector and/or sensor amplifiers; the traffic controller 110 itself; a conflict monitor unit; flash transfer relays; a police panel to allow the police to disable traffic signals; an optional battery or uninterruptable power supply (UPS), and optionally other components.

In FIG. 1A, trajectory sensors 120 are shown. The trajectory sensors may be radar (e.g., microwave), ultrasound, video camera, infrared sensors, or hybrid sensors, such as the hybrid radar/video camera sensor described in U.S. Pat. No. 8,849,554, titled "Hybrid Traffic System and Associated Method," issued on Sep. 30, 2014, which is hereby incorporated by reference in its entirety. The hybrid sensor may also be a hybrid of any combination of the radar, ultrasound, infrared, or video sensors. The trajectory sensors 120 can be supported by a support structure (not shown), such as a mast arm, suspended wire, luminaire, pole, traffic signal head, or other suitable structure at the intersection. For example, a trajectory sensor 120 may be placed on a mast arm near a traffic signal head, pointing in the direction of oncoming traffic so as to sense oncoming traffic. In contrast, FIG. 1B shows in-ground sensors, including stop line detectors 160 and advance detectors 170. These in-ground detectors may be inductive loop detectors, magnetometers, pneumatic road tubes, piezo-electric sensors, or the like.

Advantageously, in certain embodiments, the traffic controller 110 may be self-configuring based on inputs from the trajectory sensors 120 (FIG. 1A) and/or in-ground detectors 160, 170 (FIG. 1B). Specifically, the traffic controller 110 can reconfigure the signal timing within a cycle at the intersection based on detected current and/or projected future vehicle trajectories. For example, the traffic controller 110 can extend or reduce green timing, yellow clearance timing, red clearance timing, and the like based on detected vehicle trajectories. Adjusting signal timing based on vehicle trajectories, present and/or future, can result in finer-grained control and more efficient control of the intersection than coarser adjustments based on vehicle position detection using in-ground detectors 160, 170. However, the traffic controller 110 may also use data obtained from the in-ground detectors 160, 170 to refine signal timing, as will be described in greater detail below.

Figure 2:
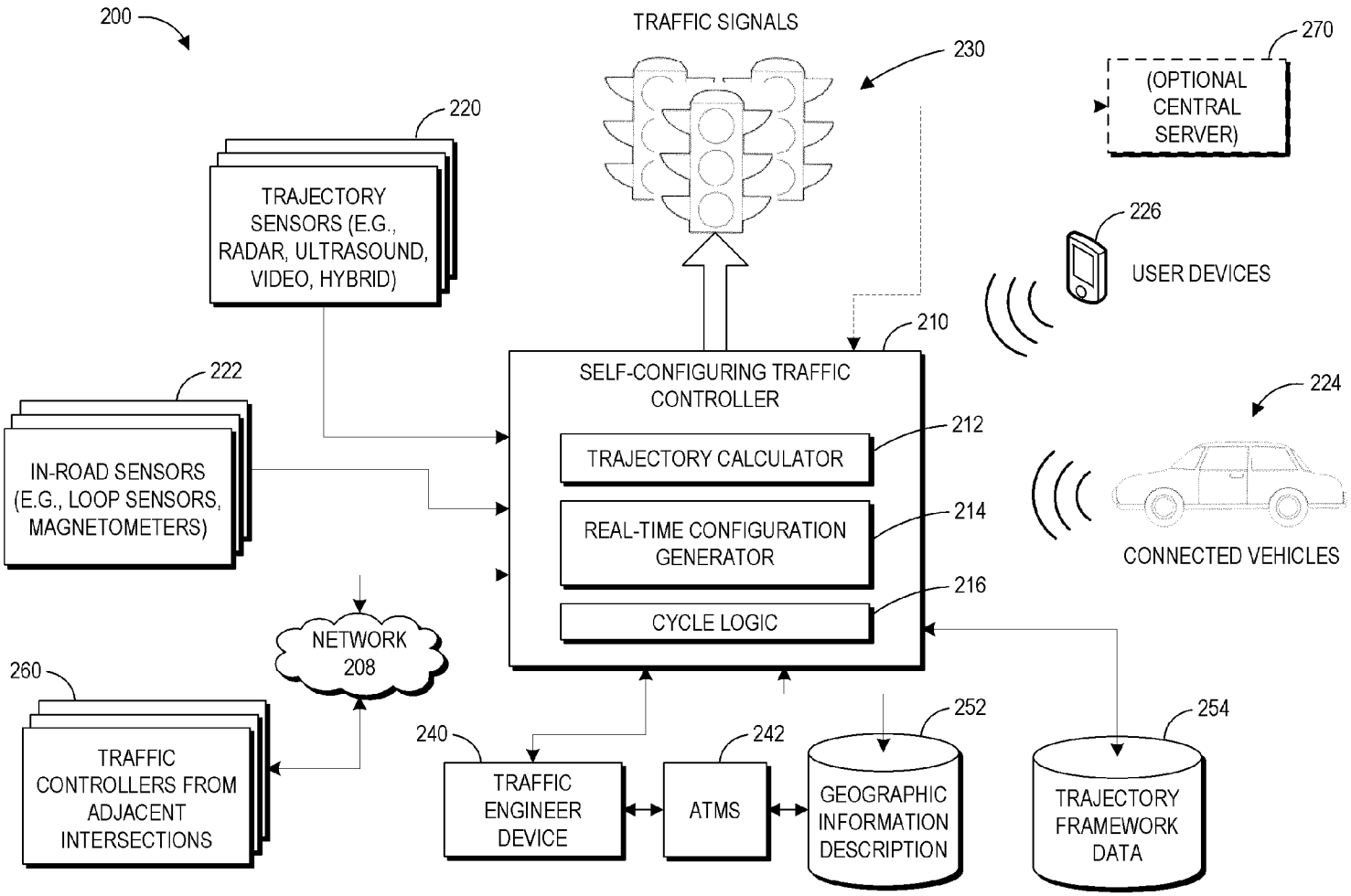
FIG. 2 depicts an embodiment of a traffic intersection environment including an example self-configuring traffic controller.

FIG. 2 depicts a more detailed embodiment of a traffic intersection environment 200 including an example self-configuring traffic controller 210. Each of the components shown may be in wired or wireless communication with one another.

The traffic controller 210 may have all the functionality and features of the traffic controller 110. The traffic controller 210 communicates with trajectory sensors 220, optionally in-road sensors 222, and traffic signals 230. The traffic signals 230 may be traffic signal heads installed at the intersection or may be traffic signals displayed on an in-vehicle display, heads-up display (HUD), or cellular device application, which are controlled via wireless communication with the traffic controller 210. In addition, the traffic controller 210 can receive trajectory information from connected vehicles 224 and user devices 226 of drivers or pedestrians (such as cell phones, smartphones, tablets, laptops, smart watches, other wearable computing devices, and the like). These inputs are described in greater detail below in section 3. The traffic controller 210 is also shown in optional communication with adjacent intersections' traffic controllers 260 over a network 208, which may be a local area network (LAN), wide area network (WAN), an Intranet, the Internet, or the like. This connection with adjacent intersections can further supply additional trajectory information from the adjacent intersections' traffic controllers 260.

The traffic controller 210 may include many hardware and software components, some of which are described above with respect to FIGS. 1A and 1B. For instance, the traffic controller 210 may include a hardware processor, digital logic circuitry, memory, persistent storage hardware, and the like that can store and implement computer-executable instructions that perform traffic control-related functions. Some functionality of the traffic controller 210 is grouped into components shown, including a trajectory calculator 212, a real-time configuration generator 214, and cycle logic 216. The trajectory calculator 212 can compute vehicle trajectories or a trajectory framework (described below) based on data received from trajectory sensors 220, in-road sensors 222, and adjacent intersections' traffic controllers 260. The trajectory calculator 212 may also base the trajectory information off of features of the intersection, including the geometry of the intersection, stored in a geographic information description 252 (which may be a database or the like) and/or in a trajectory framework database 254. The geographic information description 252 may include map components (such as data on the stop line, lane segment points, and the like). The geographic location of relevant attributes of the intersection may be extracted from various map data sources and stored in a geographic information description (GID) 252. This GID may then be converted by the ATMS 242 to reveal geometric constraints that will affect the vehicle trajectories as they drive through the roadway network. The geometric properties of the roadway network may be stored in a data structure referred to as the trajectory framework. This trajectory framework can include data that supports overlay of vehicle trajectory data relative to the roadway geometries, allowing modeling of past, present, and/or future vehicle trajectories relative to the traffic signalization. This trajectory framework information may be stored in the trajectory framework database 254. The configuration generator 214 can use this trajectory information to update the signal timing configuration of the traffic controller 210. More detailed components of the configuration generator 214 are described below. The cycle logic 216 can include logic for actuating different signal lights according to the configuration generated by the configuration generator 214, for example, by actuating relays or other electrical switches that selectively send electrical signals to turn on and off the signal lights.

Figure 5:
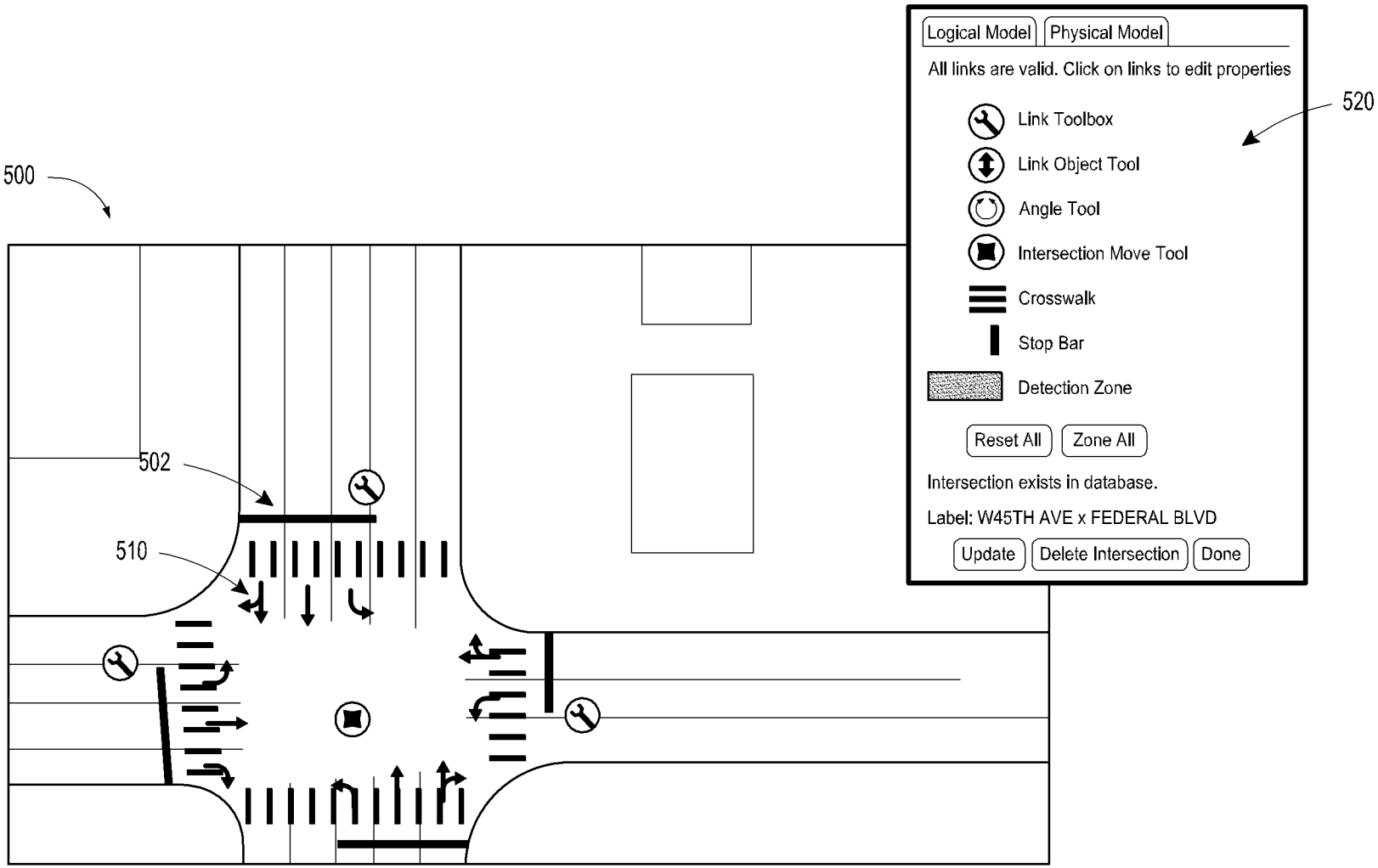
FIG. 5 depicts an example user interface for specifying the geometry of an intersection.

A traffic engineer device 240 is shown in communication with the traffic controller 210. This device 240 may be any computing device used by a traffic engineer to preconfigure and/or adjust parameters of the traffic controller 210. The traffic engineer device 240 is also shown accessing an Advanced Traffic Management Systems (ATMS) 242. The ATMS 242 may provide functionality for specifying the intersection geometry data associated with the intersection, which stores this information in the geographic information description (GID) 252. An example user interface that may be generated by the ATMS 242 for specifying intersection geometry is shown in FIG. 5 and described in greater detail below in this section and in section 3.

The traffic controller 210 can also communicate with an optional central server 270. The central server 270 can also be accessed by the traffic engineer device 240 in some embodiments and may be used to adjust control parameters for a plurality of intersection traffic controllers 210 throughout a region, such as a city, state, country, or territory. Further, in other embodiments, the features of the traffic controller 210 described herein, or some subset thereof, may be implemented by a co-processor system (not shown). The co-processor system may be a circuit board, such as a daughter board coupled to the traffic controller 210's circuit board, which analyzes trajectory information and sends override signals to adjust signal timing of the traffic controller 210. In such a configuration, the traffic controller 210 can act as a slave device to the co-processor. Other embodiments may utilize a separate computer board that communicates control to the slave traffic controller via an IP socket (or other connection). More generally, the co-processor or separate computer board and the base traffic controller 210 together may be considered a traffic controller. Thus, embodiments that describe a traffic controller herein can refer to a base traffic controller configured to have the features described herein, a co-processor or separate circuit board that implements these features and that communicates with a base traffic controller, or a combination of both a base traffic controller and a co-processor or separate board.

Figure 3:
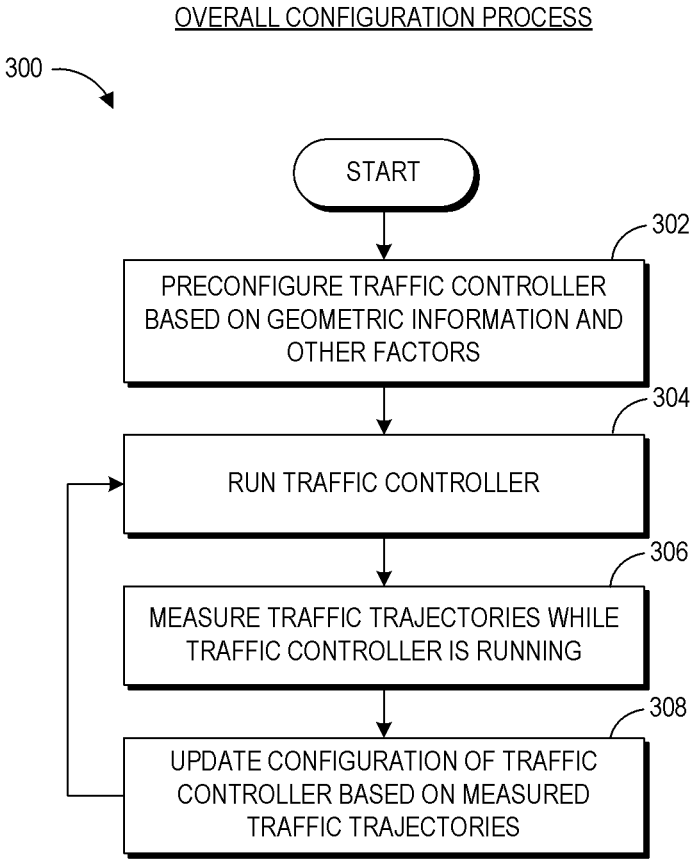
FIG. 3 depicts an embodiment of an overall traffic controller configuration process.

FIG. 3 depicts an embodiment of an overall traffic controller configuration process 310. The traffic controller configuration process 310 may be implemented by the traffic controller 110 or 210. At block 302, the traffic controller is preconfigured (e.g., by a traffic engineer) based on geometric information and other factors. This preconfiguration step may take into account the preconfiguration inputs shown in FIG. 4 and described in detail below in section 3. Once the preconfiguration has completed, the traffic controller is run for the first time at block 304. With the traffic controller running, the traffic controller measures traffic trajectories at block 306 using, for example, the trajectory sensors described above. The traffic controller then updates the configuration of the traffic controller (e.g., signal timing) based on the measured traffic trajectories at block 308.

Figure 4:
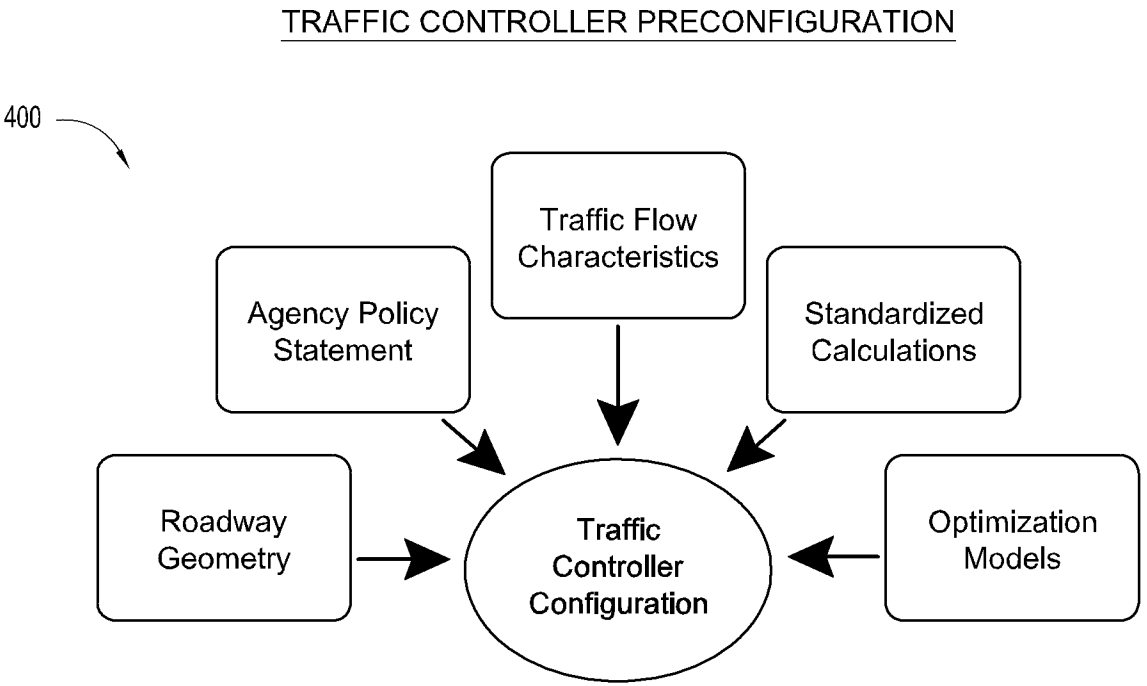
FIG. 4 depicts a block diagram representing an embodiment of traffic controller preconfiguration.

FIG. 4 depicts a block diagram representing an embodiment of traffic controller preconfiguration 400. The traffic controller 110 or 210 can be preconfigured using the inputs shown, including roadway geometry, agency policy statement(s), traffic flow characteristics, standardized calculations, and optimization models. Each of these features is described in greater detail below in section 3.

FIG. 5 depicts an example user interface 500 for specifying the geometry of an intersection in the preconfiguration process (block 302 of FIG. 3). The user interface 500 may be output by the ATMS 242 and includes user interface controls 520 for specifying GID data such as stop lines 502, movements 510, and other intersection geometry. These features are described in greater detail below.

Figure 6:
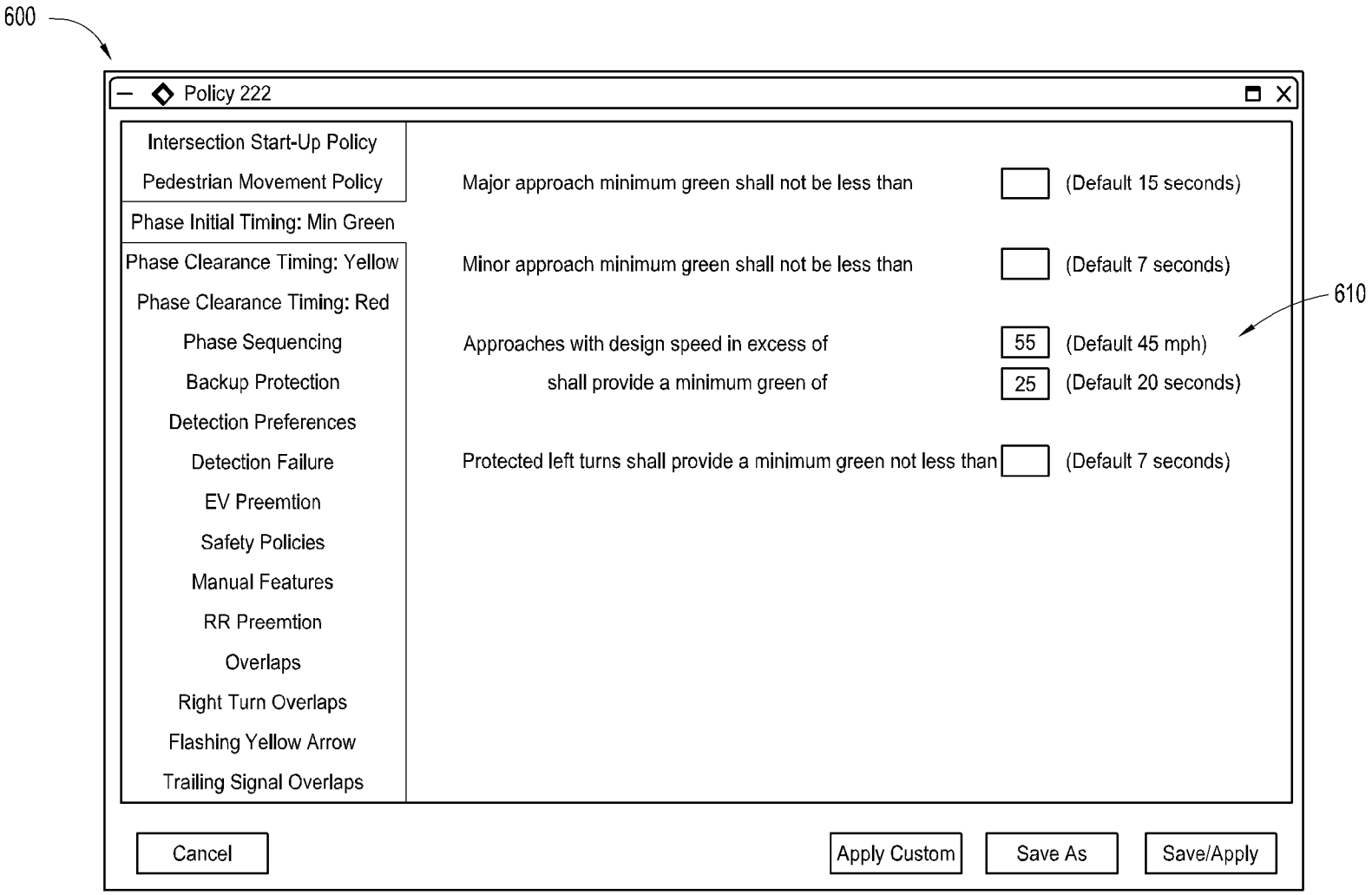
FIG. 6 depicts an example user interface for specifying agency policies that affect signal timing.

FIG. 6 depicts an example user interface 600 for specifying agency policies that affect signal timing. The user interface 600 includes controls 610 for specifying different policies and may be used by a traffic engineer during the preconfiguration process. Many detailed examples of policies that may be specified using the user interface 600 or user interfaces similar to the user interface 600 are described in detail below in section 3.

The following sections 3 and 4 provide a more detailed example implementation of the design framework for the self-configuring traffic controller 210. For convenience, the remainder of this specification refers to the traffic controller 210, but embodiments equally apply to the traffic controller 110.

Section 3—System Inputs: This section provides an overview of the processing that can be performed by each of these new input types to provide broader controller awareness. This increased system awareness can facilitate advancements to signalized control.

Section 4—Signal Control via Trajectory Modeling: This section describes the mechanism for real time signal control utilizing a vehicle trajectory model and its projected impacts of future state signal timing changes upon these vehicle trajectories.

3 System Inputs

This section details embodiments of input parameters used by the self-configuring traffic controller 210 (or simply "the traffic controller 210") as well as suggests user interfaces for the traffic engineer devices (which implement or access Advanced Traffic Management Systems (ATMS)) that can be used to manage the user setup of the traffic controller 210.

3.1 Background

Traffic engineers have followed a standardized process to generate the pre-configuration of currently-available traffic controllers. This process can be multi-staged, and may requires considerable human-in-the-loop computation and analysis. A genericized overview of this traditional process includes:

TABLE 1

| Traffic Controller Pre-configuration Stages: |
|---|
| 1. Site/Map survey to retrieve intersection geometry. |
| 2. Define traffic control policies that should apply given local, state and federal guidelines. |
| 3. Measure/estimate traffic flow characteristics by various times of day across network (arterial or grid) of intersections. |
| 4. Define base timing parameters using intersection geometry, traffic flow characteristics, and agency policy. |
| 5. Perform offline optimization of coordination parameters using a software modeling and optimization package. |
| 6. Export parameters into controller pre-configuration. |
| 7. Download and validate controller pre-configuration, often requiring "fine-tuning" of parameters to accommodate real world operation. |

The traffic controller 210 may use several software components that automate and simplify this traditional preconfiguration process. The sections that follow expand upon an example software architecture for each of these components, each of which may be implemented as sub-components of the real-time configuration generator 214 of FIG. 2:

TABLE 2

| Traffic Controller Pre-configuration Stages | Traffic Controller Pre-Component |
|---|---|
| 1. Site/Map survey to retrieve intersection geometry. | GID Editor: The ATMS 242 system can provide a visual software tool (see, e.g., FIG. 5) that allows a simplified end-user generation of the map data. The traffic controller 210 can export a Geographic Information Description (GID) from this tool. |
| 2. Define traffic control policies that should apply given local, state and federal guidelines. | Policy Editor: The ATMS 242 system can provide a software tool that supports end user configuration of traffic control policies that can be scheduled to apply on a system-wide, sectional, or localized basis. |
| 3. Measure/estimate traffic flow characteristics by various times of day across network (arterial or grid) of intersections. | Traffic Flow Datasets: The traffic controller 210 measures and records traffic flow characteristics at the local intersection. These data flows can be fed back into the pre-configuration, providing an automated self-tuning of the controller. |
| 4. Define base timing parameters using intersection geometry, traffic flow characteristics, and agency policy. | Preconfiguration Generator: The traffic controller 210 automatically performs HCM and STM based calculations to generate the controller pre-configuration. |
| 5. Perform offline optimization of coordination parameters using a software modeling and optimization package. | Timing Plan Generator: The traffic controller 210, in conjunction with ATMS 242, automatically optimizes the coordination parameters based upon historic flow data from the Traffic Flow Datasets. |

TABLE 2-continued

| Traffic Controller Pre-configuration Stages | Traffic Controller Pre-Component |
|---|---|
| 6. Export parameters into controller pre-configuration. | NTCIP 1201 & 1202 MIB: The outputs from the Preconfiguration Generator and Timing Plan Generator can be stored as standard NTCIP objects. The traffic controller 210 supports central system download of this preconfiguration data using standardized NTCIP interfaces. |
| 7. Download and validate controller pre-configuration, often requiring "fine-tuning" of parameters to accommodate real world operation. | Real Time Configuration Updater: The Configuration and Timing Plan generators can be recurrently reprocessed to generate updated signal timing parameters. Using these tools, The traffic controller 210 performs adjustments of the pre-configuration in real time to accommodate changes in traffic flow. |

3.2 Roadway Geometry: Intersection Geometric Data

One example feature of the traffic controller 210 can be to provide the traffic controller 210 with geometric awareness of the intersection. In order to meet a design goal of simplifying the user-interfacing for pre-configuration, embodiments of a tool (e.g., the ATMS 242) can be provided that can allow a simplified generation and import of geometric elements into the traffic controller 210.

This software tool can allow end users to load in a map source and identify roadway geometric characteristics that have relevance to the traffic controller 210. This tool was developed using the MapDotNet™ mapping engine and supports loading of Google™ Maps, Bing™ Maps, Navteq™ Maps, or other base map sources.

This software tool was designed to allow a traffic engineer to simply draw out an overlay of the relevant geometric elements that can be used by the traffic controller 210, using the traffic engineer device 240. The end user (e.g., traffic engineer) can configure the following elements via a visual overlay (such as shown in FIG. 5) using this software tool: Stop lines, Lanes, Approach segments for each lane, lane end points, Permitted turning movements (seen as yellow arrows in image), Crosswalks, Detection Zones, Design speed (if not included within source map), Approach grade (if not included within source map), Peer intersection IP address for each approach (can be auto-populated from System level maps). The traffic engineer (or other end user) can fully configure the needed geometric elements for an intersection quickly, e.g., in less than 5 minutes using this overlay tool.

Users can save and re-open any intersection configuration under any state of completeness. Once the intersection overlays can be complete, the configuration generated within this tool can be exportable into a Geographic Information Description (GID) format for storage in the GID database 252.

3.2.1 Example Geographic Information Description (GID) File Formats:

This section describes an example GID file format that the traffic controller 210 can support as an interface from the aforementioned map editing tool and represents an example format for storing GID data in the database 252. This format can allow the traffic controller 210 to extract the geometric data needed for traffic control.

3.2.1.1 Spatial Reference Frame and Data Types:

The GID stores spatial data using Decimal Degree (DD) units of Latitude and Longitude. To simplify and reduce data storage for the intersection features, the GID defines a point of localized origin within the intersection using the global latitude and longitude coordinates, which may be treated as Cartesian coordinates within a localized area (e.g., an intersection), in DD format. Some or all other geometric intersection features can be then stored as a set of relative decimal degree (RDD) positions from this origin point. This DD data storage can be rounded to the nearest 6th decimal point, providing resolution of: GID Geographic resolution=0.000001 DD=0.111 meters. Other resolutions can be possible in other implementations.

The GID was designed with intention to be stored as well as accessed by applications running upon the ITE standard, Advanced Traffic Controller (ATC v6.1) engine board in the traffic controller 210. This ATC standard does not may require a floating point (co-processing) unit. Resultantly, the algorithms that utilize the GID data can reduce the use of arithmetic floating point operations. In support of this design requirement, the GID stores some or all DD types in a signed integer type with an assumed resolution of 6 decimal places: GID integer storage: 0.000001 DD can be stored as 0x0000 0001 (signed 32 bit integer). In other embodiments, the traffic controller 210 can include a floating-point processor instead of or in addition to performing fixed point arithmetic.

3.2.1.2 Data Elements:

In one example embodiment, the following geometric data can be provided within the GID:

1. Intersection Origin: (DD) The origin can be a full global position {Latitude, Longitude} that can be defined anywhere within close proximity to the intersection (recommended to be the centroid of the intersection). The other geometric elements within the GID can be defined with a relative latitude and longitude offsets from this point of origin.
2. Approach Data (1-16): The GID defines up to 16 roadway approaches to the intersection. Each approach supports the following data:
3. Number of Lanes (1-8): The traffic controller 210 supports up to 8 lanes per approach (although more be supported in other embodiments). The innermost (left hand) lane of the approach can be selected as lane 1. This data element defines the total number of lanes for the designated approach.
4. Lane 1-8: The following data can be stored for each lane:
   a. Allowable movements: Each lane supports mapping of the phase and overlaps that can control the protected and/or permissive movements of the lane. These phase and overlaps can be stored in an unsigned 32 bit integer with the least significant bit (LSB) designating phase 1 or overlap A.

b. Protected Phases (32 bitfield): Bitfield of phases that control protected green movement of the lane.
c. Permitted Phases (32 bitfield): Bitfield of phases that control permitted green movement of the lane.
d. Conflicting Phases: Bitfield of phases that cannot be served concurrently with the lane due to geometric conflict.
e. Protected Overlaps (32 bitfield): Bitfield of overlaps that control protected green movement of the lane.
f. Permitted Overlaps (32 bitfield): Bitfield of overlaps that control permitted green movement of the lane.
g. Stop Line {Lat,Long}: The stop line point for the designated lane can be defined at where the leading edge of the approach stop line and lane centerline intersect.
h. Lane Segment #1-8 {Lat,Long}: Segments of the approach lane segments can be defined at arbitrary distances from the stop line along lane centerline. This can be used to define roadway curvature for the approach. A stop line, in addition to having its ordinary meaning, is generally a designed (e.g., painted line) or de factor (not indicated on the pavement) location where traffic is required to stop in the direction of approach of a roadway intersection (see, e.g., element 502 of FIG. 5).
i. Lane Width (0-10.0 m): Width of the lane in meters.
j. Design Free Flow Speed (Optional): Design speed of the intersection based upon the expected 85% speed. The traffic controller 210 can measure and update this speed.
k. Bicycle Lane: (0=no, 1=yes): Designation that the lane can be for exclusive use by bicycles.
l. Turn Pocket Opening {Lat,Long}: This data applies to dedicated turning movement lanes, defined as furthest upstream point where the turn pocket storage begins.
m. Intersection Endpoint (Width) {Lat,Long}: This can be the point across the intersection where a vehicle in the lane has fully cleared the intersection. This point can be defined for through movements as well as turning movements in accordance with local policy or state law.

5. Crosswalk {Lat,Long}: Endpoints (2) of crosswalk defined in accordance with local policy or state law. Manual on Uniform Traffic Control Devices (MUTCD) defines these points at the curbline for the crosswalk.
6. Approach Grade (+/−0-12%): Average roadway grade in approach to the intersection. Recommended practice can be to use an average grade from the point of dilemma zone to the stop line.
7. Peer Intersection: The traffic controller 210 can utilize awareness of the up/downstream traffic signals on the roadway network to convey vehicle trajectory information. Each approach can support configuration of the peer intersection information including:
   a. Peer intersection ID: Unique identifier of the peer intersection.
   b. Distance to Peer: Distance along roadway (including any curvature) between local intersection and peer intersection. This can be defined from the intersection origin for both intersections. (precision measurement of this distance can be not critical to operations)
   c. Free flow traffic speed: Expected average free flow speed for vehicles traveling from the peer intersection along this approach.
8. Detection Data (1-64): The GID defines up to 64 traditional (loop emulation) detection inputs. Each detection input supports the following data:
   a. DetectorNumber (1-64): Detector input as mapped via the cabinet inputs
   b. ApproachNumber (1-16): Intersection approach as defined above
   c. Lanes (8 bitfield 1-8): Lane(s) spanned within the detection zone
   d. Detection Zone (loop) Length (0-25.5 m): Length of the detection zone (common values include 1.8 m (6 ft) (1.8 m and 20 ft detection lengths)
   e. Setback: (0-1000 m) Distance along the lane centerline distance from the leading edge of the detection zone to the stop line.
9. Image Files: The GID supports data for the relative positioning of image files that can allow an end application to visually display these GID elements.
   a. Aerial Image Filename: The GID supports a rectangular aerial view of the intersection in a .png format.
      i. UpperLeftCorner: RDD position of the upper left corner of the image file.
      ii. LowerRightCorner: RDD position of the lower right corner of the image file.
   b. Overlay Files: The GID supports positioning of multiple overlay images upon this aerial image.
      i. Overlay Filename: text string that contains the filename of the overlay (which may be in any image file format, such as PNG, JPEG, bitmap, and so forth)
         1. Overlay Centroid: RDD position of the centroid of the overlay image.
         2. Overlay Rotation Angle: (0-359) degree rotation of the bitmap
         3. Overlay Scale: Size of the overlay as displayed upon the aerial image 3.2.1.3 J2735 Formatting:

The traffic controller can store the datasets in a format consistent with the proposed SAE J2735 standard.

3.2.1.4 Image/Overlay Files:

In addition to the intersection geometry encoded within the GID, the traffic controller 210 can additionally support the downloading of files that contain an aerial image of the intersection, and graphics of the GID components that can be overlaid onto this image file. This image file can be used for user interface/display purposes and may not provide information to be applied for traffic control.

The GID contains the coordinates of opposite corners of the aerial image that allow the traffic controller-positioning of the image relative to the GID. It also contains the image file name and spatial orientation for the graphical overlays on top of the aerial image.

3.2.1.5 Pre-Configuration File Transport and Storage:

The traffic controller 210 can support FTP downloads into a local directory from the traffic engineer device 240 or ATMS 242, either locally or over a network (such as the Internet, an Intranet, or the like). The traffic controller 210 supports an NTCIP object ("ApplyFTPDownloads") that notifies the controller to apply any newly downloaded configuration files within this folder. The files within this download folder can be copied into a separate non-volatile configuration file folder that the Cobalt traffic controller 210 uses upon system startup or restart. This folder additionally offers read-only access to any other applications that may require this geometric data.

3.3 Agency Policy Statement:

Another example objective of the traffic controller 210 can be to provide the traffic controller 210 with awareness of the policies that should be applied to traffic control. Most state and larger municipal agencies that are responsible for traffic control publish a policy or standard that governs the signal timing practices. These policies can be used by traffic engineers as guidance for when they manually configure the intersections within the jurisdiction of the agency. The traffic controller 210 or ATMS 242 can store a master list of commonly applied policies. This master policy statement can help agencies recognize the policies that can be used in general practice, as well as facilitate automatic implementation and enforcement of these policies within their traffic controller-controlled intersections.

The ATMS 242 can include a software tool that allows agencies to select from, and implement, a customized set of traffic control policies from this master policy statement. This software tool can allow users to select from a list of policy statements and apply them on either a globalized, sectional, or localized basis. These policies can be configured within the ATMS 242 (which may include Econolite's Centracs™ software) or an alternate advanced traffic management system. The ATMS 242 system can also support changing the active sets of policies on a time-of-day, scheduled basis.

Policy statements can be numeric settings, yes/no-type policy questions, or list-based selections. Such statements can include options regarding traffic control that agencies can be likely to default to using, in order to standardize their practices. An example screenshot of the Policy Editor is shown in FIG. 6.

FHWA, state and local DOTs, as well as academic research groups, have provided many recommendations for these policy decisions. Larger DOTs commonly generate their own formalized specifications that augment and/or override FHWA recommended policy decisions. Smaller agencies, however, often do not follow this level of formality and merely trust the judgment of the traffic engineer to apply appropriate practices when configuring the intersection controller. The software tool to provide a master policy statement, as well as automated implementation and enforcement of these policies, can greatly assist DOTs both large and small in ensuring their traffic control can be consistent with best industry practices. Section 3.3.1 below describes examples of policies that can be edited using this software tool in the ATMS 242.

3.3.1 Master Versus Local Policy Statements:

The traffic controller 210 expects to receive a listing of policy selections via an XML file format, referred herein as the policy statement. The traffic controller 210 can receive several sets of these policy statements, enabling policy changes to be applied on a time of day, or manually commanded basis. Rather than allowing individual override to individual policy elements within the local controller, a master policy statement can be loaded and selected for use by the traffic controller 210 and localized policy statements can be applied on top of the master policy statement. This facilitates ease in traceability and implementation to treat grouping of policies under a user defined file name, rather than trace individual policy commands from a central system or local user.

The following sections provide a listing of the policies that can be included within this master policy statement:

3.3.1.1 Objective Function Policies

The objective function allows and users to weigh the various objectives for traffic control. This policy allows standard (Default) weighting of the objectives. It additionally allows users to select some policies regarding the objectives themselves:

TABLE 3

| Objective Function Policy: | Range | Default |
|---|---|---|
| Weighting: Default weight (priority) for main street through movements as: | 0-255 | 100 |
| Weighting: Default weight (priority) for main street turning movements as: | 0-255 | 70 |
| Weighting: Default weight (priority) for side street through movements as: | 0-255 | 50 |
| Weighting: Default weight (priority) for side street turning movements as: | 0-255 | 50 |
| Delay: Treat delay as {linear, progressive, custom} | {linear, progressive, custom} | progressive |
| Delay: Custom Delay Model Multiply additional delays after XX seconds by Y.Y. | 0-255, 0-9.9 | 60, 2.0 |
| Stops: Provide penalty for vehicle stop as XX seconds of delay. | 0-255 | 10 |
| Cycle Failure: Provide penalty for cycle failure as XX seconds of additional delay. | 0-255 | 0 |
| Emissions: Assume XX % of large vehicles can be diesel. | 0-100% | 75% |
| Emissions: Assume XX % of vehicles can be electric. | 0-100% | 2% |
| Safety: Treat one unit of safety conflict as equivalent to XXX seconds of vehicle delay | 0-255 seconds | 10 seconds |
| Capacity: Treat one unit of capacity (vehicles) as equivalent to XXX seconds of vehicle delay | 0-25.5 seconds | 3.0 seconds |

3.3.1.2 Intersection Start-Up/Flash Policy

Start-up of a local intersection can be the sequence of operation following a power restoration to the intersection or a return from flashing operation. These policies govern the operation of the intersection at startup:

TABLE 4

| Startup Policy: Once the intersection is powered up, it can . . . | Range | Default |
|---|---|---|
| . . . remain in cabinet flash condition for ____ seconds. | 0-255 seconds | 10 seconds |
| . . . begin yellow flash phases in Green? | (Yes/No) | Yes |
| . . . time additional Red Clearance for ____ seconds | 0-25.5 seconds | 6.0 seconds |
| . . . serve ____ movements first? | main-street through, main-street lead, side-street through, side-street lead | main-street through |

TABLE 5

| Flash Exit Policy: When exiting software flash, the intersection can . . . | Range | Default |
|---|---|---|
| . . .apply the same methods as startup? or . . . (if No selected above) | (Yes/No) | Yes |
| . . . begin yellow flash phases in Green | (Yes/No) | Yes |
| . . . time additional Red Clearance for ____ seconds | 0-25.5 seconds | 6.0 seconds |
| . . . serve ____ movements first? | main-street through, main-street lead, side-street through, side-street lead | main-street through |

TABLE 6

| Flash Entry Policy: When entering software flash, the intersection can . . . | Range | Default |
|---|---|---|
| . . . flash for a minimum of XX seconds (Default 8) | 0-25.5 seconds | 8.0 seconds |
| . . . follow MUTCD flash entry sequencing (Y/N) or . . . (if N selected above) | (Yes/No) | Yes |
| . . . enter flash upon min green service to yellow flash phases | (Yes/No) | No |

3.3.1.3 Pedestrian Movement Policy

These policies define the treatment of pedestrian service at the intersection:

TABLE 7

| Pedestrian Movement Policy: | Range | Default |
|---|---|---|
| Pedestrian timing can be based upon a crossing (walk) speed of ____ ft/second. | 1.0-5.5 ft/second | 3.5 ft/second (per FHWA guidelines) |
| An alternate pedestrian input can implement timing based upon a crossing speed of ____ ft/second. | 1.0-5.5 ft/second | 3.5 ft/second |
| The intersection can provide a minimums of ____ second of walk timing. | 0-25.5 seconds | 4 seconds |
| Allow The traffic controller 210 to extend walk intervals to use the full phase timing? | (Yes/No) | Yes |
| Pedestrian Extension inputs can provide ____ additional seconds. | 0-25.5 seconds | 2 seconds |
| Provide ____ additional seconds of walk for each pedestrian (to not exceed phase timing) | 0-25.5 seconds | 0 seconds |
| Delay Green for (XXX) seconds when conflicting turning movement can be present. | 0-25.5 seconds | 0 seconds |
| Allow ped carryover? | (Yes/No) | No |

In some embodiments, the traffic controller 210 automatically assumes that the pedestrian timing cannot time concurrently with the phase yellow or red. The traffic controller 210 reports a policy override if a split selection overrides into the phase clearance timing.

In some embodiments, the traffic controller 210 does not provide pedestrian storage within a median, such applications may require pedestrian timing override by the traffic engineer.

3.3.1.4 Phase Initial Timing: (Minimum Green)

The traffic controller 210 can automatically determine an appropriate minimum green timing based upon the movement, vehicle speeds, and available vehicle detection. (Refer to the section on Standardized Calculations for details on this implementation.) These timings can be subject to the following policy decisions:

TABLE 8

| Minimum Green Timing Policy: | Range | Default |
|---|---|---|
| Major approach minimum green may not be less than ____ seconds | 0-255 seconds | 15 seconds |
| Minor approach minimum green may not be less than ____ seconds | 0-255 seconds | 7 seconds |
| Approaches with design speeds in excess of ____ mph can provide a minimum green of ____ seconds | 0-100 mph<br>0-255 seconds | 45 mph<br>20 seconds |
| Protected left turns can provide a minimum green not less than ____ seconds | 0-255 seconds | 7 seconds |

3.3.1.5 Phase Clearance Timing: (Yellow Clearance)

The traffic controller 210 can determine the appropriate yellow clearance timing for the intersection based upon the roadway geometry and vehicle speeds. The agency can be allowed to provide some policy-level control over this yellow clearance timing via the following policy-level selections.

As an illustrative example, federal guidelines provide an equation that will determine the yellow clearance timing that should be set within a traffic controller 210 for each movement of traffic. Per the ITE equation, this interval is based upon the geometric data of the intersection as well as information regarding the patterns of vehicular traffic.

$$\text{Yellow Clearance Phase Interval (seconds)}=t+(v/(2a\pm g))$$

Where:

t=driver perception-reaction time for stopping, (defaulted as 1 sec)

v=approach speed (ft/sec) taken as the 85th percentile speed or the speed limit a=deceleration rate for stopping (defaulted as 10 ft/sec$^2$)

g=percent of roadway grade divided by 100

The example above reveals that determination of the yellow clearance time for an approach to an intersection is based upon these various sources of input. It also demonstrates that given these inputs, the methodologies for implementation are often well established, straightforward, and broadly accepted within the industry.

Agencies handle yellow and red clearance timing via two separate rules:

1. Permissive yellow rule: Driver can legally enter intersection during entire yellow interval. Violation occurs if driver enters intersection after onset of red.
2. Restrictive yellow rule: Driver can neither enter nor be in intersection on red. Violation occurs if driver has not cleared intersection after onset of red.

TABLE 9

| Yellow Clearance Policy: | Range | Default |
|---|---|---|
| Select Clearance timing consistent to ____ yellow rule: This selection can ensure that the yellow timing allows a vehicle within the dilemma zone to sufficiently pass fully into the intersection (permissive yellow rule) or completely through the intersection (restrictive yellow rule). | Permissive, Restrictive | Restrictive |
| Yellow Clearance Timing cannot be less than X.X seconds | 0-255 seconds | 3 seconds |
| Utilize ____ mph for 85th percentile speeds of turning movements. (default 25 mph) | 0-100 mph | 25 mph |
| Allow ____ adjustment to yellow clearance timing based upon average speeds? | Dynamic (weather responsive) 0-3.0 seconds per week. | 0 seconds |

3.3.1.6 Phase Clearance Timing: (Red Clearance)

The traffic controller 210 can automatically compute the red clearance interval given the design speed and known intersection geometries. This can include provision for turning movements.

States utilizing a restrictive yellow law do not may require additional red clearance timing for vehicles to clear the intersection. The agency can be allowed to provide some policy level control over this red clearance timing via the following policy-level selections:

TABLE 10

| Red Clearance Policy: | Range | Default |
|---|---|---|
| Utilize ____ % of red clearance interval. | 0-999% | 100% |
| Allow dynamic red clearance extension? (Y/N) | Yes, No | No |
| Allow dynamic red clearance reduction? (Y/N) | Yes, No | No |
| Allow programming for zero red clearance? (Y/N) | Yes, No | No |

3.3.1.7 Phase Sequencing:

Traffic controllers typically serve the traffic movements in a sequential order. The most common ordering can be to service the left turning movements prior to the through movements, and to alternate service between main-street and side-street service:

Using the phasing convention illustrated in FIG. 1A, this sequence may be: phases 1&5→2&6→3&7→4&8→1&5 etc.

There can be many reasons and situations where traffic engineers choose to modify the sequence order from the default sequencing. Some examples may include: Traffic Controllers are often configured to lead and/or lag the main street left turns so that the main street green interval can be in better alignment with the expected platoon arrivals from the adjacent traffic signals. Opposing left turns may have a turning radius conflict and cannot be serviced concurrently. Protected left turn movements are commonly serviced after a permissive left movement during the through phase green. This provides efficiency advantages over a leading protected turning movement.

Current traffic controllers do not dynamically adjust phase sequencing, but can usually run in a predefined phase sequence for the specific time-of-day. The traffic controller 210 supports safety and efficiency improvements within the traffic controller 210 via the dynamic sequencing of phases. Policies can be implemented to protect any consistent operation that the agency and/or motoring public have become accustomed to.

TABLE 11

| Phase Sequence Policy: | Range | Default |
|---|---|---|
| Allow the traffic controller 210 to determine conflicting movements? | Yes, No | Yes |
| Allow the traffic controller 210 to dynamically switch between protected only/permissive only/ protected + permissive movements? | All, Main Street, Side Street, None | None |
| Omit protected movement when permissive V/C can be less than {0-100%} | 0-100% | 70% |
| Default Protected Main Street Movements to | Leading Lefts, Lagging Lefts, Lead-Lag Service, | Leading Lefts |
| Default Protected Side Street Movements to | Leading Lefts, Lagging Lefts, Lead-Lag Service, Sequential Service, | Leading Lefts |
| Allow the traffic controller 210 to dynamically select sequence of side street movements? | Yes, No | No |
| Allow the traffic controller 210 to dynamically {lead, lag} main street movements during free operation? | Yes, No | No |
| Allow the traffic controller 210 to Re-service left turning movements? | Yes, No | No |

3.3.1.8 Backup Protection

A common safety concern in signal control can be the occurrence of a "left turn trap" wherein a permissive left turning vehicle can observe the termination of green for its controlling signal, while the opposing through movement remains green. Left turning vehicles can erroneously assume the opposing through movement is also terminating, and may perform a permissive left turn under false assumption that the opposing vehicles can be stopping. Most traffic controllers have complex feature sets that prevent this type of operation from occurring. The traffic controller simplifies this protection by applying some policies for this backup protection:

TABLE 12

| Backup Protection Policy: | Range | Default |
|---|---|---|
| Apply left turn backup protection via ____ | switched call to the through movement. switched call to the side street movement. red revert timing. | Switched call to the through movement. |
| Apply additional red revert timing of ____ seconds. | 0-25.5 seconds | 3 seconds |

3.3.1.9 Detection Preferences

The traffic controller 210 can allow traffic engineers to determine default handling of traditional loop presence type detection at a policy level. The following preferences can be supported:

Detection Failure

The traffic controller 210 can automatically determine if a detector has failed by comparing the volume and occupancy of the detector against historic averages by the time-of-day/day-of-week. The traffic controller 210 allows traffic engineers to determine fallback operation in the event of detection failure. The same methodologies exist for movements that do not have a detection source. The following policies can be supported:

TABLE 13

| Detection Policy: | Range | Default |
|---|---|---|
| Delay calls for shared right turn/through lanes for ____ seconds. | 0-25.5 seconds | 5 seconds |
| Allow automatic determination of detection failure using a diagnostic period of ____ minutes during daytime operations. | 0 255 minutes | 5 minutes |
| Allow automatic determination of detection failure using a diagnostic period of ____ minutes during nighttime operations. | 0 255 minutes | 60 minutes |

3.3.1.10 EV Preemption

The traffic controller 210 can support a defaulted emergency vehicle preemption setup that provides a higher level of automatic configuration and optimization than traditional preemptors.

TABLE 14

| EV Preemption Policy: | Range | Default |
|---|---|---|
| Apply default EV preemptions | Yes, No | Yes |
| Select the desired phase/direction convention for preemptors: | Phase (1-16) or {NB, SB, EB, WB} | |
| EV Preempt #1 ____ | | #1 2 |
| EV Preempt #2 ____ | | #2 6 |
| EV Preempt #3 ____ | | #3 4 |
| EV Preempt #4 ____ | | #4 8 |

TABLE 14-continued

| EV Preemption Policy: | Range | Default |
|---|---|---|
| NB, SB, EB, WB (or) Phases 2, 6, 4, 8 | 0 255 minutes | 60 minutes |
| Have main-street EV Preemptions dwell in opposing through movements or protected lefts? | Opposing Through, Protected Left | Opposing Through |
| Have side-street EV Preemptions dwell in opposing through movements or protected lefts? | Opposing Through, Protected Left | Protected Lefts |
| Try to service preemption under TSP before full preemption? | Yes, No | Yes |
| Expected distance from initial preemption call to stop line. | 0-5000' | 1000' |
| Delay preemption for ____ seconds | 0-25.5 seconds | 3 seconds |

3.3.2 Safety Policies

The traffic controller 210 can utilize intersection safety conditions as a mechanism of traffic control, monitoring and reporting. This may requires prior setup of several policies regarding traffic safety. This operation is explained in section 4 below. The policies in support of this operation include:

TABLE 15

| Safety Policy: | Range | Default |
|---|---|---|
| Define Excessive speed as ____ mph above design speed. | 0-100 mph | 20 mph |
| Control excessive speed via red revert under late night operations? | Yes, No | Yes |
| Allow ____ left turning vehicles per lane under permissive clearance. | 0-10 vehicles | 3 vehicles |
| Define critical gap acceptance as ____ seconds | 0-10.0 seconds | 4.5 seconds |
| Define large vehicles as vehicles greater than XX feet. | 0-255 feet | 40 feet. |

3.3.3 Example Traffic Controller Features That are Not Policy-Driven

Many intersections have unique geometrics or control strategies that may require non-standard operation. The traffic controller 210 can preserve the "features" of NTCIP-based traffic controllers, allowing Traffic Engineers to manually configure any needed features that are not included in the automatic setup and policy enforcement. This section provides an overview of those traffic control features that can be addressed via policy statements, but left for manual programming by the traffic engineer. The traffic controller 210 can aim to standardize these features and provide policy-level implementation as possible.

3.3.3.1 RR Preemption

Traditional Railroad preemptors offer many features that overcome the indeterminate signal timing that occurs between the active phases and the transition to track clearance phases upon receipt of a preemption input. The traffic controller 210 can utilize a "Time to Track Clearance" setting that automates this traditional and error prone mechanism of configuration. Due to the heightened safety risks associated with RR preemption, the traffic controller 210 may not automatically implement RR preemptors on a policy basis. The traffic engineer may manually review and enable the localized settings for RR preemption.

3.3.3.2 Overlaps

Traffic Engineers utilize overlaps to handle movements that can be controlled by more than one phase. These overlaps follow timing of the selected "parent" phases. Overlaps are often used for nonstandard operation. Given this high degree of variability, the initial version of the traffic controller 210 does not implement non-standard overlaps via policy statements. However, the traffic controller 210 does support programming of these non-standard overlaps via traditional user interfaces and features.

The traffic controller 210 can provide native support of several standardized overlaps including:

3.3.3.2.1 Right Turn Overlaps

The traffic controller 210 can provide geometrically-based support of right turn-controlled movements via an overlap. The traffic controller 210 may recognize the overlap as the signal driver for this movement and ensures vehicle movements that occur under this overlap signal can be measured and optimized in a fashion similar to phase-controlled movements. (Refer to Section 4 for details on this implementation.)

3.3.3.2.2 Flashing Yellow Arrow

The traffic controller 210 can provide native support of left turns that can be controlled via the flashing yellow arrow. The NEMA TS-2 standard defines several mechanism of configuring flashing yellow operation. The traffic controller 210 can recognize the signal driver for this movement and ensures vehicle movements that occur under this overlap signal can be measured and optimized in a fashion similar to the phase-controlled movements. (Refer to Section 4 for details on this implementation.)

3.3.3.2.3 Trailing Signal Overlaps

The traffic controller 210 provides native support for intersections that can be controlled through two sets of signal heads that can be offset from one another, with the second set controlled via a trailing overlap. The traffic controller 210 automatically defines the trailing overlap timing consistent to the roadway geometry, vehicle speeds, and timing of the leading (parent phase) signal heads. (Refer to Section 4 for details on this implementation.)

3.3.4 Master Policy File Format

The traffic controller 210 can support a file format as mechanism of receipt of these policy selections. Master policy files can be stored using XML encoding. This facilitates extensibility to accommodate download of new policy statements to different versions of firmware that may not yet have updates to support the latest policy statements.

Each master policy can be stored in a separate xml that can be FTP downloaded to the traffic controller 210 on a system wide, sectional, or localized basis. The traffic controller 210 supports NTCIP commands to load and implement a policy file on a time of day or manually commanded basis.

3.3.5 Example Traffic Controller Policy File Implementation

The ATMS 242 system can allow configuration of a singular master policy statement that becomes the default guidance for some or all controllers within the agency. This master policy statement can be expected to be FTP downloaded into a designated /downloads file folder on the local controller for application by the traffic controller 210.

It can be also expected that localized deviations in policy from this master policy statement can then be selected by the user to include any or all of the policies within the master statement. These localized policy statements can additionally be downloaded to the traffic controller 210 via FTP to the /downloads folder. Multiple localized policies can be downloaded and applied concurrently. In the event that local policy statements provide contradictory guidance, the traffic controller 210 can apply the most recently implemented policy with the highest level of priority.

The traffic controller 210 may support NTCIP based commands to implement, de-implement, or delete a policy filename. These commands can be used the by the ATMS 242 system to facilitate centralized management, scheduling, and manual command of agency policies.

The traffic controller 210 may additionally support time of day scheduling of policies, allowing policy selections to be implemented locally on a time of day basis, without need for online commanding from the ATMS 242 system.

3.4 Traffic Flow Characteristics:

In order to generate the traffic controller 210 pre-configuration, the traffic controller 210 may gain awareness of some basic traffic flow characteristics. This can be performed in a two-stage process: Stage 1: Base assumptions of traffic flow characteristics from existent data; Stage 2: Updates to base assumptions from measured traffic flows.

The stage 1 initial pre-configuration of the traffic controller 210 can utilize any available detector data within the ATMS 242 database to determine these approximate expected traffic flows on a time of day basis. Stage 2 can provide recurrent updates to these base assumptions after the traffic controller 210 becomes operational and has begun to collect more accurate traffic flow characteristics from the trajectory and point source data.

3.4.1 Preconfiguration Traffic Flow Dataset

The following parameters can be utilized by the traffic controller 210 when generating the traffic controller 210 pre-configuration:

Average Hourly Traffic Volume: This parameter can be the number of vehicles demanding service at the intersection for each hour of the day. This data can be desired on a per lane basis, but can be often only available on a per-approach or per-movement basis. This data can be gathered from the ATMS 242 system detector database, or an online traffic data service (e.g., INRIX). The ATMS 242 can be expected to generate this information for the traffic controller 210 from its available sources of traffic control data.

Turning movement percentages: This parameter can be the expected percentage of vehicles upon approach that can perform a left turn as well as right turn at the intersection. These percentages can be used for an approximation for turning movement volumes, which can be often not available via ATMS 242 or online traffic data sources.

This volume data allows the traffic controller's 210 Timing Plan Generator to develop initial phase split allocations to support the expected demand. These initial phase split allocations, can be quickly updated upon real-time operation to utilize the real world traffic volumes that can be measured by the traffic controller 210.

3.4.2 Assumed Traffic Flow Parameters:

Additional traffic flow parameters can be derived from highway capacity manual and other industry standardized estimates for stage 1 configuration. Under stage 2 operation, these parameters can be verified by real world measurement from the vehicle trajectories within the traffic controller 210. These real world parameters can then be fed back into to re-compute the pre-configuration data by the traffic controller 210 Configuration Generator. These assumed traffic flow parameters may include startup lost time, vehicle acceleration rate, and vehicle deceleration rate.

This real time measurement of these parameters and subsequent update of signal timing elements via the traffic controller 210 Configuration Generator, can ensure the traffic controller 210 signal timing adapts to real world traffic conditions, including weather responsive operation, and not limited to static industry-standardized estimates.

3.5 Standardized Calculations

As stated above, the traffic controller 210 can automatically generate and update its base configuration through real-time measurement of the traffic flow characteristics. The traffic controller 210 can utilize the GID, policy statement, as well as traffic flow data to generate the information useful to automatically compute many of the standardized calculations that can be used in the configuration and analysis of intersections. This section describes the standardized models that can be used:

3.5.1 HCM Performance Measurement

The *Highway Capacity Manual* (HCM) defines many of the performance measures used within the industry to measure the levels of service and effectiveness of traffic control. The traffic controller 210 can record the Input Data Elements as defined by the *Highway Capacity Manual*, as well as generate the performance measures as defined in the HCM. These input data elements are defined in the HCM in Exhibit 18-6, Table 16 below.

TABLE 16

Exhibit 18-6 Input Data Requirements: Automobile Mode with Pretimed, Fully Actuated, or Semiactuated Signal Control

| Data Category | Input Data Element | Basis |
|---|---|---|
| Traffic characteristics | Demand flow rate | Movement |
| | Right-turn-on-red flow rate | Approach |
| | Percent heavy vehicles | Movement group |
| | Intersection peak hour factor | Intersection |
| | Platoon ratio | Movement group |
| | Upstream filtering adjustment factor | Movement group |
| | Initial queue | Movement group |
| | Base saturation flow rate | Movement group |
| | Lane utilization adjustment factor | Movement group |
| | Pedestrian flow rate | Approach |
| | Bicycle flow rate | Approach |
| | On-street parking maneuver rate | Movement group |
| | Local bus stopping rate | Approach |
| Geometric design | Number of lanes | Movement group |
| | Average lane width | Movement group |
| | Number of receiving lanes | Approach |
| | Turn bay length | Movement group |
| | Presence of on-street parking | Movement group |
| | Approach grade | Approach |
| Signal control | Type of signal control | Intersection |
| | Phase sequence | Intersection |
| | Left-turn operational mode | Approach |
| | Dallas left-turn phasing option | Approach |
| | Passage time (if actuated) | Phase |

TABLE 16-continued

Exhibit 18-6 Input Data Requirements: Automobile Mode with Pretimed, Fully Actuated, or Semiactuated Signal Control

| Data Category | Input Data Element | Basis |
|---|---|---|
| | Maximum green (or green duration if pretimed) | Phase |
| | Minimum green | Phase |
| | Yellow change | Phase |
| | Red clearance | Phase |
| | Walk | Phase |
| | Pedestrian clear | Phase |
| | Phase recall | Phase |
| | Dual entry (if actuated) | Phase |
| | Simultaneous gap-out (if actuated) | Approach |
| Other | Analysis period duration | Intersection |
| | Speed limit | Approach |
| | Stop-line detector length and detection mode | Movement group |

3.5.2 The Traffic Controller Configuration Generator

The traffic controller 210 Configuration Generator can establish interval timing consistent to the methodologies defined in the Signal Timing Manual as well as other accepted industry formulations. A description of some of these calculations is provided within this section.

3.5.2.1 Minimum Green:

The configuration generator calculates a dynamic minimum green as defined by the queue of vehicles awaiting service. This minimum green can be defined as:

For cases where detection provides lane discrimination: Gmin=3+2N (seconds)

For cases where detection does not provide lane discrimination: Gmin=3+1.5N (seconds)

Where N can be the maximum number of queued vehicles in any single lane.

For cases where no advance detection exists, the traffic controller 210 can measure the number of discharging vehicles and apply a minimum green computed from the average N of discharged vehicles over the prior 5 cycles.

The traffic controller 210 can determine the number of queued vehicles by accumulating those vehicles that are: Truncated from the prior phase service+Arrive during phase red+Arrive during initial green timing.

The traffic controller 210 can store the dynamic minimum greens computed within a time-of-day log. These times can be used as a basis for phase timing in the event that detection fails. Upon detection failure, the average hourly minimum green for the same day-of-week and hour-of-day, over the prior 4 weeks can be substituted. (Refer to the section on detection policy for details.)

3.5.2.2 Passage/Maximum Green/Split Timing

The traffic controller 210 can determine the duration and proper termination point of green timing based upon the optimizations described in section 3.5.

3.5.2.3 Phase Clearance Timing: (Yellow Clearance)

The Institute of Transportation Engineers provides an equation for the yellow clearance interval as:

$$\text{Yellow Interval} = t + \left(\frac{v}{2a + 64.4g}\right)$$

Where:

t=reaction time (set to 1 second)

v=85$^{th}$ percentile approach speed in feet/second a=deceleration rate (set to 10 ft/sec$^2$)

g=grade of approach over the breaking distance in percent/100

The traffic controller 210 can utilize this yellow clearance interval. An assumed design speed of 25 mph can be used when calculating yellow clearance for turning movements. The yellow clearance time may not be less than 3.0 seconds in some jurisdictions.

However, the ITE equation for yellow clearance does not provide sufficient yellow clearance time for low and high speed approaches, and can be increased by the traffic controller 210 to allow full passage of vehicles within the dilemma zone.

For example, a vehicle traveling on level ground at 100 ft/sec may require 6 seconds of yellow time per the equation above. A vehicle passing through the light on a yellow change can travel 600 feet during the yellow interval. A vehicle decelerating at 10 ft/sec$^2$ may require 11 seconds to react and fully stop. This decelerating vehicle may require 600 ft to fully stop. Using these two vehicles as a comparison, a vehicle that is 590 feet from the stop line, cannot stop in the distance allotted, nor can it successfully pass through the intersection with only a 6 second yellow clearance interval. The traffic controller 210 can ensure the yellow time can be such that vehicles can fully pass into or through the intersection based upon the yellow rule in effect. A similar example holds for very slow speed approaches were the yellow clearance may not be sufficient for restrictive yellow passage through the intersection.

3.5.2.4 Phase Clearance Timing: (Red Clearance)

The Institute of Transportation Engineers provides an equation for the red clearance interval as:

$$\text{Red Clearance Interval} = \left(\frac{w + l}{v}\right)$$

Where:

w=width of intersection (ft)

l=length of the vehicle (ft)

v=85th percentile approach speed in feet/second

This interval provides sufficient time for a vehicle traveling from the stop line through the intersection at the design speed, to traverse fully through the intersection.

The traffic controller 210 can automatically compute this red clearance interval given the design speed and known intersection geometries. This can include provision for turning movements as well as adherence to the policy decisions regarding red clearance timing.

3.6 Example Optimization Models 3.6.1 Industry Overview and Definitions:

Traffic signals can be optimized for most efficient operation through the optimization of three key parameters: Cycle Length, Offset, and Split Timing. These parameters, collectively referred to as COS, can be defined as (in addition to having their ordinary meaning): Cycle Length: The time period in seconds that the traffic signal can take to service all movements in sequence under assumption of constant vehicular demand to all movements. Offset (Reference): A specific point in the cycle that adjacent intersections can use to coordinate their cyclic operation between one another. These reference points can be often defined as the beginning of main street green, or beginning of main street yellow. Offset (Time): A time reference relative to some master time reference (master clock—which may start at a reference time such as midnight) wherein a coordinated local intersection can achieve its offset reference point. This timed offset can be established between adjacent intersections so that overall progression through a network of traffic signals can be optimized. Split Timing: The amount of time within the cycle (typically in % of Cycle Length or seconds) that a specific movement (or phase) can be served under assumption of constant demand for service.

Signals can be optimized to either run coordinated to adjacent signals using an offset reference or "free" to cycle independently from adjacent signals. Coordinated signals typically can operate under a common cycle length. In less common cases, they can run a commonly divisible cycle length that allows for a common periodicity among some or all signals in the optimized network.

Traffic engineers carry a responsibility to ensure reasonable optimization of these COS parameters. Optimization of these parameters can be commonly done via a manual process that utilizes specialized traffic modeling and optimization software. This optimization process may requires the traffic engineer to model some geometric properties of the roadway network, input the expected vehicular demand for each intersection movement into the model, and run a non-real-time optimization based upon this expected demand, resulting in an "optimal" set of COS values to implement in the traffic controllers. Since vehicular demand changes based upon the time of day, it can be common for traffic engineers to optimize multiple sets of demand data and generate "COS timing plans" that can be implemented by time-of-day within the traffic controller. Traffic patterns can be subject to change as roadway demands change over time. Standard practice can be for traffic engineers to re-time (or "retime") traffic signals every 3-7 years to match any long term changes in traffic flow. There can be advantages that can be made to signalized optimization, if optimized in real-time using actual vehicle demand as the basis of split timing, rather than this offline aggregate analysis.

3.6.2 Example Traffic Controller Signal Optimization

Thus, in certain embodiments, the traffic controller 210 is not a traffic control package that optimizes the coordination of a signalized network like these adaptive systems and/or offline optimization packages. However, it can provide localized adjustment to COS values at an intersection, preserving the objectives of the offline optimization, but fusing in the localized efficiency and safety objectives that arise from real-time vehicle trajectory data. Certain embodiments of the traffic controller 210 described herein focus on improving or optimizing split timing or in-cycle timing without optimizing the cycle length, offset (reference) or offset (time) of a plurality of traffic controllers across multiple intersections. However, as described below, the traffic controller 210 may take inputs from adjacent intersections to improve or optimize in-cycle split timing at a single intersection where the traffic controller 210 is located.

4 Signal Control via Trajectory Modeling:

This section outlines embodiments of methods by which the traffic controller 210 receives inputs, models the present and future state vehicle trajectories, and computes an optimization via minimization of the user-defined objective function.

Figure 7:
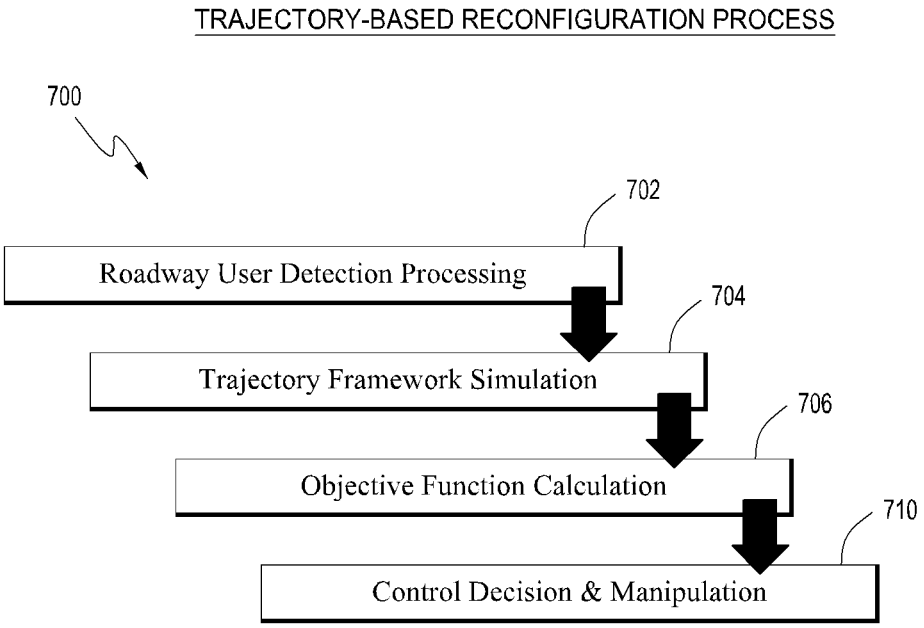
FIG. 7 depicts an embodiment of a trajectory-based traffic controller reconfiguration process.

By way of overview, with reference to FIG. 7, signal control via trajectory modeling can include the overview process 700 shown. This process 700 may be implemented by the traffic controller 110 or 210 and includes roadway user detection processing (702), trajectory framework simulation (704), objective function calculation (706), and control decision and manipulation (710). Each of these features is described in greater detail below.

Figure 8:
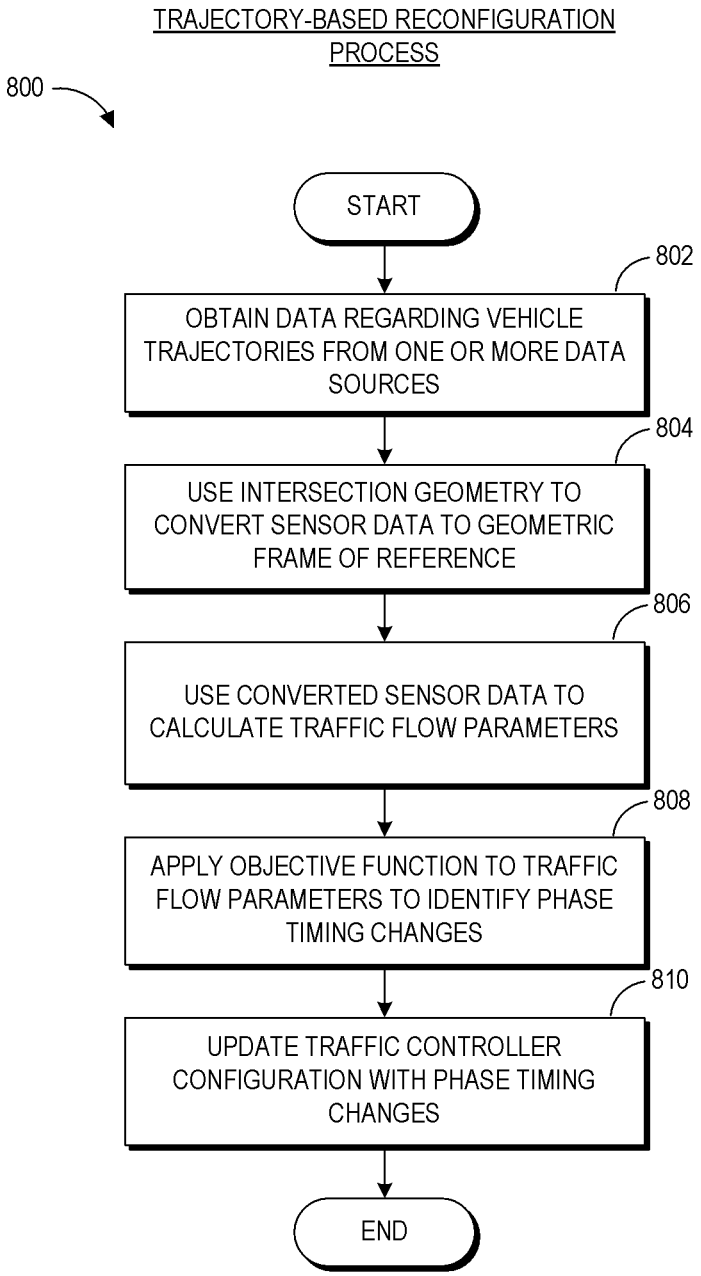
FIG. 8 depicts another embodiment of a trajectory-based traffic controller reconfiguration process.

Viewed another way, FIG. 8 depicts an overview process 800, implemented by the traffic controller 110 or 210, which illustrates an overview of trajectory-based traffic control reconfiguration. At block 802, the traffic controller 210 obtains data regarding vehicle trajectories from one or more data sources. At block 804, the traffic controller 210 uses geographic information description (GID) to convert sensor data to a GID frame of reference or coordinate system. At block 806, the traffic controller 210 uses converted sensor data to calculate traffic flow parameters. At block 808, the traffic controller 210 applies an objective function to the traffic flow parameters to identify phase timing changes. At block 810, the traffic controller 210 updates the traffic controller configuration based on the phase timing changes.

4.1 Roadway User Detection Inputs:

The traffic controller 210 supports extension of controller inputs to include trajectory modeling of the vehicles, pedestrians and other roadway users. This section describes the data interfaces from these various detection sources and the resultant processing of these inputs for use by the traffic controller 210.

4.1.1 Utilization of Legacy Detection Sources

Intersection control strategies can be predominantly constrained by the level and quality of vehicle detection. Vehicle detection infrastructure constitutes a large investment for the agency (commonly more than $10K per intersection). Moreover, this infrastructure may requires significant ongoing maintenance to keep its detection systems operational.

The traffic controller 210 can most efficiently operate if some or all approaches have full vehicle trajectory data. However, such a prerequisite would not be grounded in the financial and maintenance constraints that most agencies operate under. The traffic controller 210 can be designed to utilize what detection data exists (or does not exist) and provide the best control strategy possible, across a broad range of vehicular detection types.

4.1.2 Traditional Vehicle Detection

Traditional vehicle detectors, such as loop-detectors, magnetometers, and some radar systems, only provide knowledge to the traffic controller 210 that a vehicle has passed over a very specific location in the roadway. The traffic controller 210 can be designed to utilize these existing detection sources. The traffic controller 210 supports the placement of these detectors within the GID, and registers vehicular demand by modeling vehicles at those locations based upon the detector actuations. The traffic controller 210 extrapolates vehicular movements from these point source actuations. The traffic controller 210 can do this by assuming standard acceleration/deceleration rates and applying queuing models for the vehicles as they approach and depart from the signals. The traffic controller 210 can use this information together with or instead of more advanced trajectory sensors such as radar, ultrasound, and video cameras, as will be described in greater detail below with respect to section 4.2.

There can be several common types of point source detectors. The treatment of input data for each of these types can be presented below:

4.1.2.1 Stop Line Presence Detectors:

Stop line presence detectors provide information regarding the presence of vehicle(s) over the detection zone at a stop line. When each lane has its own detection zone, this presence provides a lane determination for the vehicle. Oftentimes, multiple lanes can be spanned with a single detection zone, leading to ambiguity regarding the number of vehicles awaiting service across those lanes spanned by the detectors. See FIG. 1B (160).

The traffic controller 210 identifies a vehicle to be within a specific lane when a single lane stop line presence detector is occupied. In the event that multiple lanes can be spanned by a single detection zone, the traffic controller 210 can apply demand to the movement, but can rely instead upon either upstream or historic data sources to estimate the actual vehicle count or lane presence.

After a signal turns green, the duration of constant presence provides some indication of the number of vehicles that were queued in the lane or lanes. The standard model for queue discharge provides a rule of thumb that 1 vehicle can be likely to have existed for every 3 seconds of detector occupancy after a green signal is provided. The traffic controller 210 can store this estimated vehicular count from stop line detectors to estimate the vehicular demand for use in demand modeling. More efficient trajectory-based sensors are described below.

4.1.2.2 Stop Line Count Detectors:

Some stop line detectors provide vehicular count information by pulsing the input for each new vehicle that is determined to pass within the detection zone. This arrangement can offer a better estimated number of vehicles present over the detection zone at a stop line. When each lane has its own detection zone, this presence detection provides a lane determination for the vehicle. Oftentimes, multiple lanes can be spanned with a single detection zone, leading to ambiguity regarding the number of vehicles or lanes awaiting service. Even with multiple lanes spanned by a stop line detector, the detector processing card can often retain an accurate vehicular count as the vehicles arrive and/or discharge from the detection zone.

4.1.2.3 Advance Detectors:

Point source detectors can be often applied in advance (200-500') of the stop line. These detectors provide vehicle count and time-location information of the vehicles upon arrival to the intersection. When each lane has its own detection zone, this presence provides a lane determination for the vehicle. Oftentimes, multiple lanes can be spanned with a single detection zone, leading to ambiguity of the lane that the vehicle was detected within. See FIG. 1B (170).

The traffic controller 210 can apply demand to the lane where discrimination exists when these advance detectors are actuated. In the event that multiple lanes are spanned within a single detection zone, the traffic controller 210 can model vehicles to occupy separate lanes in alternating sequence across some or all lanes spanned by the detection zone.

4.1.2.4 Advance Speed Detectors:

In some intersections, pairs of point source detectors can be applied in a single lane with close spacing between the detection zones to provide an accurate per vehicle speed measurement as well as vehicle length. See FIG. 1B (170). The speed can be determined by taking the distance between the leading edge of both detection zones and dividing this distance by the time of leading edge presence across each detection zone. (Speed=distance/time.) With this speed known, the vehicle length can also be determined by the duration of the vehicle presence over the lagging detection zone. (Distance=speed/time=vehicle length+detection zone length). Advance speed detectors provide a rough point source estimate of vehicle position, speed and length data.

4.1.2.5 Trajectory-Based Detection

The traffic controller 210 can take advantage of recent radar, ultrasound, and video detection systems that can provide real-time trajectories of approaching vehicles. The traffic controller 210 can support a data interface to these detectors that allows retrieval of this vehicle trajectory data. This data provides a much more robust measurement of the vehicles throughout the GID. The traffic controller 210 can also communicate with hybrid sensors.

4.1.2.5.1 Trajectory Data

The traffic controller 210 can receive the following data from these trajectory-based detectors: Timestamp—It can be expected that these trajectory detection systems can publish vehicle trajectory sets at least every 100 msec. A common time reference can be shared between sensor and controller for this data to have accuracy. Vehicle unique identifier—This can be some unique identifier from the tracking detector that aids in the alignment of iterative data sets. (Vehicle 12 in one data set can remain Vehicle 12 in the next data set). For each vehicle, the following data can be transmitted: Detection Confidence (1-100%) (Detector confidence that the object can be not an artifact); Vehicle Position (relative to sensor coordinate system) including Longitudinal Standard Deviation Estimate (accuracy of distance from sensor) and/or Transverse Standard Deviation Estimate (accuracy of lane positioning); Vehicle Length (classification); Vehicle Instantaneous Speed (velocity vector if available); and/or Vehicle Instantaneous Acceleration/Deceleration (vector if available).

4.1.2.5.2 Trajectory-Based Detection and Error Correction

These tracking-based detection systems do not provide perfect measurement of vehicles and their trajectories. The traffic controller 210 can implement several mechanism to error-correct the vehicle trajectory data that can be received from these sensors.

4.1.2.5.3 GIS—Referencing

These detection systems are not likely to have true GIS positioning of their field of view. The traffic controller 210 can improve the GIS referencing for these detection systems via two options: (1) GID Referenced: The traffic controller 210 can publish the GID (e.g., at least the part of the database relevant to the traffic controller's 210 intersection and possibly adjacent intersections) to the sensor along with its location and intended approach for detection. This approach can allow the sensor to provide vehicle positioning relative to the GID. (2) Sensor Referenced: The traffic controller 210 can support sensors that provide the traffic controller-referenced data relative to a reference point as determined by the sensor. These sensor references can be the sensor location and aiming direction, a fixed line in the sensor's field of view (e.g., stop line) or some alternate referencing methodology that the sensor vendor offers. The traffic controller 210 can perform a coordinate transformation translation of the reference frames into the GID referenced framework.

4.1.2.5.4 Lane Profiling

Even after applying translation of coordinate reference frames, there may be additional correction issues based upon the nature and quality of the detection source. As example, a radar-based sensor receives a radar return from a point on the vehicle, but not necessarily the vehicle front bumper or centroid. The traffic controller 210 can fine-tune these reference frames by comparing where the sensor places cars which have stopped at the stop line, versus the GID-known location of the stop line. The traffic controller 210 can also look at the distribution of vehicles within each lane. The traffic controller 210 can adjust the coordinate system from the sensor such that the averaged vehicle trajectories are centered within the lanes as outlined in the GID.

With traditional vehicle detection, vehicle placement is critical to the control algorithm. Greater tolerance of vehicle placement inaccuracy may be possible with the present traffic controller 210. Since the traffic controller 210 can have a long window of arrival under trajectory-based detection, misplacing a vehicle by even 20 feet longitudinally should have little adverse impact on the control strategy.

4.1.2.5.5 Data Smoothing

The traffic controller 210 can receive vehicle trajectory data at regular intervals, such as every 100 msec, from the sensor(s) or other data sources (e.g., connected vehicle(s), user devices, etc.). This raw data may be subject to error and can be smoothed with prior trajectory data to remove any jitters, using, for example, median filtering or averaging. This smoothing can be based upon the type of input and likely errors of that technology. As example, Doppler-radar based sensors provide a very accurate speed measurement, but cannot provide as accurate distance ranging. The traffic controller 210 can apply a smoothing of the vehicle position consistent to the accurately measured speed. Video detection inputs, on the other hand, can have a more accurate position but may not generate accurate speed measurement. The traffic controller 210 can apply a positional smoothing of the prior data sets that yield an approximate average velocity.

4.1.2.5.6 Confidence Utilization

The traffic controller 210 can support utilization of the confidence threshold for which a detected vehicle can be recognized. This tuning can be based upon the criticality of measurement, ensuring or attempting to ensure increased safety.

As example, if the detector suggests that there is a 50% likelihood of a single vehicle awaiting side-street service, the controller can defer placing the call for a short period of time to ascertain any increase or decrease of confidence. If the vehicle likelihood does not decrease to zero within a reasonable wait timeframe for the possible driver, the controller may then err on the side of determining this to be a vehicle and placing a call to service.

In another example, assuming the same 50% vehicle (vehicle detected with 50% confidence) is among a series of evenly-spaced vehicles at an approach that is about to terminate the green interval, this 50% vehicle can be statistically the safest car to place within the dilemma zone for green termination. In addition to having its ordinary meaning, "dilemma zone," as used herein, refers to a zone along an approach created when a yellow light is indicated and a driver in the approach can choose whether to stop or to pass through and thereby run the risk of running the ensuing red light.

4.1.2.6 Connected Vehicle Inputs

USDOT is currently allocating the 5.9 GHz spectrum and promoting standards that connect vehicles to the signalized infrastructure. This program is often referred to as "Connected Vehicle." Refer to the following website for details of this program: http://www.its.dot.gov/connected_vehicle/connected_vehicle.htm, the contents of which are hereby incorporated by reference.

When this program goes live, vehicles may have the ability to communicate the location to the intersection controller via the Basic Safety Message (BSM) as being defined in the SAE J2735 standard. The traffic controller 210 can support input of these connected vehicle BSM messages as inputs for real-time traffic control. This source of data can be expected to provide potentially more accurate and longest range of vehicle trajectory data at the intersection.

CV equipped vehicles can be expected to be deployed can be some production vehicles starting in 2018, with a slowly increasing market penetration over the following 10-15 years. The traffic controller 210 utilizes these CVs when data can be present, but can take into account the reality that only a fraction of the vehicles can provide this BSM.

Connected vehicles communicate their position and speed using the J2735 Basic Safety Message (BSM) when within an expected 1000' range of the intersection. Given this data sources can be expected to provide a very accurate position and speed, CV vehicles can be placed directly onto the TF when Cobalt receives their data via the BSM. These vehicles can be given a 100% confidence factor while actively receiving BSM positional updates.

4.1.2.7 Peer-Discharge Detection

The traffic controller 210 can take advantage of the geometric awareness and trajectory modeling of adjacent intersections that can be also being controlled by a traffic controller 210 running the traffic controller 210 application. These upstream intersections can communicate the release of vehicles to the downstream intersections and help provide a far advance set of vehicle inputs. These vehicles are not likely to be tracked between the point of passage through upstream intersection and their arrival at the downstream intersection; however, direct measurement of the average free flow speed for arriving vehicles at the downstream intersection along with knowledge of the distance to the upstream intersection may allow the traffic controller 210 to model these vehicle arrivals using estimated speeds.

The traffic controller 210 supports peer-to-peer IP communication between intersections, including adjacent intersections, to exchange the following information: destination IP address (downstream signal), and for each vehicle that can be modeled to proceed onto the downstream signal the estimated time that vehicle can exit the upstream signal and the estimated vehicle speed upon exit to the upstream signal.

Note that these vehicles exiting onto the downstream signal may come from sidestreet turning movements of the upstream signal. The estimated time for exit can be based upon the current Trajectory Framework models for the upstream signal (see section 4.2 for description of the Trajectory Framework) Once the vehicle has been released to the downstream signal (safe passage) it may no longer be modeled by the upstream traffic controller 210 and instead can be modeled by the downstream traffic controller 210.

These datasets can be communicated at a regular interval, such as once per second, to some or all adjacent intersections that are configured within the system.

4.1.2.8 Cellular Vehicle Detection

The traffic controller 210 can take advantage of roadway users who are running a mobile application that communicates their geographic position to the ATMS 242. These applications may provide lat-long and velocity data to the ATMS 242 on a near-real time basis. This application additionally conveys any vehicle prioritization requests to the ATMS 242. This positioning and priority request data can be forwarded by the ATMS 242 to the traffic controller 210 to be applied as another source of vehicle arrival data.

4.1.3 Detection Input Summary

The following table summarizes examples of the aforementioned detection types as well as the data offered:

TABLE 17

| Detector Type | Range | Vehicle Confidence | Vehicle Count | Position | Lane Delin.* | Speed | Accel. |
|---|---|---|---|---|---|---|---|
| Lane Separated Stop line Presence | Stop line Only (6-50') | Only 1 vehicle per lane detected. | Historic inferred from queue discharge | Stop line Only | Yes | No | No |
| Lane Combined Stop line Presence | Stop line Only (6-50') | Only 1 vehicle per approach detected with confidence. | Historic inferred from queue discharge | Stop line Only | No | No | No |
| Lane Separated Stop line Count | Stop line Only (6-20') | Yes | Historic - accurately measured | Stop line Only | Yes | No | No |
| Lane Combined Stop line Count | Stop line Only (6-20') | No | Historic - accurately measured | Point source | No | No | No |
| Advance - Lane Separated | Advance Detection Zone (200'-500') | Yes | Accurate | Advance Detection Zone Only | Yes | No | No |
| Advance - Lane Combined | Advance Detection Zone (200'-500') | Can detect vehicles side-by-side as one vehicle. | Accurate - except for vehicles that can be side-by-side. | Advance Detection Zone Only | No | No | No |
| Advance Speed Detectors | Advance Detection Zone (200'-500') | Yes | Yes | Advance Detection Zone Only | Yes | Yes | No |
| Trajectory-Based Detectors | 300-1000' | % provided by detector. | Accurate but may miss closely spaced vehicles. | Yes, but accuracy at far distance can fade. | Yes, but lane delin. at far distance can fade. | Yes | Radar (yes) Video (no) |
| Connected Vehicle | 1000' | 100% | 100% | Accurate within range | Yes | Yes | Yes |
| Cellular | System Wide | 100% | 100% | Poor (latency) | No | Yes | No |
| Peer Discharge | Upstream Intersections | 100% | Per detection at upstream intersection | Accurate upon release, estimate arrival thereafter | No | No | No |

*Delin. = delineation.

4.2 Trajectory Framework

The traffic controller 210 supports the dynamic trajectory modeling of vehicles upon approach to, and passage through the intersection. The traffic controller 210 can use multiple vehicle detection sources (Refer to section 4.1)) to generate awareness of vehicular demand in advance of their arrival at the intersection. The traffic controller 210 can use these various input sources to create a model of position and trajectory data for some or all detected vehicles within the GID. This section describes how each of the vehicular inputs can be processed, inserted and maintained within a real-time positioning model of some or all detected and assumed vehicles. This present and future state model can be referred to as the Trajectory Framework (hereinafter TF), although the TF may also include solely present state or solely future state information.

4.2.1 Trajectory Framework Data Structure

These vehicular locations can be stored in one or more data structures that establish a positional relationship between the intersection GID and the time-changing position of the vehicles. Examples of these relational data structures are described below.

As defined within the GID, each intersection can be comprised of a set of approaches, with each approach being comprised of a set of lanes. Each lane can be assigned to a vehicular movement, whether that be a left turn, through, or right turn movement. Each of these movements can be mapped within the GID to be controlled by a signal head that can be driven by a phase or overlap within the traffic controller 210. This hierarchy can be represented as: GID (Intersection #)→Approach Number (1-8)→Lane Number (1-8)→Movements Allowed (LT/RT/TH)→Phase/Overlap assigned to movement.

The trajectory framework can be comprised of a hierarchical database that provides storage of the vehicle positioning data within each lane for some or all approaches to the intersection. The following data can be stored for each vehicle that can be being actively modeled within the TF:

Each of these sources vary in the proximal distance from the intersection as well as quality and availability of data. As such, the traffic controller 210 may begin to model vehicle 4.2.2 Data Fusion Given the various types of vehicle detection inputs, and desire to utilize some or all available sources of information, the traffic controller 210 can provide a fusion of these detection inputs and other data sources into a collective set of vehicle trajectories within the GID. arrivals across a broad

TABLE 18

Table: Active Vehicle Data

Figure 9:
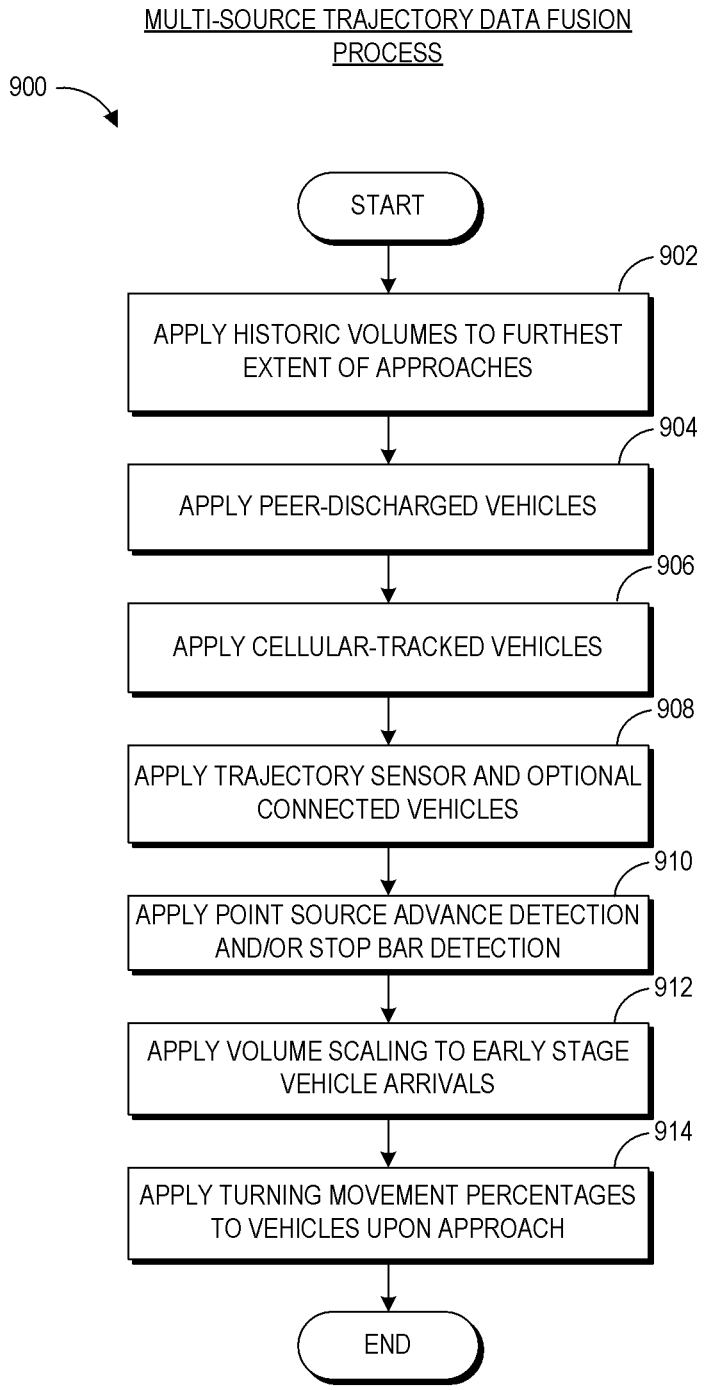
FIG. 9 depicts an embodiment of a multi-source trajectory data fusion process.

| Data Element | Range | Description |
|---|---|---|
| VehicleUID | 0-65535 | VehicleUID can be a locally unique identifier assigned to each vehicle that can be modeled within the TF. UIDs can be assigned in incremental order as detected using an unsigned word. The counter can be reset to zero at midnight or some other reference time. |
| Approach Number | 1-8 | Approach can be the approach number (1-8) that the vehicle can be currently located upon as defined in the GID. Note that this may change in time based upon the future trajectory of the vehicle. |
| Arrival Lane Number | 1-8 | Lane can be the lane number (1-8) that the vehicle was initially detected to occupy as defined in the GID. |
| Vehicle Length | 1-100' | Vehicle Length can be provided by the vehicle detector or CV. If the data can be not available, it can be assumed to be a standard car length (20') |
| Vehicle Detection Confidence | 1-100% | Detection Confidence can be provided by the vehicle detector. This data can be generated within the detection algorithms when processing artifacts that may not be fully detected as a vehicle. |
| Vehicle Priority | 1-100 | Some vehicles may be able to communicate a request for priority service at the intersection. This score provides a weighted measurement of the vehicle demand that can be applied by the Objective Function. |
| Lane | 1-8 | Lane can be the lane number (1-8) that the vehicle is currently detected or assumed to occupy as defined in the GID. Note that this may change in time based upon the future trajectory of the vehicle (lane selection). |
| Distance | +/−3276.7 m | Distance can be defined as the distance of the vehicle relative to the stop line. Distances can be stored with decimeter precision. They can be defined as the distance along the lane centerlines relative to the stop line. The stop line can be defined at 0.0 m. The approach up to the stop line can be represented as positive distances, and distances beyond the stop line (through the intersection) can be defined as negative distances. |
| Speed | 0-100.0 m/sec | Speed can be defined as the current speed of the vehicle in meters per second with decimeter/sec precision of storage. |
| Acceleration | +/−0-100.0 m/sec$^2$ | Acceleration can be defined as the current acceleration of the vehicle in units of m/sec$^2$ with decimeter/sec$^2$ precision of storage |
| Dilemma Zone (Y/N)? | Y/N | Dilemma Zone can be a real time attribute of each vehicle that denotes whether it can be currently occupying the "dilemma zone" within the intersection. This attribute can be derived from the vehicle speed and distance to the stop line. It can be stored here as a Boolean value to simplify future computation. |
| Left Turning Movement Percentage | 0-100% | Forecasted probability that the vehicle can make a left turn at the intersection. |
| Right Turning Movement Percentage | 0-100% | Forecasted probability that the vehicle can make a right turn at the intersection. |

distance and then can refine the trajectories of these vehicles within each of these detection zones. This modeling follows a staged process in certain embodiments as follows:

Stage 1: Apply Historic Volumes to Furthest Extent of Approaches. (FIG. 9, Block 902)

At the furthest upstream distance from the intersection, the traffic controller 210 can only have historic data to draw upon. This data can be of the form of historic vehicular volumes for approach over each cycle. In approaches outfitted with advance detection, the additional information of historic arrival profiles relative to the phase cycle can additionally be gleaned.

The traffic controller 210 begins in one embodiment by determining the historic average volume per cycle for each approach. This volume can be defined as a rolling average volume taken over the prior 5 cycles (other numbers may be chosen). In the event that this data does not exist (controller restart) the average volume can be taken by averaging the approach volume for the prior 4 weeks (for example) during the same day of week and hour of day.

These historic volumes can be then applied by introducing vehicles into the model at the furthest distance modeled for the approach at a rate consistent with these volumes. As example, if an approach has a modeled distance of 1000 m, and has an average volume of 45 vehicles per the 90 second cycle, the traffic controller 210 can model a new arriving vehicle at the 1000 m distance, traveling at the free flow speed, every 2 seconds. These vehicles can be placed in alternating lanes when more than one lane exists.

At this stage the model can have fictitious vehicles that can be on the approach with value only to model expected demand levels.

Stage 2: Apply Peer-Discharged Vehicles. (FIG. 9, Block 904)

The traffic controller 210 supports peer intersection communication of the discharged vehicles to each downstream intersection. This may not be available for some or all intersections, but can be useful or even critical data for optimization when available. Once per second, each intersection can receive the trajectory information of any vehicles that can be modeled to approach the downstream intersection. This data can be to include the estimated time to be released from the upstream signal as well as estimated vehicle speed upon release. This data can then be applied to the TF to place these known vehicles in the approach to the downstream intersection.

This vehicle data can be not as fictitious in nature as can be the case for historic volumes. In cases where this peer intersection data can be provided, this data can replace the historic vehicle volumes.

The location of these vehicles between their upstream discharge and eventual detection at the downstream approach cannot be precisely known in some instances. As such, these vehicles can be modeled to continue on the approach, accelerating from the last known speed up to the free flow speed. The eventually can reach the approach of the downstream signal and be detected by the next set of detectors.

Stage 3: Apply Cellular-Tracked Vehicles. (FIG. 9, Block 906)

At this stage, any vehicles that can be currently being tracked via a cellular connection can be added to the model. Any cellular tracked vehicle that appears to coincide within 20' of a peer discharged vehicle, can be assumed to be the same vehicle and can retain the same UID.

Stage 4: Apply Trajectory Sensor and CV Sourced Vehicles. (FIG. 9, Block 908)

At the next level of refinement, vehicles that have been physically detected upon approach using a trajectory detector or a connected vehicle input can now be updated with greater accuracy. It can be assumed that any vehicles modeled in approach to the intersection but not detected within range of the sensor can be no longer present. As such, within the range of these sensors, some or all vehicles that were previously modeled, can be replaced by the vehicles detected at the approach.

Stage 5: Apply Point Source Advance Detection. (FIG. 9, Block 910)

This level of refinement applies vehicles that have been physically detected upon approach using a point source presence detector. It can be assumed that any vehicles modeled in approach to the intersection but not detected crossing this sensor can be no longer present. As such, at this point within the TF, some or all vehicles that were previously modeled, can be replaced by the vehicles detected by these sensors. Any vehicle that was previously modeled and appears to be in the same lane, and within 20' of the presence detected vehicle, can be assumed to be the same vehicle and can retain the same UID.

Stage 6: Apply Point Source Stop Line Detection. (FIG. 9, Block 910)

This level of refinement applies vehicles that have been physically detected at the stop line using a point source presence detector. It can be assumed that any vehicles modeled in approach to the intersection but not detected crossing the stop line can be no longer present. As such, at this point within the TF, some or all vehicles that were previously modeled, can be replaced by the vehicles detected by these sensors. These sensors can be likely to provide lane delineation of the arriving vehicles.

Any vehicle that was previously modeled and appears to be in the same lane, and within 20' of the presence detected vehicle, can be assumed to be the same vehicle and can retain the same UID.

Stage 7: Apply Volume Scaling to Early Stage Vehicle Arrivals (FIG. 9, Block 912)

There are likely to be differences between the aggregate volume of vehicles projected by the historic averages and peer discharges versus the reality of volume measured by the physically sensed vehicles upon arrival at the intersection. This can be due to mid-block ingress/egress patterns onto the roadway network or errors within the early stage detection sources. The traffic controller 210 can maintain a comparison of the arrival demand from the stage 1 and 2 sources versus the actual measurement of vehicle arrivals. It can then adjust the arrival demand from the stage 1 and 2 sources to provide greater consistency and accommodate this mismatch of scaling. This can be accomplished by increasing or decreasing the vehicle detection confidence (even above 100%) for vehicles that can be modeled beyond the reach of the advance intersection detectors. These weighted measurements can normalized any aggregate demand calculations to correct for these scaling differences. This scaling can be measured and updated on an hourly basis.

Stage 8: Apply Turning Movement Percentages to Some or All Vehicles Upon Approach. (FIG. 9, Block 914)

Arriving vehicles to the intersection can be likely to make a lane selection into a through or turning movement. This last minute lane selection does not provide adequate prior modeling of vehicular demand for turning movement demands. In order to forecast turning movement demands, each arriving lane can carry a real time attribute of turning movement percentage. This turning movement percentage is not likely to match up for each vehicle, but carries aggregate value for demand modeling of future state conditions. The traffic controller 210 can measure the approach volumes as well as turning movement volumes after the fact, and can use this information to generate a turning movement percentage that can be applied on this per lane, aggregate basis.

At this stage of input processing, a turning movement percentage can be applied to each vehicle based upon the lane occupied and historic turning movement averages. This percentage can be even assigned to vehicle far upstream from the signal to facilitate future demand forecasting of turning movements within the TF. The following rules can be applied for discernment of the turning movement attributes for vehicles: vehicles that have been detected upon the approach to have selected a dedicated turning or through lane, can have their turning movement percentages updated to reflect this lane selection; vehicles that have been detected to be in a shared through/turning lane, but can be slowing down without a red signal or other vehicle in front of them, can be determined to be in a turning movement and can be tagged accordingly; and/or vehicles that have been detected to be in shared through/turning lane, but can be traveling faster than the turning movement speed can be tagged as through movement vehicles.

This staged process can allow fusion of some or all vehicle detection sources into a singular Trajectory Framework. This framework provides the most comprehensive description of the pending vehicular demand possible given the input sources.

4.2.3 Future State Trajectory Projection

The traffic controller 210 models a projected future state of each vehicle trajectory within this system. The future state modeling projects one cycle length into the future (or optionally more than one or a partial cycle into the future), building a model of the expected vehicle trajectories for each approach over the next cycle. This section describes the mechanism at which this future state trajectory can be determined.

4.2.3.1 Phase Sequence and Timing Estimation

In order to develop a future sate trajectory model, the traffic controller 210 can begin with an assessment of the possible future phase sequence and timing options. This establishes an expected timeframe for red/yellow/green service to some or all movements in a near term time horizon. This expected service can have obvious impact upon the vehicle trajectories as they slow down and queue for red signals and proceed through green signals.

Per the active phase sequence policy, in one embodiment, the traffic controller 210 maintains a set of up to 16 allowable phase sequences. Examples of these sequences can be as follows. Phase Sequence 1: Standard dual quad with leading left turns (with each column from left to right indicating a phase shift, e.g., with 1&5 shifting to 2&6 in Table 19):

TABLE 19

| | | | | |
|---|---|---|---|---|
| 1 | 2 | 3 | 4 | . . . 1 |
| 5 | 6 | 7 | 8 | . . . 5 |

Phase Sequence 2: Dual quad with sequential side street service (difference with Table 19 highlighted in bold):

TABLE 20

| | | | | |
|---|---|---|---|---|
| 1 | 2 | 3 | 4 | . . . 1 |
| 5 | 6 | **8** | **7** | . . . 5 |

The future state trajectory model begins by gathering the set of some or all possible (up to 16) phase sequence options from the sequence policy.

The expected duration for each of these possible phase sequences can also be determined in order to build an accurate future state model of the possible phase sequence and timing options. The actual phase durations for each of these movements may not be fully known ahead of time, but can be estimated as a function of expected vehicular demand that has been generated in the TF.

Given the cycle length (e.g., time to serve all phases in sequence) and offset reference point can be predetermined from the time of day (TOD) pattern, the duration of each phase can be constrained so that all phases can be served within a cycle length and within the boundary of the coordinated offset reference.

The traffic controller 210 may expect the duration of the future phase split times to be in balanced proportion to the future vehicle arrivals at each movement. It can allocate 2 seconds per vehicle per lane (or some other value) across some or all vehicles that can have arrived to the intersection by its time of service. This count of future state demand can be estimated by counting the vehicles within the TF within range of the intersection to be served if driving at free flow speed.

As example: if we can be seeking the split time for phase 7, which has an approach speed of 20 m/sec and can be to begin in 35 seconds, we can count the aggregate turning movement probabilities of some or all vehicles upon this approach that can be within (20 m/sec*35 seconds)=700 m of approach of the intersection. We can additionally seek vehicles that can be expected to arrive under green extension as (20 m/sec*2 seconds/vehicle*number of vehicles counted within this range). This provides an estimated time of needed service to accommodate some or all queued and arriving vehicles for that future state phase split time.

This future sequence modeling can begin with the active phase movements and project this demand modeling one full phase sequence into the future. It provides additional time back to the main street movements, where it can dwell until the appropriate time to serve the next cycle.

In the event that there can be not sufficient time to serve some or all movements, the split times can scaled into proportion to demand of some or all movements. (e.g., The traffic controller 210 can provide 1.X seconds per vehicle per lane across all movements)

Note that sequence rules may require all rings to terminate their phases concurrent at barrier crossings (e.g., all main street movements can terminate at the same time before side street service is provided) These rules may result in critical movements being allocated split times at a full demand level and under-saturated movements being afforded extra time merely to accommodate the critical movements.

Example—Phase Sequence 1, Assume: the traffic controller 210 just began serving phases 2&6 with an estimated time remaining of 40 seconds; the cycle length is 100 seconds; and the free flow speed for all approaches is 20 m/s.

TABLE 21

| | | | | |
|---|---|---|---|---|
| ph2<br>40 sec | ph3 | ph4 | ph1 | ph2 |
| ph6<br>40 sec | ph7 | ph8 | ph5 | ph6 |

From this assumption, determine estimated split durations for the future phase movements.

Solution: The traffic controller 210 begins by demand modeling the next phases in sequence (3&7) determining the maximum number of vehicles in a lane within (40 seconds*20 m/sec=800 m) of the approach for each of these phases. The traffic controller 210 can take this number of vehicles*2 seconds/vehicle to determine the phase time needed to serve these vehicles. The model can then iteratively look for additional vehicles that will have arrived at phases 3&7 during the service of the previously counted vehicles for 3&7 and provide additional time for those vehicles. These phases 3&7 then can be terminated after service for all vehicles that will have arrived. Phases 4 and 8 are then evaluated to determine how many vehicles will have arrived at these phases upon termination of phases 3&7 and provide 2 seconds of service for each of these vehicles. Note that the service of phases for and 8 may begin at different times since service to phase 4 can commence after service of all vehicles for phase 3 and service of phase 8 can commence after service for all vehicles on phase 7. Upon completion of service to phases 4&8, these phases can terminate simultaneously to serve the demand that will have arrived to phases 1&5 by that point in time where these phases are served.

This future state extrapolation assumes there is sufficient time to serve all arriving vehicles and still provide return to phases 2&6 consistent to the 100 second cycle length. In the event that this is not possible, these times may be scaled downward in relative to the movement and objective weighting provided in the objective function to provide priority of service to phases consistent to the priority (weight) provided by the user.

4.2.3.2 Trajectory Estimation

Once the phase timing is anticipated, the future movements of the vehicles within the TF can be modeled. Vehicles can be modeled using any subcombination of the following rules or the like: Vehicles that have an unobstructed path can accelerate from their current speed up to the parameter of FreeFlowSpeed[Approach]. This parameter can be provided within the GID, but updated hourly based upon the field measurement of FreeFlowSpeed[Approach] from those vehicles whose speed can be measured upon unimpeded approach to the intersection. Vehicles that can be queued can be discharged in accordance to parameter QueueDischargeRate[Approach]. This can be defaulted to 3 seconds per vehicle, but can be updated hourly based upon field measurement of vehicular discharge rates. Vehicles can accelerate at a rate consistent to the parameter AvgAccelerationRate. AvgAccelerationRate can be updated hourly based upon the measurement of actual vehicle accelerations from the trajectory detectors. Vehicles that have an obstructed path can decelerate from their current speed down to the speed of the obstruction. This deceleration can begin at a point where the deceleration matches their speed to the speed of the obstruction at the AvgFollowingDistance. The parameter AvgFollowingDistance can be defaulted to 20' per every 10 mph, but can be updated hourly based upon field measurement.

The position speed and acceleration of vehicles within the TF can be updated iteratively from the present measured conditions, once per second, for one cycle length into the future.

This simulation begins by updating the lead vehicle in each lane, and then updating the position of each subsequent vehicle relative to the lead vehicle or signal state.

The following pseudo code provides description of the modeling of vehicular movements:

```
//Starting now, iterate through one cycle length into the future with one
second time increments
for (time = now; time < cyclelength; time += 1 second)
{
  //Iterate through all movements
  for(movement = 1; movement <= max_movements; movement++)
  {
    //Iterate through all lanes
    for(lane = 1; lane <= max_lanes; lane++)
    {
      //Iterate through all vehicles in the lane, starting with the lead
      vehicle for(lane.vehicle.lead; lane.vehicle.last; lane.vehicle.next)
      {
        //Accelerate vehicle up to FreeFlowSpeed if path can be
        unobstructed if(lane.vehicle.path.unobstructed)
        {
          Vehicle.acceleration = AvgAccelerationRate
          Vehicle.speed = Vehicle.speed + AvgAccelerationRate
          If(Vehicle.speed > FreeFlowSpeed[Approach])
            Vehicle.speed = FreeFlowSpeed[Approach]
        }
        //Decelerate down to Obstruction speed if path can be obstructed
        else if (lane.vehicle.path.obstructed)
        {
          Vehicle.acceleration = AvgDecelerationRate
          Vehicle.speed = Vehicle.speed – AvgDecelerationRate
          If(Vehicle.speed > Obstruction.speed)
            Vehicle.speed = Obstruction.speed
            Vehicle.acceleration = 0;
        }
            //Output: Store the updated position, speed, and
acceleration for each vehicle for each point in time
      Vehicle.position[time+1]    = Vehicle.position[time] +
                                    Vehicle.speed
      Vehicle.speed[time+1]       = Vehicle.speed
      Vehicle.acceleration[time+1]= Vehicle.acceleration
```

The following data can be stored for each vehicle that has been modeled within the TF: Modeled Future Vehicle Trajectory Table: Phase sequence option (1-16), Active Phase duration (0-PHASE_MAX), Timestamp (0-CycleLength), VehicleUID {Lane, Distance, Speed, Acceleration, Dilemma Zone (Y/N)?}; Modeled Future Lane Details Table: Phase sequence option (1-16), Active Phase duration (0-PHASE_MAX), CycleNumber (Timestamp, Lane {Signal State, Queue Head position, Queue Tail position, VehicleUID [MAX_VEHICLES]}).

4.2.3.3 Historic Vehicle Data Sets

The traffic controller 210 maintains a record of the historic position of each vehicle within the TF. This historic data can be utilized for positional smoothing as well as archived for offline analysis by the ATMS 242 system. The following data can be stored for each vehicle that has been modeled within the TF:

TABLE 22

Table: Historic Vehicle Data

| Data Element | Range | Description |
|---|---|---|
| Timestamp | Date/HH:MM:SS | This historic data can be stored on a 1/second basis. |
| VehicleUID | 0-65535 | VehicleUID can be a locally unique identifier assigned to each vehicle that can be modeled |

TABLE 22-continued

Table: Historic Vehicle Data

| Data Element | Range | Description |
|---|---|---|
| | | within the TF. UIDs can be assigned in incremental order as detected using an unsigned word counter (0-65535). |
| Approach Number | 1-8 | Approach can be the approach number (1-8) that the vehicle can be currently located upon as defined in the GID. Note that this may change in time based upon the future trajectory of the vehicle. |
| Arrival Lane Number | 1-8 | Lane can be the lane number (1-8) that the vehicle was initially detected to occupy as defined in the GID. |
| Vehicle Length | 1-100' | Vehicle Length can be provided by the vehicle detector or CV. If the data can be not available, it can be assumed to be a standard car length (20') |
| Vehicle Detection Confidence | 1-100% | Detection Confidence can be provided by the vehicle detector. This data can be generated within the detection algorithms when processing artifacts that may not be fully detected as a vehicle. |
| Vehicle Priority | 1-100 | Some vehicles may be able to communicate a request for priority service at the intersection. This score provides a weighted measurement of the vehicle demand that can be applied by the Objective Function. |
| Lane | 1-8 | Lane can be the lane number (1-8) that the vehicle can be currently detected or assumed to occupy as defined in the GID. Note that this may change in time based upon the future trajectory of the vehicle (lane selection). |
| Distance | +/−3276.7 m | Distance can be defined as the distance of the vehicle relative to the stop line. Distances can be stored with decimeter precision. They can be defined as the distance along the lane centerlines relative to the stop line. The stop line can be defined at 0.0 m. The approach up to the stop line can be represented as positive distances, and distances beyond the stop line (through the intersection) can be defined as negative distances. |
| Speed | 0-100.0 m/sec | Speed can be defined as the current speed of the vehicle in meters per second with decimeter/sec precision of storage. |
| Acceleration | +/−0-100.0 m/sec$^2$ | Acceleration can be defined as the current acceleration of the vehicle in units of m/sec$^2$ with decimeter/sec$^2$ precision of storage |
| Dilemma Zone (Y/N)? | Y/N | Dilemma Zone can be a real time attribute of each vehicle that denotes whether it can be currently occupying the "dilemma zone" within the intersection. This attribute can be derived from the vehicle speed and distance to the stop line. It can be stored here as a Boolean value to simplify future computation. |

A Historic Lane Details Table stored at the traffic controller 210 may contain information such as the following: CycleNumber (Lane [QueueTailPositionAtBeginGreen, StartupLostTime, QueueDischargeRate, Volume, ArrivalProfile {ArrivalDistance, TimeStamp, VehicleUID}], Timestamp, Dilemma Zone, Position, Speed).

A Safety Conflicts Table (store location of safety events within this table) stored at the traffic controller 210 may contain information such as the following: ConflictUID (CycleNumber, Timestamp, ConflictType, Lane, Distance).

Per-Vehicle Data:

The following information can be stored for each vehicle that can be modeled within the TF. Vehicle position data can be stored with the following properties:

(1) Phase Sequence Option. The traffic controller 210 can model the future state trajectory of vehicles upon an assumption of maintaining the current phase state, as well as modeled upon an assumption of terminating the current phase state to serve demand on alternate phases. This field stores the operating assumption as an enumeration. 0=historic data or current phase conditions. 1–N can be alternate phase sequencing options that may be additionally modeled.

(2) Current Phase Duration: In addition to optional phase sequences, the traffic controller 210 models the traffic impact of terminating the current phases at different times in the future. This field stores the additional duration of the current phase green. (0=terminate green now, 60=terminate green 6.0 seconds into the future)

(3) Timestamp. The timestamp can be stored in deciseconds from now, using a signed integer (e.g.: now=0; 9.0 seconds ago=−90; 4.5 seconds in the future=45), at each timestamp the following trajectory data can be stored. The TF allows storage of past, present and future state positional data as follows: Distance: This can be the distance from the stop line, stored in decimeters using a signed integer (e.g.: 20 m before the stop line=−200; at the stop line=0; 5 m past the stop line=50); Speed: The linear magnitude of the velocity of the vehicle along the direction of travel, stored as decimeters per second; Acceleration: The linear magnitude of acceleration along the direction of travel for the vehicle, stored in decimeters per second$^2$. A positive acceleration value corresponds to an accelerating vehicle and negative value denotes deceleration.

Per-Lane Data:

The following information can be stored for each lane modeled within the TF, among other things: timestamp. The timestamp can be stored in deciseconds from now, using a signed integer (e.g., now=0; 9.0 seconds ago=−90; 4.5 seconds in the future=45). At each timestamp the following lane data can be stored. The TF allows storage of past, present and future state lane conditions, such as: signal state, stored as an enumeration of the following options (protected, permissive, yellow clearance, red clearance, red (prohibited); queue head position, the location of the leading stopped vehicle within the queue, stored as a distance from the stop line, in decimeters using a signed integer (e.g., 20 m before the stop line=−200; at the stop line=0; 1 m past the stop line=10); and queue tail position, the location of the furthest upstream stopped vehicle within the queue, stored as a distance from the stop line, in decimeters using a signed integer.

This data can be used to model the present and future state positioning of some or all detected vehicles. This future state trajectory can be modeled upon an assumption of maintaining the current phase state, as well as modeled upon an assumption of terminating the current phase state to serve demand on alternate. This future state modeling determines those cars likely to have excessive deceleration, run a red light, or experience a near proximal conflict with another vehicle. This future state projection enables the traffic controller 210 to modify signal timing to ensure the optimal phase termination point as defined within the Objective Function.

4.2.4 Example Relational Format for Trajectory Framework Data

The traffic controller 210 can record the following traffic flow data in a relational format for query by the traffic controller 210 optimization and logging routines:

Raw Input Level Data: The traffic controller 210 can retrieve and retain vehicular input data from the various detection sources. This raw data can be useful to build the GID-based traffic flow model, but can be then retained to validate and/or troubleshoot the detection devices. The following data can be stored in a log and available for retrieval: traditional detection and tracking detection. Each of these is described in more detail as follows:

Traditional Detection: The following raw input data can be stored from traditional detectors for each detected vehicle: Detector #: (detector ID reference #1-64); Timestamp of Actuation: (HH:MM:SS.deciseconds); and Duration of Actuation: (milliseconds).

Tracking Detection: The following raw input data can be collected from the tracking-based detection sources and kept as a real-time perspective of the vehicular demand. This data may or may not be stored for historical logging and includes: Lane #: For Each Vehicle in the Lane: (assumes lane determination has already been calculated from positional data and stdev estimates) Vehicle Confidence %; Distance from stop line; Vehicular velocity vector; Vehicular acceleration/deceleration; and Vehicle length classification.

Fused Data: The following traffic flow data can be stored based upon the fused traffic input data from some or all available sources: Demand Volume and Loop Occupancy, Service Volume, Vehicular Queue, Vehicular Delay/Stops, Vehicular Arrival Profile, Vehicular Speed Profile, and Vehicular Gap (spacing) Profile. Each of these is described in greater detail as follows:

Demand Volume and Loop Occupancy: Volume can be the number of vehicles demanding service to a particular phase or overlap. It can be usually measured over some fixed time interval. Demand volume can be registered when a vehicle can be first detected (based upon detection type). Demand volume can be logged and retrievable on a minute-by-minute basis as well as a cycle-by-cycle basis. Occupancy can be a measure of time that a traditional detection loop can be "occupied" by a vehicle. If this data can be not provided exactly from a loop detector on the lane, it can be derived based upon the measured vehicle volumes, speeds, vehicle lengths, and assumed loop lengths. Example demand volume and loop occupancy data can include: Phase/Overlap#; Lane # (lane upon initial detection); Cycle # (rollover counter); HH:MM (timestamp); and Volume (vehicular counts).

Service Volume: Service volume can be the number of vehicles being serviced on a particular phase over time. Service volume can be registered when a vehicle passes over the stop line and can be "served" under a permitted movement. Examples include: Phase/Overlap#; Phase/Overlap state when served: {Protected Green, Permissive Green, FYA, Yellow Clearance, Red Clearance, Flashing Yellow, Flashing Red, Solid Red}; Lane # (lane upon service); Cycle # (rollover counter); HH:MM; and Volume (vehicular counts).

Vehicular Queue: Vehicular queue can refer to the number of vehicles awaiting service in a lane, or the combined length of some or all vehicles and inter-vehicle spacing queued for service. The traffic controller 210 can record a real-time and historic record of the queue of vehicles awaiting service for each phase/overlap. The following data can be stored: Phase/Overlap#; Lane #; Stored data: {Cycle # (rollover counter), HH:MM, Vehicle Queue upon beginning of Green, Vehicle Queue upon termination of Green, Maximum Queue, Queue Length upon beginning of Green, Queue Length upon termination of Green, Maximum Queue length}.

Vehicular Delay/Stops: The traffic controller 210 can record a real-time and historic record of the delay and stops for vehicles awaiting service for each phase/overlap. The following data can be stored: Phase/Overlap#; Lane #; Vehicular Delay Rate (real-time, number of vehicle-seconds per second being delayed); Stored data: {Cycle # (rollover counter), HH:MM, Aggregate vehicular delay (per cycle and per lane), Aggregate number of vehicle stops}.

Vehicular Arrival Profile: The traffic controller 210 can record a real-time and historic record of the vehicle arrivals relative to the service for each phase/overlap. The following data can be stored: Phase/Overlap#; Lane #; Arrival Profile (real-time, histogram for number of vehicles awaiting service from t=now to t=next cycle (seconds)); Stored data: {Cycle # (rollover counter), HH:MM (upon beginning of green), Arrival Profile (real-time, number of vehicles awaiting service from t=(beginning of current cycle green) to t=(beginning of next cycle green)}.

Vehicular Speed Profile: The traffic controller 210 can record a real-time and historic record of the vehicle speeds relative to the service for each phase/overlap. The following data can be stored: Phase/Overlap#; Lane #; Instantaneous Speed Profile (real-time, histogram of vehicular speeds for some or all vehicles in the lane); Mean Profile Speed (real-time, mean speed per profile above); Stored data: {Cycle # (rollover counter), HH:MM (upon beginning of green), Arrival Speed Profile (histogram of vehicular speeds for some or all vehicles upon first detection in the lane)}.

Vehicular Gap (spacing) Profile: The traffic controller 210 can record a real-time and historic record of the vehicle spacing for each phase/overlap. The following data can be stored: Phase/Overlap#; Lane #; Instantaneous Gap Profile (real-time, histogram of vehicular gaps for some or all vehicles in the lane); Mean Profile Speed (real-time, mean speed per profile above); Stored data: {Cycle # (rollover counter), HH:MM (upon beginning of green), Arrival Speed Profile (histogram of vehicular speeds for some or all vehicles upon first detection in the lane)}.

4.2.4.1 Free-Flow Speed Modeling

The free-flow speed of the intersection can either be input as an element of the GID or measured from any advanced detection sources. Free-flow speed can be defined, in addition to having its ordinary meaning, as the mean speed of vehicles approaching an unimpeded green signal (after the queue has fully discharged). This can be likely to change based upon arterial congestion, weather patterns, or other time-of-day based factors. The traffic controller 210 can measure and log this free-flow speed as a basis for modeling traffic flow characteristics.

4.2.4.2 Delay Modeling

The traffic controller 210 can model intersection delay by comparing the measured free-flow speed of the approach against the actual vehicle trajectory of each vehicle. The delay contribution for these vehicles can be the time difference between the ideal free-flow traverse through the entire intersection, and the measured trajectory through the intersection. This delay can be the sum of three delay components:

$$\begin{aligned}&\text{Arrival delay(delay for vehicles approaching queue)} +\\&\quad\text{Queue delay(delay for vehicles in queue awaiting discharge)} +\\&\quad\text{Discharge delay(delay for vehicles accelerating from}\\&\quad\text{queue to free flow speed)} = \text{Total Control Delay}\end{aligned}$$

4.3 Strategic Optimization:

The traffic controller 210 can utilize policy-level inputs, geometric understanding, and automated configuration to transform the nature of traffic control from the current practice of feature-level tuning, to instead offer a platform for traffic control via strategic objectives. This can be accomplished by allowing users (e.g., of agencies such as a department of transportation (DOT) or traffic engineers) to establish strategic objectives via a multi-component objective function along with a vehicle prioritization scaling, which in turn allows the agency to create plans that can automatically optimize traffic control in accordance with their user-defined, strategic objectives. This user-definable objective function includes the following parameters for strategic prioritization in one embodiment: Vehicle delay (seconds), Number of vehicle stops (vehicles that can be forced to stop), Vehicle emissions (CO), Intersection safety, Intersection capacity, and Vehicle priority classification. Fewer or more factors may be incorporated in the objective function in other embodiments. For convenience, however, the remainder of this specification uses the example of these five factors or objectives as being implemented in the objective function.

Inherent tradeoffs exist between these objectives. As one example, the safest possible intersection can be also highly inefficient. As another example, increases to intersection capacity also increase delays to side street movements. Modern traffic controllers do not support control in accordance with a prioritization of these objectives. The traffic controller 210 can allow users to establish control plans that independently prioritize each of these objectives, for example, by outputting a user interface similar to FIG. 6 that allows users to specify priorities or weights for different objectives or factors. This prioritization can be applied for each type of approach (main street versus side street), location within the system (e.g., certain roadways or areas of town), and may even be modified on a time-of-day basis. For example, emissions-based control can be enacted during peak pollution hours and locations. Alternatively, intersection capacity can be optimized during oversaturated conditions. In a different scenario, safety could be more highly prioritized for intersections that reveal the highest safety risks.

Vehicle priority classification allows users to designate certain types of vehicles to have an increased weighting within this objective function. As example, busses, trucks and other larger vehicles can be given a higher priority based upon their detected vehicle size. Other vehicles that can wirelessly transmit their classification data to the intersection (police, emergency vehicles, fleet vehicles, etc.) can also be given a higher prioritization within the objective function.

4.3.1 Objective Function Based Signal Timing:

The traffic controller 210 can optimize coordinated and free running signals under a user-definable objective function that can be minimized in real-time based upon traffic demand:

$$f(\text{objective}) = \sum_{m=0}^{movements} w_m(w_d\text{delay}_{movement} + w_s\text{stops}_{movement} + w_e\text{emission}_{movement} + w_s\text{safety}_{movement} - w_c\text{capacity}_{movement})$$

This objective function can allow traffic engineers to establish a policy for the relative importance of movements via a weighting factor for each movement. These weights can be user-definable (e.g., in a user interface such as in FIG. 6), but can default to the following values:

$w_m$=1.00 for m=major through movements
$w_m$=0.50 for m=major turning movements
$w_m$=0.50 for m=minor through movements
$w_m$=0.50 for m=minor turning movements This objective function additionally allows the user to establish a policy for the relative importance of several objectives via a weighting factor for each objective. These weights can be user definable (e.g., in a user interface such as in FIG. 6), but can default to the following values:

$w_d$=1.00 (delay)$_{vehicle\text{-}minutes}$
$w_s$=0.10 (stops)$_{vehicle\text{-}stops}$
$w_e$=0.50 (emissions)$_{grams\text{-}CO}$
$w_s$=1.00 (safety)$_{vehicle\ conflicts}$
$w_c$=1.00 (capacity)$_{vehicles\ per\ minute}$ In example alternate units of vehicle-seconds and centigrams, the weights may be:

$w_d$=1.00 (delay)$_{vehicle\text{-}seconds}$
$w_s$=0.10 (stops)$_{vehicle\text{-}stops}$
$w_e$=0.50 (emissions)$_{centigrams\text{-}CO}$
$w_s$=1.00 (safety)$_{vehicle\ conflicts}$
$w_c$=1.00 (capacity)$_{vehicles}$ 4.3.2 Objective Sets The traffic controller 210 can allow users to establish sets of these objective functions, identify them via alphabetical characters, and apply them to groupings of traffic signals on a time-of-day basis. As examples of possible applications. The traffic controller 210 may allow objective plans to be established and scheduled as one or more of the following four example plans:

Emissions Reduction Plan: Increased focus (weight) upon emissions control to be applied at critical sections of town during most polluted times of day.

Late Night Optimization: Weighted focus upon safety and reduction of stops during late night operation.

Normal Delay Reduction: Weighted focus on reduction of delay during normal operating conditions.

Oversaturation Plan: Weighted focus on maximization of overall capacity during oversaturated conditions.

In certain embodiments, the traffic controller 210 has the ability to measure and optimize these objectives through its geometric awareness of the intersection as well as vehicle trajectory data within the geometry of the intersection.

The ability of the traffic controller 210 to optimize these objective functions can be largely dependent upon the vehicle detection capabilities at the intersection. The traffic controller 210 can geometrically model vehicles within the network based upon a broad range of detection types as described in Sections 4.1 and 4.2. The following models can be applied in application of each of these objectives:

4.3.3 Delay

The traffic controller 210 can measure delay in vehicle-seconds. This measurement can be defined as the travel time difference between the trajectory of each vehicle through the intersection versus theoretical time it would take the vehicles to drive through the intersection at the FreeFlowSpeed. The traffic controller 210 can measure delay of vehicles using the Trajectory Framework as:

$$\text{delay}_{vehicle} = \sum_{initial\ deceleration\ upon\ approach}^{return\ to\ FreeFlowSpeed} TF \left\{ \frac{FreeFlowSpeed[\text{approach}] - \text{speed}_{vehicle}}{FreeFlowSpeed[\text{approach}]} \right\} \Delta\text{time}$$

where the TF{ } notation refers to vehicles represented in the trajectory framework (TF), such that delay is summed for all vehicles represented in the TF in some embodiments. The quotient within the brackets provides a percentage of delay, which may then be multiplied by a time change value (delta time) as part of the overall delay calculation for the vehicles.

Note that this delay can be not be limited to the delay of deceleration and queuing upon approach to a signal, but also include the delay from re-acceleration of the vehicle after departing the intersection until it can be modeled to reach the FreeFlowSpeed[Approach] after passing through the intersection.

The traffic controller 210 can optimize the delay component of the objective function by projecting the aggregate delay of the vehicular movements under various phase sequences and timing within the TF. The traffic controller 210 can perform this future state delay projection by building a real-time arrival and queuing profile for each approach. The delay on each movement can be directly proportional to the number of vehicles approaching or within the traffic queue, as well as the length of time prior to phase service and resultant queue discharge. This delay may not be a singular value, but a value that varies across a future time domain. The methodology employed by the traffic controller 210 allows for a forward time projection of the future delays based upon either serving or not serving the traffic movement.

The traffic controller 210 can update this delay calculation regularly, such as once per second, for each traffic movement. It can look forward a full cycle length in time when providing this delay model. Phase sequencing and timing decisions can reduce or minimize the impact of the aggregate delays subject to the weighting applied in the objective function, over this time horizon.

4.3.4 Stops

The traffic controller 210 can measure vehicle stops in units of number of stopped vehicles. The traffic controller 210 can define a vehicle stop as any vehicle that can fully stop at either a red signal or at the back of a discharging queue. A vehicle that slows down, but does not have to fully stop upon approach to an intersection can be not deemed to have experienced a stop. The traffic controller 210 can measure the vehicular stops for each movement from the trajectory framework as (counting as one unit for each vehicle in the TF):

$$\text{stops} = \sum_{vehicles} TF\{1, \forall\ \text{vehicle}_{(speed=0)}\}$$

The traffic controller 210 can update this stop calculation once per second for each traffic movement. It can look forward two minutes in time when providing this stop calculation. Phase sequencing and timing decisions can reduce or minimize the impact of the aggregate stops subject to the weighting applied in the objective function, over this two-minute time horizon.

4.3.5 Emissions

The traffic controller's 210 objective function allows signal optimization in regards to vehicle emissions. Since traffic controllers cannot measure vehicle emissions directly, it can apply models for emissions based upon the measured vehicle counts, vehicle type classification, speeds, acceleration rates and idle time while vehicles can be queued at an intersection. There exists sufficient correlative research between vehicle emissions and vehicle trajectory data to provide a reasonable aggregate measure of emissions at the intersection. The goal of this control strategy can be to have an effect upon the vehicular flows so as to reduce aggregate emissions. This goal can be accomplished using these averaged emissions models for vehicles.

In one embodiment, the traffic controller 210 can define vehicle emissions in units of grams or centigrams of carbon monoxide (although other measures of emissions may be used in other embodiments). There can be many pollutants emitted by motorized vehicles, however CO can be preponderant, comprising more than 90% of all pollutants by weight from gasoline engines. In addition, CO emissions carry extensive study and research, allowing reasonable estimation of vehicle emissions from the vehicle trajectory data. The data for CO emissions can be extrapolated into other pollutant types on an aggregate basis; however, the relationship between CO emissions and vehicle trajectory data can be not proportional to the other types of pollutants. As such, any extrapolation of this CO-based control strategy to other pollutant types can only produce loosely correlated estimates.

Figure 12:
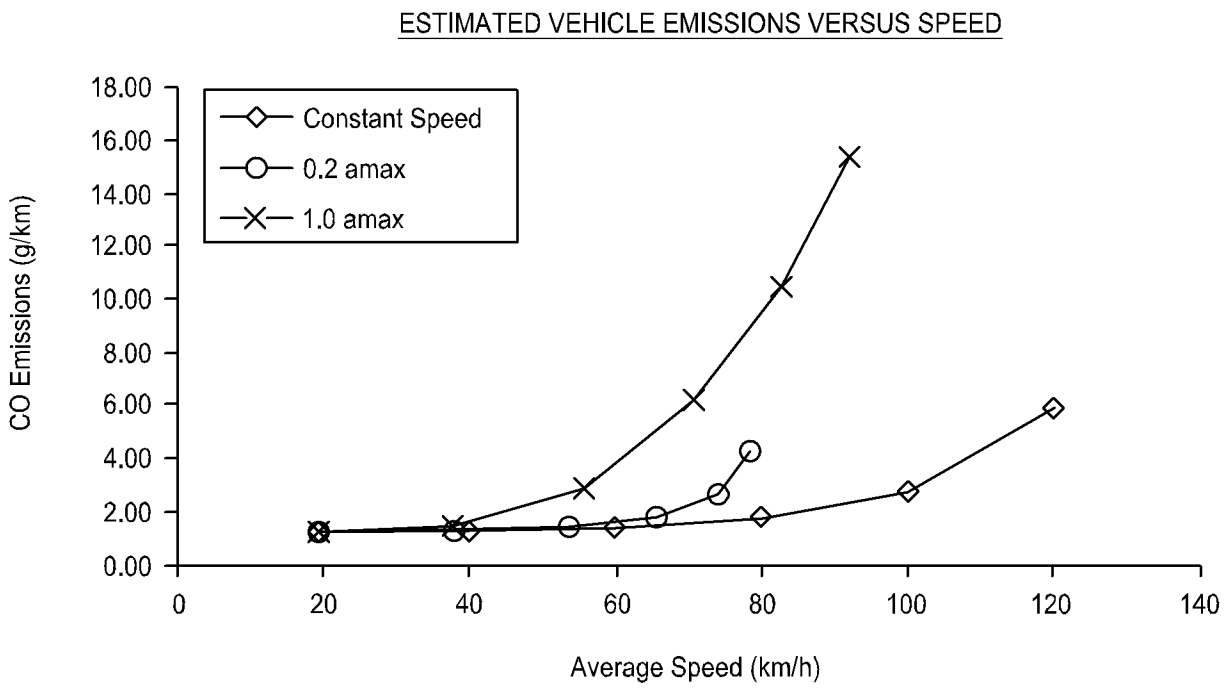
FIG. 12 depicts a graph of estimated vehicle emissions versus vehicle speed.

The traffic controller 210 can provide measurement of vehicle CO emissions using the input measurement of vehicle speeds, accelerations, idle time, and vehicle classification. Virginia Tech has provided significant research on emissions models based upon vehicular stops and acceleration data. The traffic controller 210 can derive a simplified model from this research, specifically, referencing the graphs presented in the VT paper, "Impact of Stops on Vehicle Fuel Consumption and Emissions," authored by Hesham Rakha and Yonglian Ding, which is hereby incorporated by reference in its entirety. This research presents significant datasets relating emissions to speed and vehicle acceleration rates. The traffic controller 210 can apply lookup table approximations to these models so that an average measure can be quickly and easily applied to the vehicle trajectories as they approach toward, and depart from, the intersection. Cobalt can apply a pre-generated table of CO emissions rates based upon average vehicle speed as well as vehicle acceleration drawn from the results of this research. An example from the paper referenced above is provided as an illustrative example of the datasets available in FIG. 12.

The traffic controller 210 possesses vehicle classification information and could include adjustment to these emissions rates to accommodate the differences between vehicle and truck emissions. Current detection systems are not able to accurately determine the specific vehicle type and more importantly, the fuel type (gas or diesel). USDOT has published emissions data based upon vehicle type, which reveals that there can be no longer a significant difference in emissions rates among vehicle sizes: http://www.rita.dot.gov/bts/sites/rita.dot.gov.bts/files/publications/national _transportation_statistics/html/table_04_43.html.

Based upon this data, the traffic controller 210 can treat some or all traveling vehicle types as equal emitters, and provide emissions-based control based upon the speed, stops, and accelerations that can be accommodated via signalized control.

The EPA has published idling emissions rates by vehicle type. The traffic controller 210 can apply the CO idling emissions rates based upon the vehicle classification available. Given the detection cannot discern gasoline or diesel engine types, a blended factor of (for example) 98% gasoline/2% diesel engine type can be applied to small vehicles, and (for example) 80% diesel/20% gasoline rate can be applied to large vehicles. A separate rate can be applied to motorcycles when motorcycle discrimination can be available. Connected vehicles can be expected to provide far greater vehicle classification data. The traffic controller 210 can apply the more accurate emissions rates for these vehicle types when this classification data can be provided.

TABLE 23

Table 1: Average Idle Emission Rates by Pollutant and Vehicle Type[2]

| Pollutant | Units | LDGV | LDGT | HDGV | LDDV | LDDT | HDDV | MC |
|---|---|---|---|---|---|---|---|---|
| CO | g/hr | 71.225 | 72.725 | 151.900 | 7.018 | 5.853 | 25.628 | 301.075 |
| | g/min | 1.187 | 1.212 | 2.532 | 0.117 | 0.098 | 0.427 | 5.018 |

(Source: http://www.epa.gov/otaq/consumer/420f08025.pdf)

The traffic controller 210 can update this emissions calculation regularly, such as once per second, for each traffic movement. It can look forward two minutes in time (or some other value) when providing this calculation. Phase sequencing and timing decisions can reduce or minimize the impact of the aggregate emissions, subject to the weighting applied in the objective function and over this two-minute time horizon.

The traffic controller 210 can determine the baseline emissions that would be produced for some or all vehicles if traveling at design speed through the intersection at the 50th percentile speed under a constant green signal and no interfering traffic conditions. This baseline for emissions can provide a normalization framework for "perfect" emissions levels, similar to the normalization of the delay variable against a "zero delay" intersection.

The traffic controller 210 calculates the gross emissions component within the objective function in one embodiment by measuring the emissions of each vehicle using a lookup table according to the following equation:

$$\text{emissions}_{vehicle} = \sum_{initial\ deceleration}^{return\ to\ FreeFlowSpeed} TF\left\{CO_{\vec{v},\vec{a}_{vehicle}}\right\}$$

The equation above provides the gross emissions of a vehicle through its trajectory where delay is encountered. The amount of emissions that would be generated from a vehicle that travels through the intersection without any delay (constant speed) is subtracted from this trajectory-modeled emissions above so that the net increase of emissions is processed by the objective function. This gross emissions for all vehicles can be logged for offline reporting and analysis within the ATMS.

4.3.6 Safety

As stated above, the traffic controller 210 can support a future state trajectory modeling of vehicles upon approach to, and passage through the intersection. This modeling can determine those vehicles likely to have a safety conflict with another vehicle, pedestrian, or the signal states, based upon this future state trajectory modeling of some or all vehicles in proximity to the intersection.

The traffic controller 210 can utilize this positional modeling in real time to generate a set of safety metrics from the measured trajectories of vehicles against one another, as well as against the current signal indications. The traffic controller 210 measures safety in units of "conflict score." The traffic controller 210 defines conflicts based upon the type and level of conflict. The traffic controller 210 supports a policy statement that can allow the agency to define safety thresholds as well as associate a scoring value to each conflict type (assumed to be scored upon the basis of conflict severity). The following conflicts can be identified and supported within the traffic controller 210 (when appropriate detection can be provided):

TABLE 24

| Conflict Type: | Can be Predicted from Trajectory? | How Measured: | Conflict Score: (default) |
|---|---|---|---|
| Single Car Dilemma Zone Termination | Yes | Vehicle can be located within the dilemma zone upon green termination | 1 |
| Multi Car Dilemma Zone Termination | Yes | Two or more vehicles that share the same lane can be within the dilemma zone upon green termination | 2 * number of vehicles in dilemma zone |
| Large Vehicle Dilemma Zone Termination | Yes | Large Vehicle (per user defined value - defaulted to >40') located in the dilemma zone upon green termination | 3 |
| Red Clearance Violation | Yes | Vehicle clears through the signal past the legal passage point, but prior to conflict of the opposing movements. | 2 |
| Excessive Red Clearance Violation. | Yes | Vehicle clears through the signal past the legal passage, inducing conflict to the opposing movements. | 5 |
| Red Light Violation | Yes | Vehicle disobeys the red light during other phase service. | 10 |
| Excessive Speed | Yes | Vehicle detected in excess of user definable {default 20 mph} above design speed | 1 |
| Excessive Deceleration | Yes | Vehicle detected to excessively decelerate without conflict to vehicle in the same lane. (late recognition of red signal) | 1 |
| Rear End Braking Conflict | Yes | Vehicle detected to provide significant deceleration in conflict to another vehicle in the same lane. | 4 |
| Left Turn Spillover | Yes | Queued vehicles in turn pocket spill into through lanes during green movement of the through phase. | 2 per cycle with spillover event |
| Excessive Left Turn During Phase Clearance. | No | Number of vehicles turning under permissive left turn clearance in excess of user defined allowance (default 2) | 1 for each vehicle above allowance |
| Left Turn Critical Gap Acceptance | No | Left Turning Vehicle detected to turn in gap less than user definable critical gap (default 4.5 seconds) | 2 |
| Permissive Left Turn Phase Failure | Yes | Permissive Left Turning vehicles that can await a second cycle for service. (This promotes critical gap acceptance) | 2 |
| Side street or turning movement phase failure. | Yes | Vehicles that can await a second cycle for service. (This promotes red light running) | 2 |
| Right Turn Gap Conflict | No | Right on red turning vehicle triggering excessive braking of through movement vehicles. | 2 |
| Illegal Left Turn on Red | No | Vehicle detected to violate restricted left turning movement. | 1 |
| Illegal Right Turn on Red | No | Vehicle detected to violate restricted right turning movement. | 1 |
| Illegal U-Turn | No | Vehicle detected to violate restricted U-Turning movement. | 1 |
| Left Turning Vehicle - Pedestrian Conflict | No | Permissive Left Turning Vehicle with pedestrian presence in conflicting section of crosswalk. | 2 |
| Right Turning Vehicle - Pedestrian Conflict | No | Permissive Left Turning Vehicle with pedestrian presence in conflicting section of crosswalk. | 2 |
| Crosswalk Violation | No | Vehicle decelerates into crosswalk (beyond stop line) | 1 |
| Crosswalk Violation with Ped Present | No | Vehicle decelerates into crosswalk with pedestrian present in crosswalk. | 5 |

The traffic controller 210 can perform signal optimization of the safety component within the objective function by assessing the occurrence of these events within the TF across each of the potential green termination points for the current phase timing. The traffic controller 210 may not try to assess the safety impact upon future phases that can be not currently served. This assumption can be valid due to the nature of safety issues being near field imminent conflicts and not something that can be accurately projected far into the future. This assessment can be performed by projecting the future state trajectory of the arriving vehicles against the options for phase termination as computed within the TF. An example of this projective assessment can be provided below:

Green termination: The point of green termination can be influenced by several components within the objective function. The safety conflict score provides an additional measure that can influence the green termination point. While the signal is green, the traffic controller 210 can look ahead into the future distribution of vehicle arrivals on a second-by-second basis and determine the safety conflict score if green termination were to be provided at each of these points in the future. These safety conflicts can be defined as those that can be likely to be created by the green termination of the phase. This can be to include vehicles whose trajectories can place them in the dilemma zone at green termination as well as vehicles whose speeds can be such that they can be predicted to run the red light. This can also include permissively turning vehicles that can be predicted to be stranded in the intersection or left to phase failure.

Some of the safety conflicts in the table above may not be projectable into the future via measurement of vehicle trajectories. The traffic controller 210 can instead measure these conflicts after the fact and use this information as a basis for future cycle changes in control. For example, the determination to provide either protected or permissive green movements can use a rolling average of safety conflicts for the prior permissive movements when assessing the overall safety score for a future protected versus permissive movement.

The traffic controller 210 can store a record of each of these conflicts with timestamp, movement, conflict type, and conflict score for offline analysis.

4.3.7 Capacity

The STM defines capacity, in addition to having its ordinary meaning, as the maximum rate at which vehicles can pass through the intersection under prevailing conditions. For a single movement, the STM defines the capacity, in addition to having its ordinary meaning, by the maximum rate at which vehicles can pass through a given point in an hour under prevailing conditions (known as saturation flow rate), and the ratio of time during which vehicles may enter the intersection.

$$c = s\left(\frac{g - slt}{C}\right)$$

Where:

c=the capacity of the movement (vph)

s=the saturation flow rate for all lanes of the movement (vph)

g=the green time for the movement (seconds)

slt=startup lost time for the movement (seconds)

C=the cycle length (seconds)

The saturation flow rate for a movement may vary based upon location, type of traffic, weather conditions, time of day among other factors. The HCM presents complex treatments to generate average values for the saturation flow rate of a movement, which typically can be in the range of 1500-2000 vehicles per hour per lane (vphpl). The traffic controller 210 does not need to rely upon HCM formulations for capacity of movements and can directly measure the saturation flow rate from the vehicles measured within the TF. The typical assumption of 1900 vphpl can be used as the default value until direct measurement of the saturation flow rate has been performed.

The startup lost time for a movement also varies based upon location, type of traffic, weather conditions, time of day and other factors. The traffic controller 210 does not need to rely upon HCM formulations for startup lost time of movements and can directly measure the startup lost time from the vehicles measured within the TF. The industry standard assumption of 2.2 seconds can be utilized until direct measurement of the startup lost time can be performed.

The traffic controller's 210 objective function allows signal optimization relative to the capacity of each movement. There exists an inherent tradeoff between the other objective function elements and capacity of the movement. As one movement can be granted an increased capacity (green time), the other movements experience an increase in delays, stops, emissions, and even safety (as drivers become more inclined to run red clearances). Extraneous capacity may offer headroom to the movement to provide accommodation for short term increased demand in traffic flows beyond those values used when determining the COS values within the offline optimization. Extraneous capacity can also afford accommodation for vehicles that may not be detected by the system upon approach to the intersection (e.g., those turning onto the street beyond the range of the advance detectors). Extraneous capacity can also allow traffic engineers to designate what phases shall receive any unused time within a fixed cycle length.

The traffic controller 210 can use units of vehicles per cycle or seconds per cycle (where vehicles=seconds/2) to measure and control capacity of each movement. This weighted allowance to increase or decrease the capacity of each approach permits traffic engineers to tune the overall capacity afforded to critical movements relative to the other objectives.

The traffic controller 210 can record the available capacity as well as capacity utilization (V/C) for each movement on a cycle-by-cycle and minute-by-minute basis, so that the traffic engineer can assess the overall capacities, critical movement capacities, and other phase utilization for each movement.

4.3.8 Objective Function Calculation:

The traffic controller 210 can fuse the inputs from one or more detection sources as described in Section 4.1. Per Section 4.2, the traffic controller 210 takes these inputs and generates a trajectory framework for some or all of the detected vehicles that includes not just the present state of each vehicle, but a simulated future state of each vehicle given multiple variations in phase sequence and timing. These calculations can be preparatory to generate the data for the computation of the objective function components.

This preparatory work establishes the following example objective function:

$$f(\text{objective}) = \sum_{m=0}^{movements} w_m(w_d \text{delay}_{movement} + w_s \text{stops}_{movement} + w_e \text{emission}_{movement} + w_s \text{safety}_{movement} - w_c \text{capacity}_{movement})$$

These values can be not just computed using the current phase sequence and timing, but computed given a varying duration for the current phase as well as across varying options of future phase sequencing. The output of this calculation for each of the phase sequence options as well as current phase durations can result in aggregate values of the objective function that can be best visualized by graphing these aggregate objective function scores over time.

Graphing the objective function provides a weighted delay, stops, emissions, safety score, and capacity measure over some or all movements. The traffic controller 210 computes these values for the current phases being served as well as the available options for next phase service from the present point, forward in time. These graphs can facilitate the best selection of a phase termination point, as well as the best selection of next phases to be served in accordance with the minimization of the cumulative objective function for some or all movements.

Figure 10:
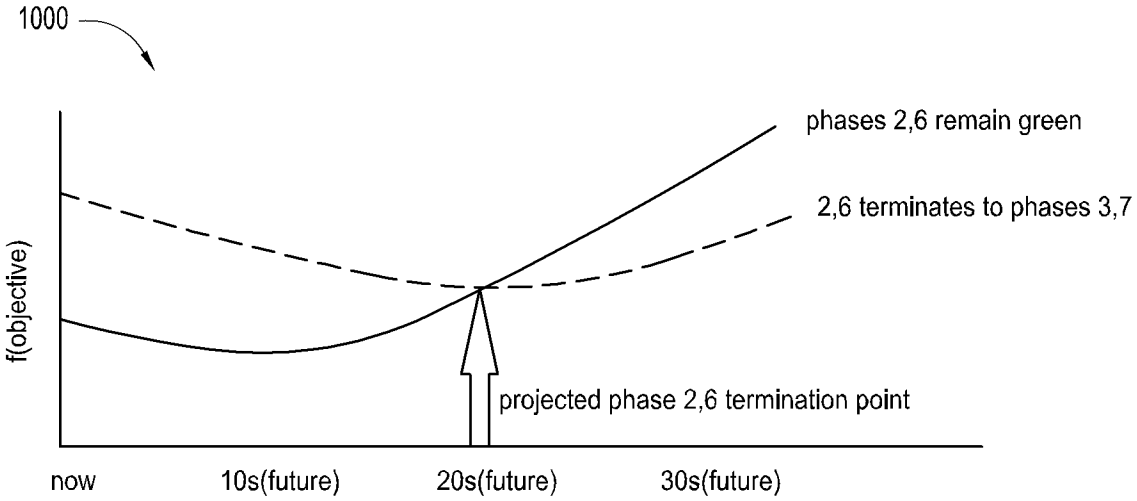
FIG. 10 depicts a graph of example evaluated objective functions.

An example graph 1000 shown in FIG. 10 reveals an example aggregate valuation of the objective function (vertical axis) based upon the addition timing of the current phases 2&6 remaining green for a future duration of 0-35 seconds (green curve). It additionally measures the aggregate valuation of the objective function if the current phases 2&6 terminate to serve phases 3&7. It is evident from this graph that there can be advantages (smaller objective function value) to remaining in 2&6 green until 20 seconds in the future, where the termination to phases 3&7 can provide advantage. This can be identified as the optimal termination point for the phase. This future termination point may not be locked in advance, but recomputed every second to ensure future changes to the traffic trajectories are included in the optimization. Advantageously, in certain embodiments, the traffic controller's 210 computation of the objective function can result in adjusting signal timing from cycle to cycle, which may be far more efficient than current controllers that adjust at most a few times per day.

4.3.9 Application of Phase Split/Max Timing:

The traffic controller 210 can support the application of a maximum green or maximum split timing for a phase. This timing can set an upper limit upon the timing of the current phases that can affect the idealized phase termination point as determined by minimization of the objective function. As the phase termination becomes imminent due to this maximum timing threshold, the decision on when to terminate can become most heavily influenced by the immediate fluctuations in the safety component within the objective function. (Other objective function terms change much more gradually over time) This imminence, in addition to having its ordinary meaning, can be defined as the point in time when some or all possible vehicles to be serviced prior to phase maximum have been detected (can be within the range of detection) and the selection of the termination point becomes a decision of the safest point in time to terminate the phase. If there is not advance detection that provides a sufficient advance time window, traditional gap termination can be applied. An example graph 1100 in FIG. 11 depicts this safety-driven termination point.

Figure 11:
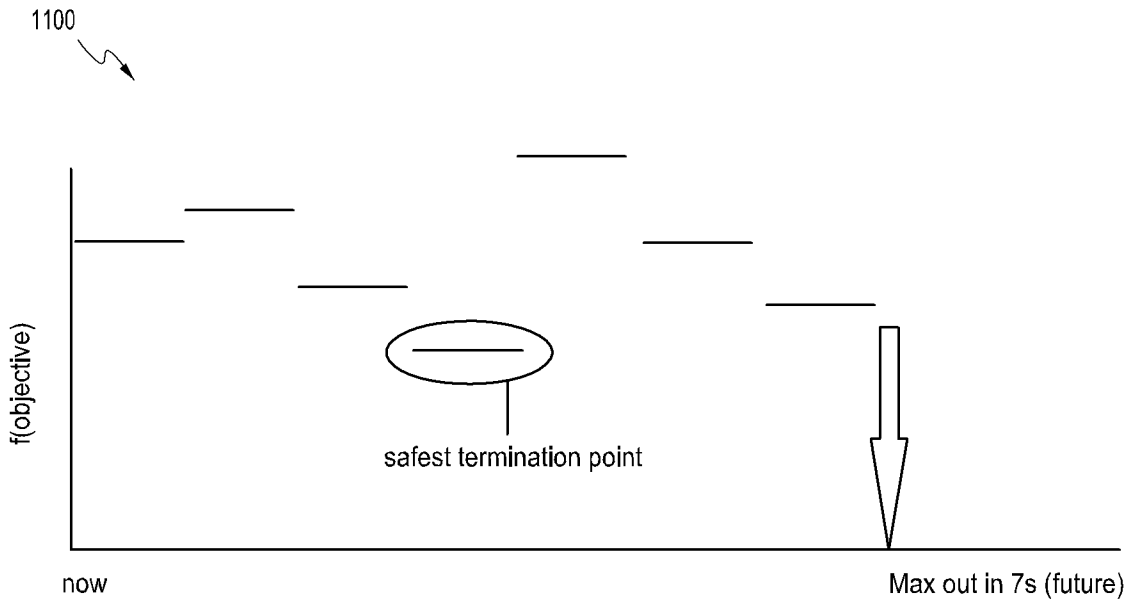
FIG. 11 depicts another graph of an example evaluated objective function.

In certain embodiments, the safety factor results in discontinuity shown in the graph 1100 of FIG. 11. Contributions to the objective function from the safety factor can include a count of vehicles that are in the dilemma zone (e.g., as determined by detecting the vehicles in a dilemma zone specified in the GID and setting the Boolean variable described above). As vehicles enter the dilemma zone, the traffic controller 210 can increase a count of vehicles in the zone and can decrement the count as those vehicles leave. If the objective function were based purely on safety (e.g., because the user-defined weights for other factors were zero), one example implementation of the objective function would be minimized to achieve the fewest number of predicted vehicles in the dilemma zone.

4.3.10 Pseudocode for Objective Function Calculation

The following pseudocode provides a description of the calculation of the objective function across the parameters of the TF:

```
//Iterate through each of the 16 sequence options (this represents the
different curves that can be graphed)
for (sequence = 1; sequence <= 16; sequence += 1)
{
 //Starting now, iterate through each of the active phase durations for the
current phases up to the max time for the current phases
 // (this represents the x axis of the graph)
for (time = now; time < ActivePhaseMaxTime; time += 1 second)
{
 //Iterate through all movements (this represents the summation
 Σ over all movements) for(movement = 1; movement <=
 max_movements; movement++)
 {
     //Create a temporary variable to hold the ObjectiveFunction value
for the movement
  OF_movement = 0
  //Add the weighted delay component to the objective function
  OF_movement += weight_delay*delay[sequence][time]
  //Add the weighted stops component to the objective function
  OF_movement += weight_stops*stops[sequence][time]
  //Add the weighted emissions component to the objective function
  OF_movement += weight_emissions*emissions[sequence][time]
  //Add the weighted safety component to the objective function
  OF_movement += weight_safety*safety[sequence][time]
  //Add the weighted capacity component to the objective function
  OF_movement += weight_capacity*capacity[sequence][time]
  //Apply the movement weighting
  OF_movement *= weight_movement
  //Add the per-movement value to the aggregate Objective Function
  valuation
  ObjectiveFunction[sequence][time] += OF;
}}}
```

4.4 Intersection Control Mechanism from the Objective Function Calculation

Once the Objective Function has been computed for each sequence and active phase duration (stored within ObjectiveFunction[sequence][time]), in one embodiment, the minimum overall value is selected from this array as the "optimal" sequence and optimal time to serve the currently active phases. As an example, if the minimum value is found in the array at ObjectiveFunction[3][23], the phase sequence 3 is the optimal phase sequence and 23 seconds is the optimal time to remain in the current phase or phases. This optimal sequence and phase duration may be recomputed regularly, such as once every second, until the completion of the optimal time to remain in the current phases is considered imminent. Imminence may be determined by calculating an imminence time value, which can be the average (or another statistical measure such as median) time difference between initial vehicle trajectory detection and the time at which vehicles enter the dilemma zone, or 5 seconds or a similar value (whichever is greater). At the point of imminence, where the completion of the optimal time is at or within an imminence time value away, the phase sequence and phase duration may be locked in and may not be changed in certain embodiments. Thus, at this point the phase termination point and the phase sequence may be deterministically defined. However, if the parameters (phase termination point and phase sequence) are changed prior to imminence, they are then passed on to the phase timing module (in the cycle logic 216) within the traffic controller 210 for implementation by the traffic controller.

These parameters are passed to the cycle logic upon or after the point of imminence in one embodiment because in certain embodiments the output of the objective function may only communicate to the traffic controller core real-time commands that are assured. The interim calculations of the objective function can bounce around based upon real-time vehicle trajectories, and there may be no need to burden the cycle logic with those changes. In other embodiments, the controller updates the cycle logic in real time or sooner than the point of imminence.

4.5 Additional Example Optimization Components

The objective function provides a mechanism for optimizing the future phase sequence and duration of the active phase green. There can be additional phase control applications that the traffic controller 210 performs. This section describes some examples of such applications.

4.5.1 Dynamic Red Clearance:

Although the traffic controller's 210 objective function attempts to terminate green when no vehicles are placed into a dilemma zone, there can be certain to be vehicles that decide to run a red light after green termination. The traffic controller 210 offers additional safety by dynamically applying red clearance time as needed for the safe passage of the vehicles that can be detected to be running the red signal. This timing can be updated in real time as the vehicle can be tracked throughout its movement through the intersection. The red clearance interval can be allowed to terminate when the vehicle(s) has fully cleared the intersection in accordance with the TF trajectory for the vehicle.

Figure 13:
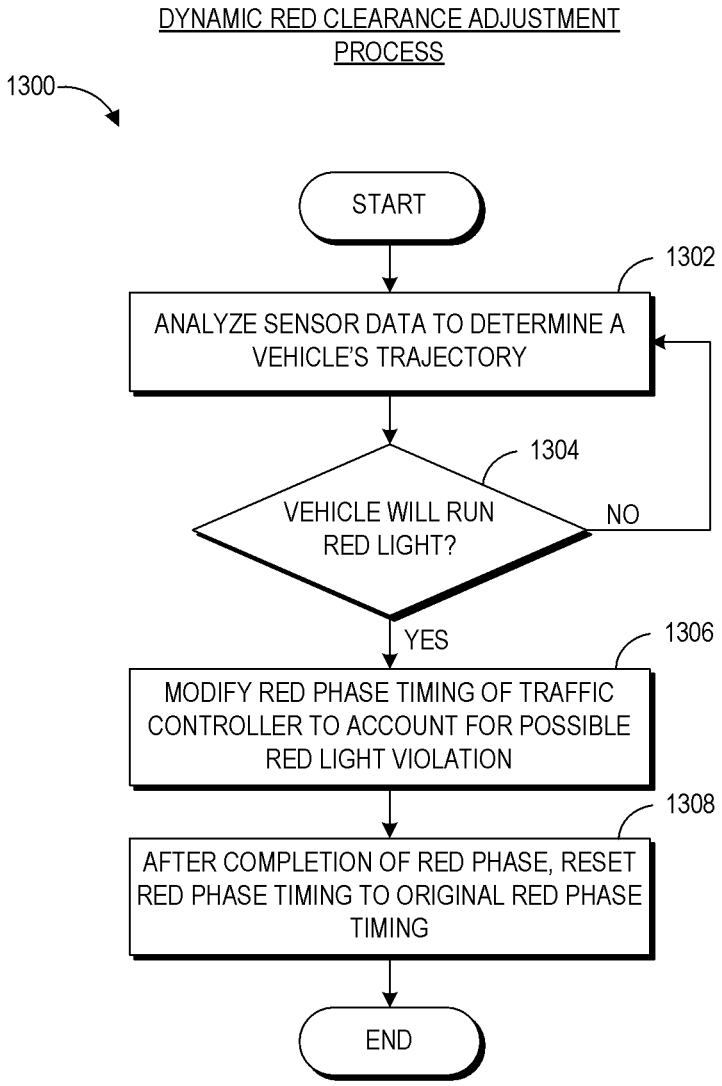
FIG. 13 depicts an embodiment of a dynamic red clearance adjustment process.

For example, referring to FIG. 13, in one embodiment a process 1300 for adjusting dynamic red clearance is as follows, implemented by the traffic controller 210. At block 1302, the traffic controller 210 analyzes sensor data to determine a vehicles trajectory as described above. From this trajectory data, the traffic controller 210 determines (e.g., predicts) at block 1304 whether the vehicle will run or is running a red light. If not, the process 1300 loops back to block 1302. But if the light will be or is being run, the traffic controller 210 modifies (e.g., extends) the red phase timing to account for the possible red light violation at block 1306. By extending the red phase (optionally up to some maximum value), the traffic controller 210 can forestall vehicles from opposing lanes moving into the intersection on green, thereby preventing or reducing the chance of an accident. At block 1308, the traffic controller 210 can reset the red phase timing after completion of the red phase to the red phase timing before the red phase was extended.

4.5.1.1 Non-Real Time Safety Control:

Some of the safety conflicts in the table above may not be predictable via measurement of future vehicle trajectories, but can be measured "after the fact." The traffic controller 210 can use this information as a basis for safety improvements in the subsequent phase cycles.

As an example, the traffic controller 210 can determine whether to provide a protected or permissive turning movement based upon a rolling average of safety conflicts for the prior permissive movements and opposing phase gap profiles.

One of the most common sources of intersection accidents stems from a left-turning vehicle that does not have a sufficient gap between vehicles in the opposing traffic. The traffic controller 210 supports measurement of the opposing vehicle gap profiles available to drivers, as well as measurement of the gaps taken by drivers during permissive left turning movements. The traffic controller 210 can automatically manage the duration of protected left turn movements based upon comparison of the oncoming traffic gap availability versus turning movement demand. The traffic controller 210 can monitor and report the characteristics of the gap acceptance profiling for further analysis and treatment by the traffic engineer.

4.5.2 Base Intersection Pre-Configuration:

Currently available traffic controllers may require a traffic engineer to manually configure the traffic controller parameters consistent to agency policies, roadway geometry, traffic flow characteristics, HCM standard practices, as well as any optimization modeling that has been performed. In contrast, the traffic controller 210 can utilize its geometric awareness of the intersection, as well as real-time vehicle trajectory data to automatically configure and optimize the intersection timing parameters consistent to the agency policies. Doing so can transcend the traditional labor-intensive methods of STM-based computation currently may be required of the traffic engineer, and can become the first-ever "self-configuring" traffic controller 210.

4.5.3 Automatic Policy Implementation and Monitoring:

Most agencies currently publish a policy or standard that governs signal timing practices. These policies can be used by the agency's traffic engineers as guidance when manually configuring the intersection. This implementation of the policy may requires a human-in-the-loop, to ensure signal timing can be consistent to agency policies. Many traffic cabinet design sheets may require a licensed Professional Engineer (PE) to certify that the traffic controller 210 configuration is consistent with agency policies and standard practices.

Even when a signal is set up to be initially consistent with agency policies, future changes in traffic flow patterns or localized changes made to the configuration by signal technicians can later render the intersection inconsistent to policy. Currently, there can be no solution to this human-in-the-loop conversion and management of agency policies. In contrast, the ATMS 242, as described above, can include a software tool that can automatically convert the agency traffic control policy statement into signal timing constraints within the traffic controller 210. This software can ensure or attempt to ensure that the traffic controller 210 is running consistent to agency policy and/or report an alarm condition if the traffic signal operation deviates from the established policies. The alarm condition may be detected, for example, when an update to the signal timing proposed by the traffic controller 210 would violate one or more of the policies programmed into the traffic controller 210 (e.g., by a traffic engineer using the user interface 600 of FIG. 6 or the like). The alarm can be transmitted over a network to a traffic engineer's device instead of overriding the policy. The alarm may include text, for instance, that reports the recommended signal timing change and the policy that would be violated by making that change. As a result of the alarm, the traffic engineer can decide whether to permit the change and may communicate remotely with the traffic controller 210 to effectuate the change. In other embodiments, the traffic controller 210 can override the policy and make the change in addition to or instead of sending an alarm.

4.5.4 Weather Variant Traffic Control:

Since the traffic controller 210 can utilize speed, acceleration, and deceleration profiles of vehicles as a basis for modeling vehicle behavior, the traffic controller 210 provides a mechanism of optimizing traffic control with automatic adaptation to changes in weather and other conditions that affect the fundamental traffic behavior.

Current weather responsive systems may require roadway instrumentation that often include in-pavement sensors of the roadway temperature and precipitation. Traffic engineers configure these sensors to trigger a change within the traffic controller 210 to a predefined set of alternate timing that was optimized for the slower conditions expected under poor weather events. The traffic controller 210 can be the first traffic control software that automatically adapts to weather conditions without the need for weather measurement devices. This can be accomplished as a natural result of the automated calculation of vehicle trajectories consistent to the real-time measured speed, and acceleration vectors of the vehicles, which would ordinarily change due to weather. Thus, the traffic controller 210 need not measure weather directly to change phase timing to account for weather.

4.5.5 Speed Enforcement During Late Night Operations:

When optimized for vehicle stops and delay during late night operation, the traffic controller 210 can provide highly synchronized service of green intervals given the far advance detection of the scarce vehicles on the roadway. This may affect driver behavior and induce a pattern of speeding with a priori expectation of green service. The traffic controller 210 can mitigate this excessive speeding by adjusting the excessive speed conflict score within the objective function. The traffic controller 210 can provide a red light to excessively speeding vehicles in an attempt to mitigate this safety concern.

Traffic engineers have historically implemented speed trap detectors and detection logic within the traffic controller 210 that detects speeding vehicles and provides a red light to mitigate their speed. This feature can be automatically derived from the base design capabilities of the traffic controller 210 objective function.

4.5.6 Platoon Arrival Optimization:

It is standard practice for multiple intersections along an arterial to time the main street green interval to a fixed-time offset from the green interval of the upstream signal. This standardized practice of green "offset" provides better progression for the platoons of vehicles traveling along the arterial. However, this green offset can be disrupted when a standing queue at the intersection first clears itself out prior to the platoon arrival. The objective function of the traffic controller 210 can offer a mechanism to provide advance clearance of the standing queue so that the queue can discharge itself in a synchronized manner prior to the platoon's arrival. This benefit may fall out of the design of the objective function naturally due to taking into account vehicle arrivals into queues at the intersection, from adjacent intersections and/or from mid-block ingresses.

4.6 Other Benefits:

Moreover, this mechanism of traffic control based upon policy definition, geometric awareness, trajectory modeling and traffic control via a user definable objective function provides many other advances to the current state of traffic control.

Terminology

Many other variations than those described herein can be apparent from this disclosure. For example, depending on the embodiment, certain acts, events, or functions of any of the algorithms described herein can be performed in a different sequence, can be added, merged, or left out altogether (e.g., not all described acts or events can be necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. In addition, different tasks or processes can be performed by different machines and/or computing systems that can function together.

Not necessarily all such advantages are achieved in accordance with any particular embodiment of the embodiments disclosed herein. Thus, the embodiments disclosed herein can be embodied or carried out in a manner that achieves or optimizes one advantage or group of advantages as taught herein without necessarily achieving other advantages as may be taught or suggested herein.

The various illustrative logical blocks, modules, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality can be implemented as hardware or software depends upon the particular application and design constraints imposed on the overall system. The described functionality can be implemented in varying ways for each particular application, but such implementation decisions should not be interpreted as causing a departure from the scope of the disclosure.

The various illustrative logical blocks and modules described in connection with the embodiments disclosed herein can be implemented or performed by a machine, such as a hardware processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A hardware processor can be a microprocessor, but in the alternative, the processor can be a controller, microcontroller, or state machine, combinations of the same, or the like. A processor can include electrical circuitry or digital logic circuitry configured to process computer-executable instructions. In another embodiment, a processor includes an FPGA or other programmable device that performs logic operations without processing computer-executable instructions. A processor can also be implemented as a combination of computing devices, e.g., a combination of a DSP and a microprocessor, a plurality of microprocessors, one or more microprocessors in conjunction with a DSP core, or any other such configuration. A computing environment can include any type of computer system, including, but not limited to, a computer system based on a microprocessor, a mainframe computer, a digital signal processor, a portable computing device, a device controller, or a computational engine within an appliance, to name a few.

The steps of a method, process, or algorithm described in connection with the embodiments disclosed herein can be embodied directly in hardware, in a software module stored in one or more memory devices and executed by one or more processors, or in a combination of the two. A software module can reside in RAM memory, flash memory, ROM memory, EPROM memory, EEPROM memory, registers, hard disk, a removable disk, a CD-ROM, or any other form of non-transitory computer-readable storage medium, media, or physical computer storage known in the art. An example storage medium can be coupled to the processor such that the processor can read information from, and write information to, the storage medium. In the alternative, the storage medium can be integral to the processor. The storage medium can be volatile or nonvolatile. The processor and the storage medium can reside in an ASIC.

Conditional language used herein, such as, among others, "can," "might," "may," "e.g.," and the like, unless specifically stated otherwise, or otherwise understood within the context as used, are generally intended to convey that certain embodiments include, while other embodiments do not include, certain features, elements and/or states. Thus, such conditional language is not generally intended to imply that features, elements and/or states are in any way may required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" mechanism one, some, or all of the elements in the list. Further, the term "each," as used herein, in addition to having its ordinary meaning, can mean any subset of a set of elements to which the term "each" is applied.

Disjunctive language such as the phrase "at least one of X, Y, or Z," unless specifically stated otherwise, can be otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments may require at least one of X, at least one of Y, or at least one of Z to each be present.

Unless otherwise explicitly stated, articles such as "a" or "an" should generally be interpreted to include one or more described items. Accordingly, phrases such as "a device configured to" is intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

While the above detailed description has shown, described, and pointed out novel features as applied to various embodiments, it is understood that various omissions, substitutions, and changes in the form and details of the devices or algorithms illustrated can be made without departing from the spirit of the disclosure. As is recognized, certain embodiments of the inventions described herein can be embodied within a form that does not provide all of the features and benefits set forth herein, as some features can be used or practiced separately from others.

What is claimed is:

1. A self-configuring traffic signal controller apparatus, the apparatus comprising:

a plurality of inputs that receive sensor signals from a plurality of trajectory sensors at an intersection, each trajectory sensor comprising one or more of the following: an ultrasound sensor, a radar, or a video camera;

a plurality of outputs that transmit first control signals to traffic signal heads at the intersection to cause the traffic signal heads to selectively turn on and off traffic signals;

a storage device having stored thereon geometric intersection data representing a geometry of the intersection and cycle data representing a signal timing configuration for different phases of a signal cycle of the intersection;

electronic hardware that:

generates trajectory data from the plurality of inputs and the geometric intersection data, the trajectory data comprising information representing at least current and predicted future vehicle speeds and positions with respect to the geometric intersection data;

automatically reconfigures the signal timing configuration multiple times per day by analyzing the trajectory data according to a balancing of different user-defined factors; and adjusts the plurality of outputs based on the reconfigured signal timing configuration to transmit second control signals to the traffic signal heads to cause the traffic signal heads to selectively turn on and off the traffic signals according to the reconfigured signal timing configuration;

wherein the electronic hardware generates the trajectory data multiple times within a single traffic signal cycle until a calculated time to remain in a current phase has been reached.

2. The apparatus of claim 1, wherein the electronic hardware generates the trajectory data in part by sending the geometric intersection data to the trajectory sensors so that the trajectory sensors are configured to send inputs to the traffic controller that are described with respect to a coordinate frame matching a geometry of the intersection.

3. The apparatus of claim 1, wherein the inputs from the trajectory sensors are not described with respect to a coordinate system corresponding to a geometry of the intersection, and wherein the traffic controller generates the trajectory data by transforming the inputs into the coordinate system based on the geometric intersection data.

4. The apparatus of claim 1, wherein the electronic hardware generates the trajectory data in part from predicted traffic volumes in addition to the inputs received from the trajectory sensors.

5. The apparatus of claim 1, wherein the electronic hardware generates the trajectory data in part from traffic data reported from second traffic controllers of second intersections adjacent to the intersection in addition to the inputs received from the trajectory sensors.

6. The apparatus of claim 1, wherein the electronic hardware generates the trajectory data in part by predicting the future vehicle speeds and positions based on estimated or measured acceleration data.

7. The apparatus of claim 1, wherein the user-defined factors comprise two or more of the following: delay, vehicle stops, intersection capacity, emissions, and safety.

8. The apparatus of claim 1, wherein the electronic hardware comprises a co-processor or separate circuit board that overrides a traffic controller.

9. The apparatus of claim 1, wherein the electronic hardware automatically reconfigures the signal timing configuration by selecting a traffic phase from a plurality of possible traffic phases and selecting a phase termination time from a plurality of possible phase termination times.

10. The apparatus of claim 1, wherein the calculated time is based on an average time difference between initial vehicle trajectory detection, obtained from the trajectory data, and a time at which vehicles are detected from the plurality of inputs as entering a dilemma zone.

11. The apparatus of claim 10, wherein the electronic hardware automatically reconfigures the signal timing configuration in response to reaching the calculated time.

* * * * *